US011781257B2

(12) United States Patent
Takizawa et al.

(10) Patent No.: US 11,781,257 B2
(45) Date of Patent: Oct. 10, 2023

(54) SEWING MACHINE

(71) Applicant: NSD CORPORATION, Nagoya (JP)

(72) Inventors: Yoshichika Takizawa, Nagoya (JP); Hirotsugu Uenishi, Nagoya (JP)

(73) Assignee: NSD CORPORATION, Nagoya (JP)

( * ) Notice: Subject to any disclaimer, the term of this patent is extended or adjusted under 35 U.S.C. 154(b) by 137 days.

(21) Appl. No.: 17/438,137

(22) PCT Filed: Mar. 14, 2019

(86) PCT No.: PCT/JP2019/010598
§ 371 (c)(1),
(2) Date: Sep. 10, 2021

(87) PCT Pub. No.: WO2020/183714
PCT Pub. Date: Sep. 17, 2020

(65) Prior Publication Data

US 2022/0162789 A1 May 26, 2022

(51) Int. Cl.
*D05B 47/04* (2006.01)
*D05B 19/12* (2006.01)
(Continued)

(52) U.S. Cl.
CPC ..... *D05B 47/04* (2013.01); *D05B 19/12* (2013.01); *D05B 45/00* (2013.01); *D05C 3/02* (2013.01); *D05C 11/08* (2013.01)

(58) Field of Classification Search
CPC ..... D05B 45/00; D05B 47/04; D05B 19/12; D05C 3/02; D05C 5/00; D05C 11/08
See application file for complete search history.

(56) References Cited

U.S. PATENT DOCUMENTS 4,690,083 A 9/1987 Hara et al.
5,022,335 A * 6/1991 Hanyu ..... D05B 45/00 112/475.05
(Continued)

FOREIGN PATENT DOCUMENTS

JP H05-212183 A 8/1993
WO 2010/147023 A1 12/2010
(Continued)

OTHER PUBLICATIONS

Supplementary European Search Report dated Sep. 26, 2022, issued for Euroepan Patent Applicatio No. 19919266.7.
(Continued)

*Primary Examiner* — Nathan E Durham
(74) *Attorney, Agent, or Firm* — Locke Lord LLP

(57) ABSTRACT

A low-cost sewing machine capable of achieving a desired balance between needle thread consumption and bobbin thread consumption is described. A memory section stores needle thread requirement data having precorrected needle thread requirement and postcorrected needle thread requirement. In a torque control zone, rotating force is imparted to a turning arm so as to impart a tension on the needle thread according to a torque value, while closing an upstream grip section main body and while opening a downstream grip section main body. In a first position control zone, the needle thread is drawn according to the postcorrected needle thread requirement, while opening the upstream grip section main body and while closing the downstream grip section. In a second position control zone, the turning arm is returned to an initial position, while closing the upstream grip section main body and while opening the downstream grip section main body.

23 Claims, 43 Drawing Sheets

(51) Int. Cl.

| | |
|---|---|
| ***D05B 45/00*** | (2006.01) |
| ***D05C 11/08*** | (2006.01) |
| ***D05C 3/02*** | (2006.01) |

(56) References Cited

U.S. PATENT DOCUMENTS

| | | | | |
|---|---|---|---|---|
| 8,640,637 | B2 | 2/2014 | Takizawa et al. | |
| 8,794,167 | B2 | 8/2014 | Takizawa et al. | |
| 9,016,218 | B2 | 4/2015 | Fujiura et al. | |
| 2007/0119353 | A1* | 5/2007 | Nakata ..... | D05B 49/04 112/2 |
| 2016/0153129 | A1 | 6/2016 | Takizawa et al. | |

FOREIGN PATENT DOCUMENTS

| | | | |
|---|---|---|---|
| WO | 2012/014610 | A1 | 2/2012 |
| WO | 2013/047477 | A1 | 4/2013 |

OTHER PUBLICATIONS

Office Action dated Oct. 10, 2022, issued for Application No. 201980094060.5 and brief English description thereof.

* cited by examiner

[FIG. 1]
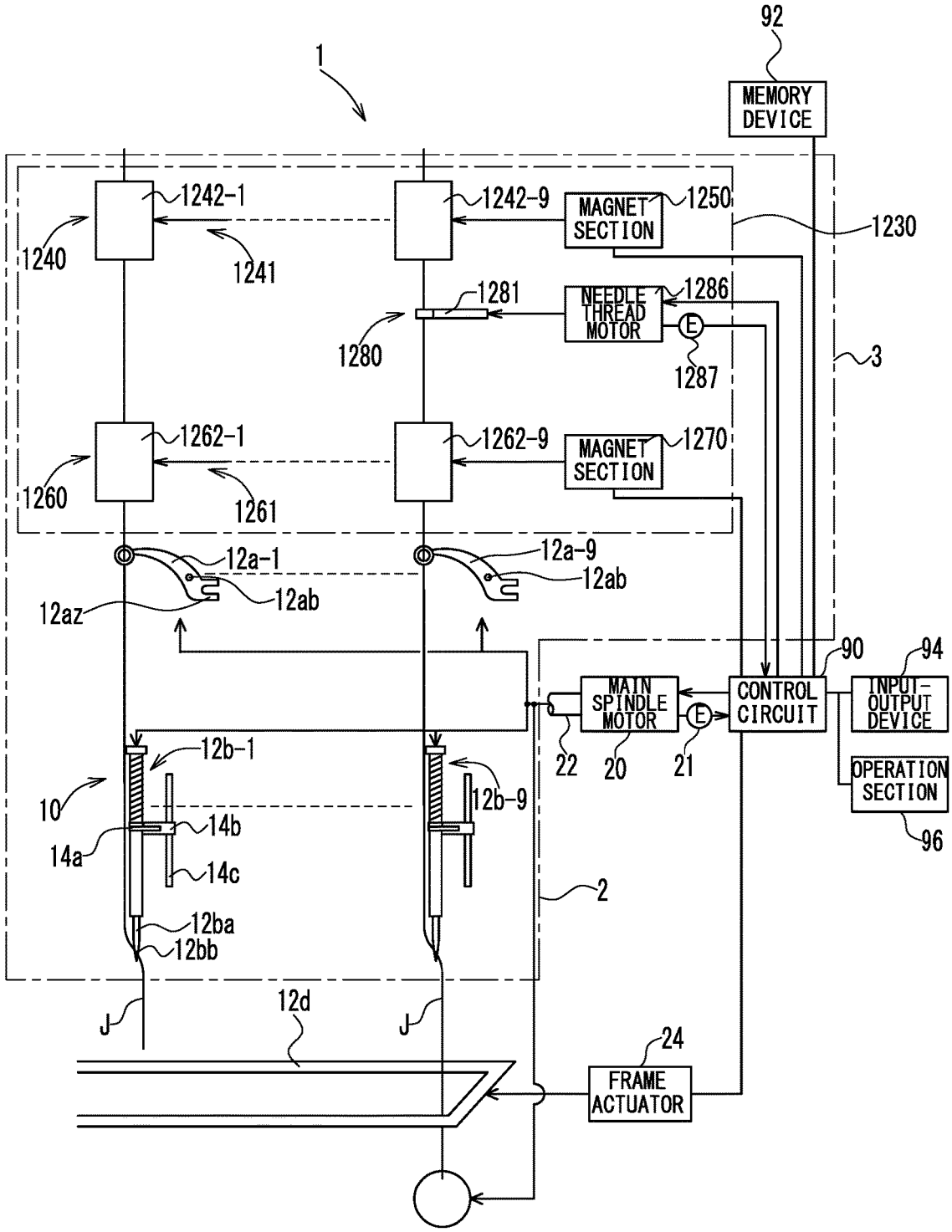

[FIG. 2]
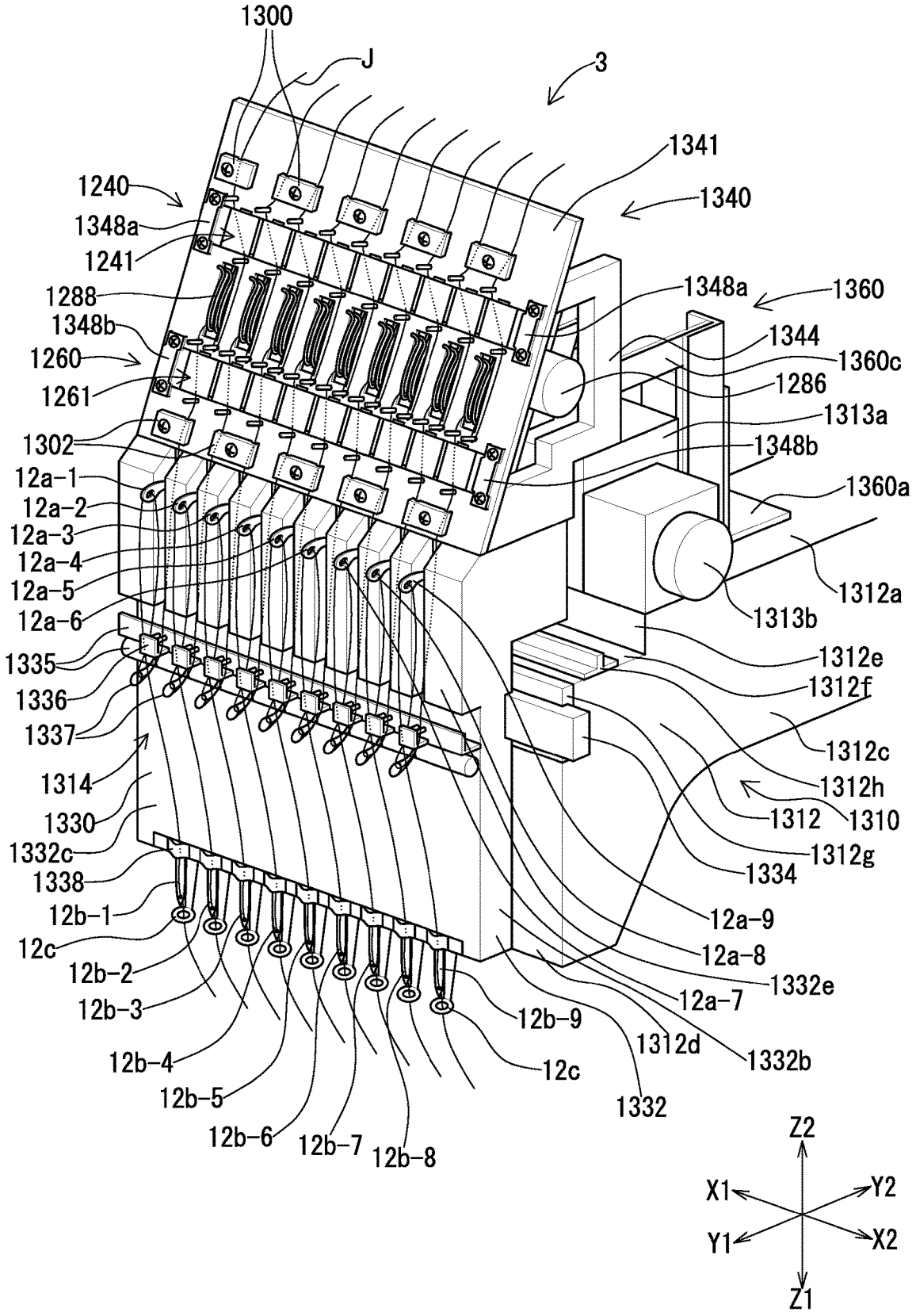

[FIG. 3]
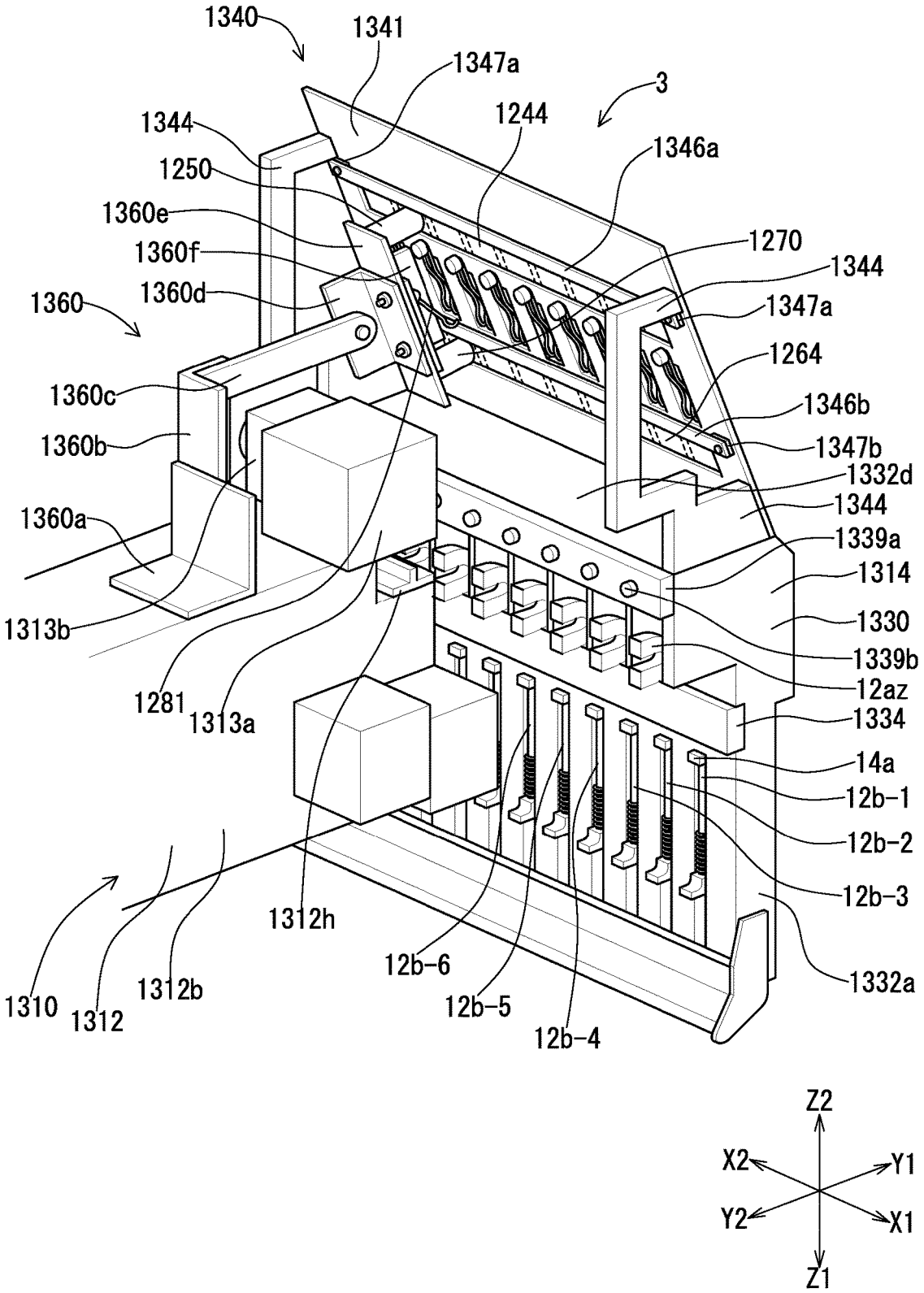

[FIG. 4]
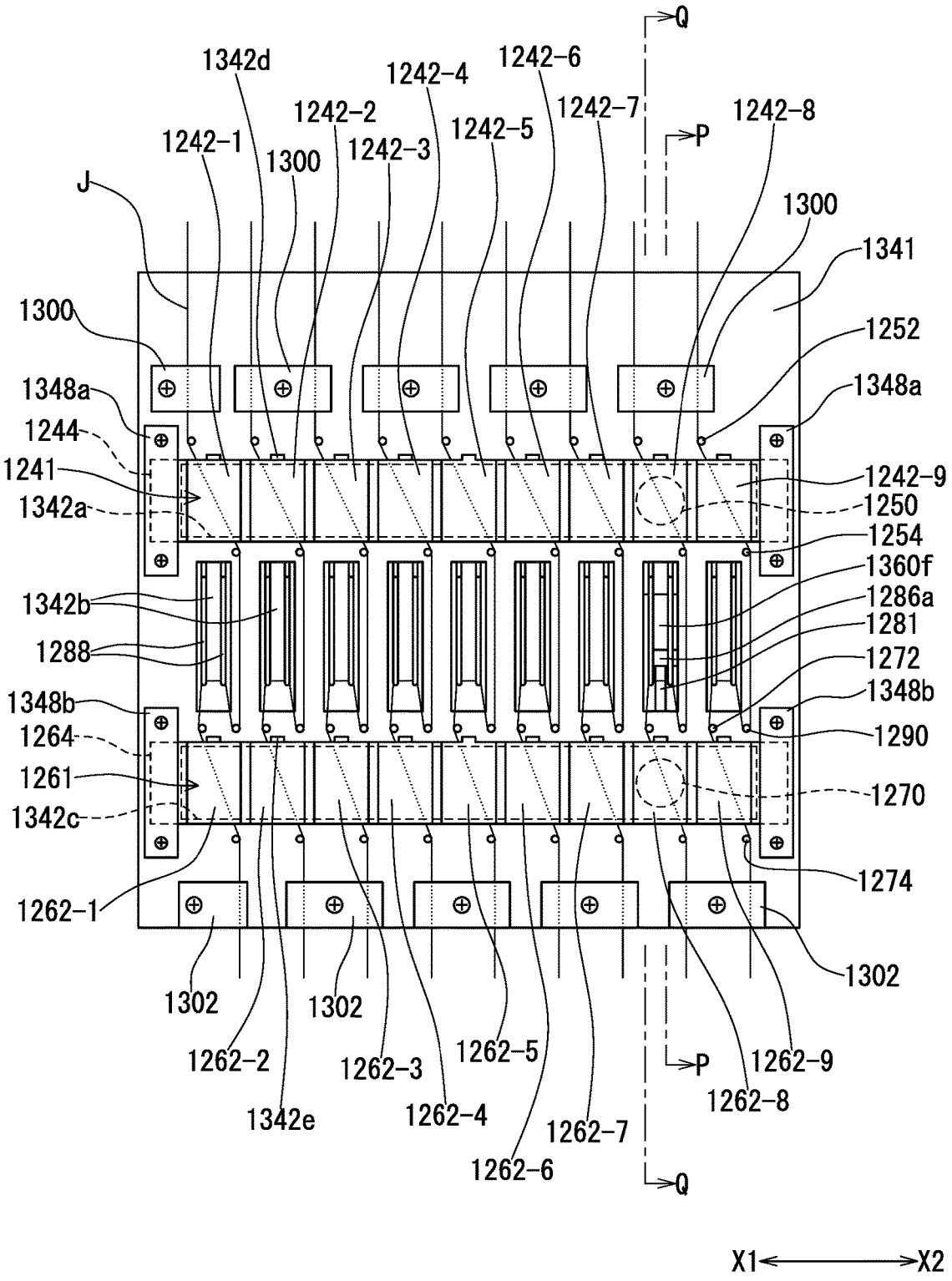

[FIG. 5]
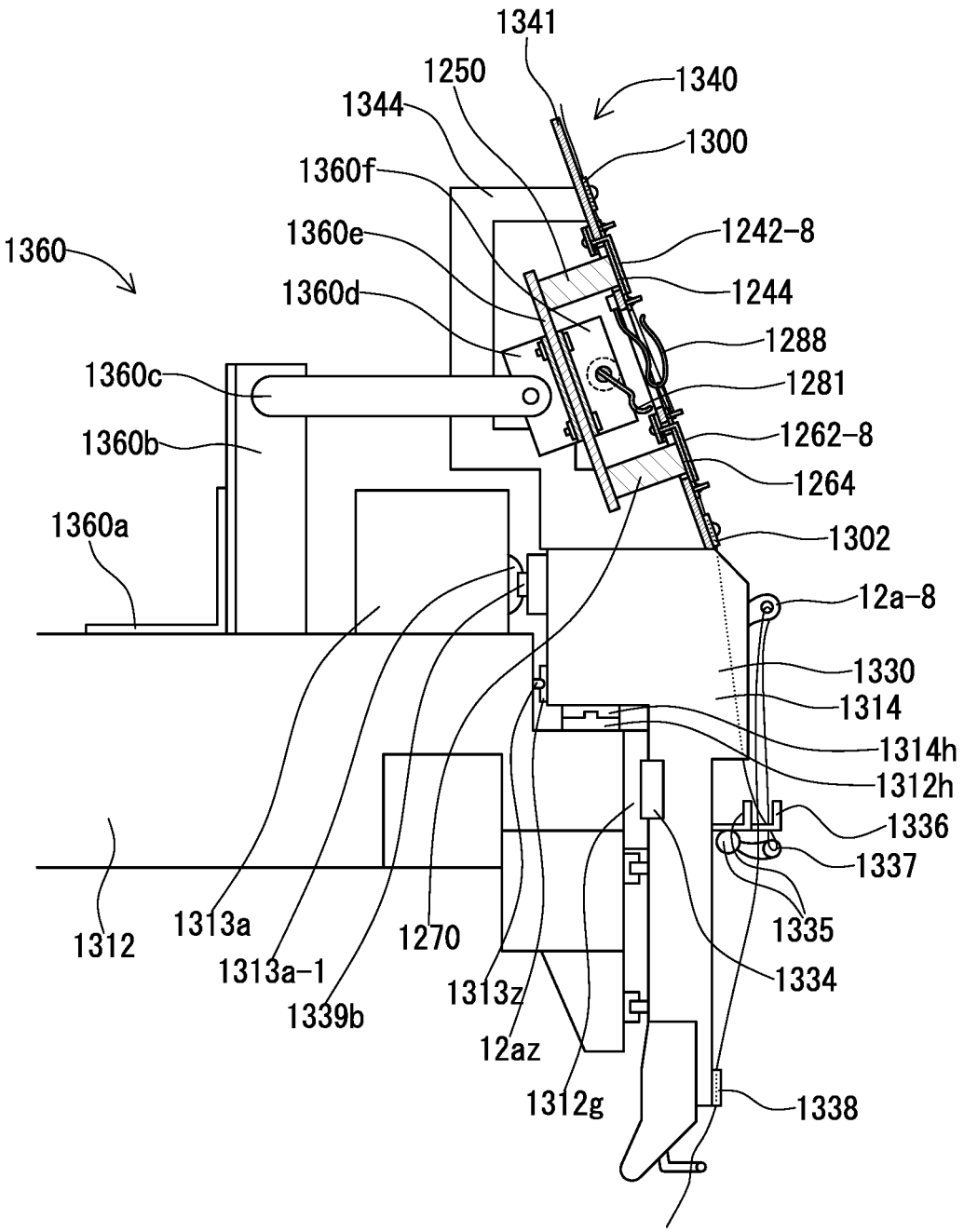

[FIG. 6]
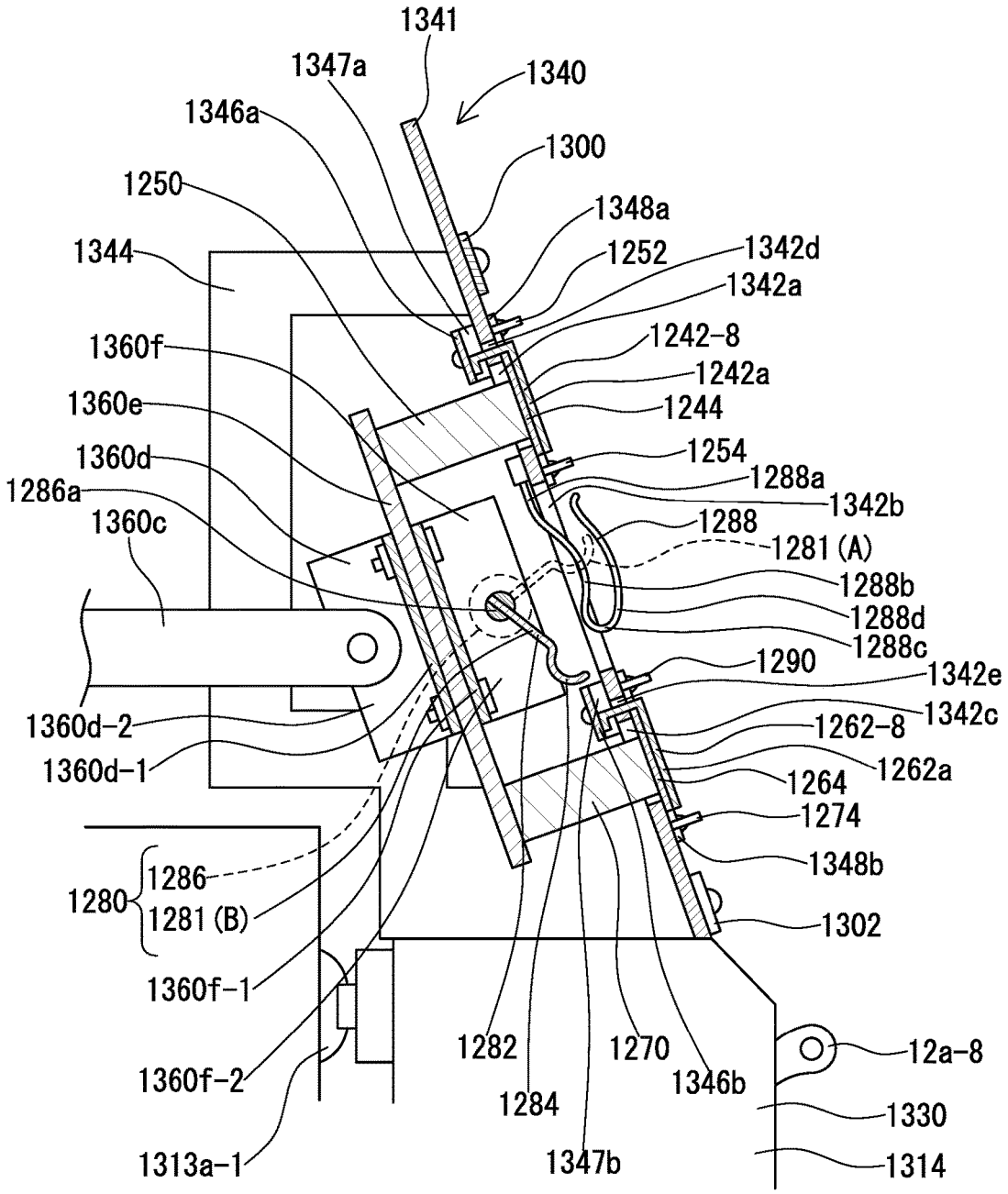

[FIG. 7]
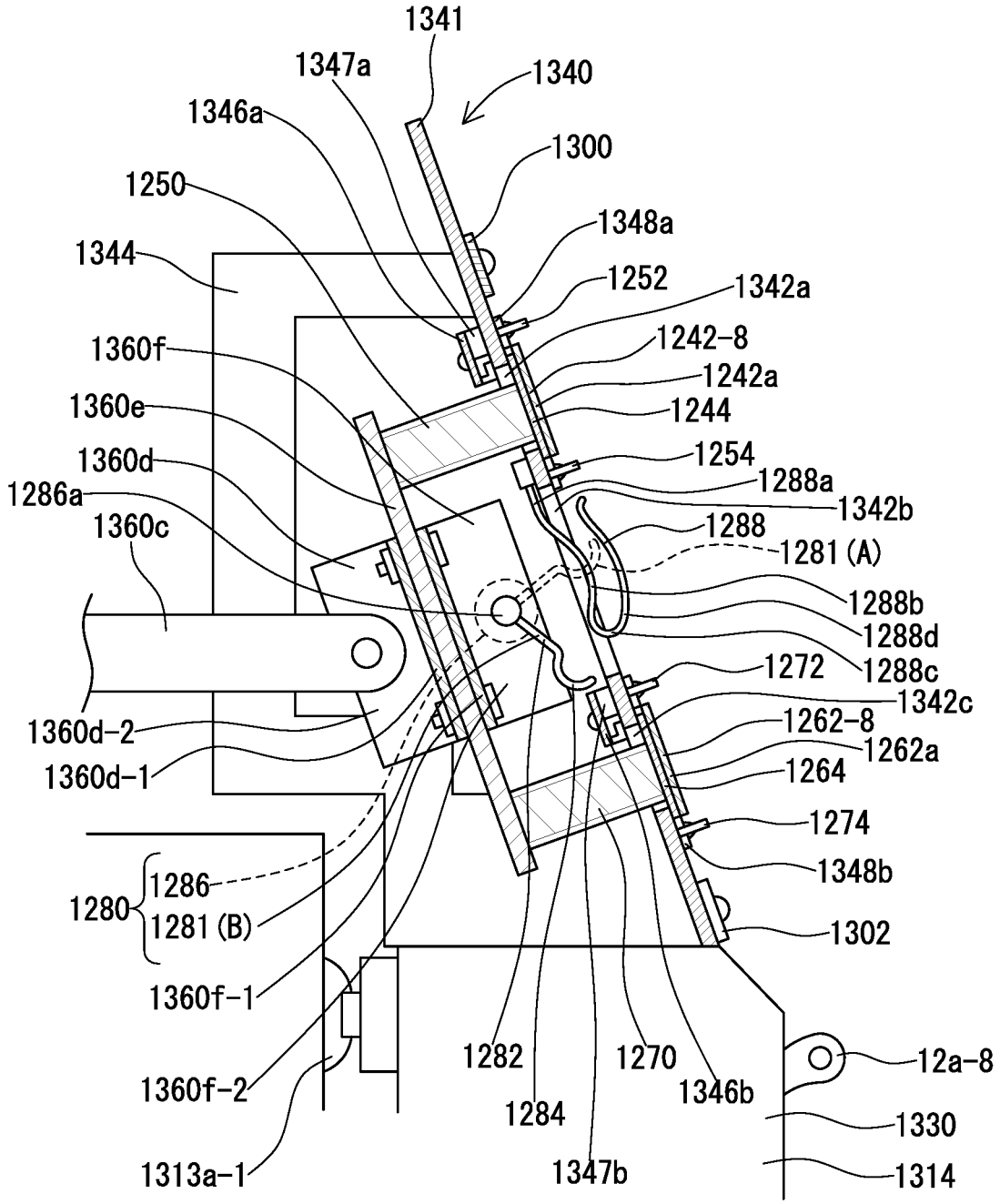

[FIG. 8]
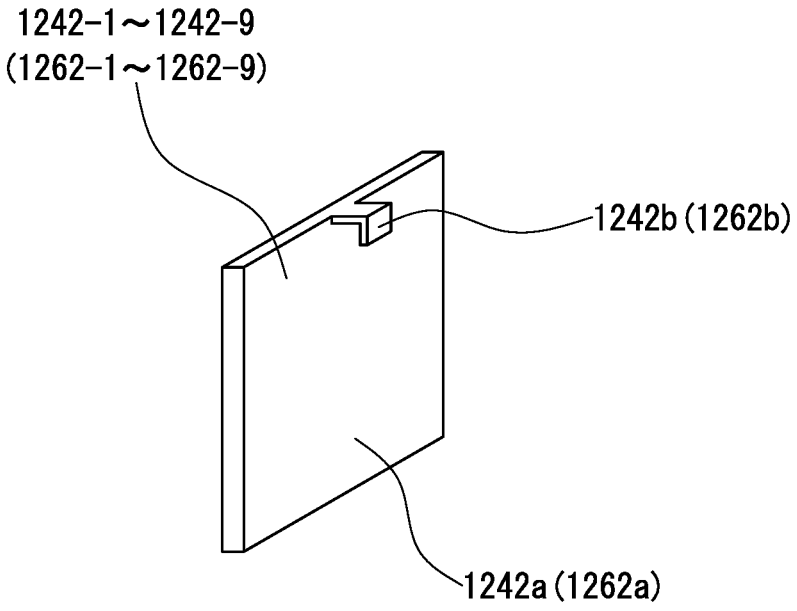

[FIG. 9]
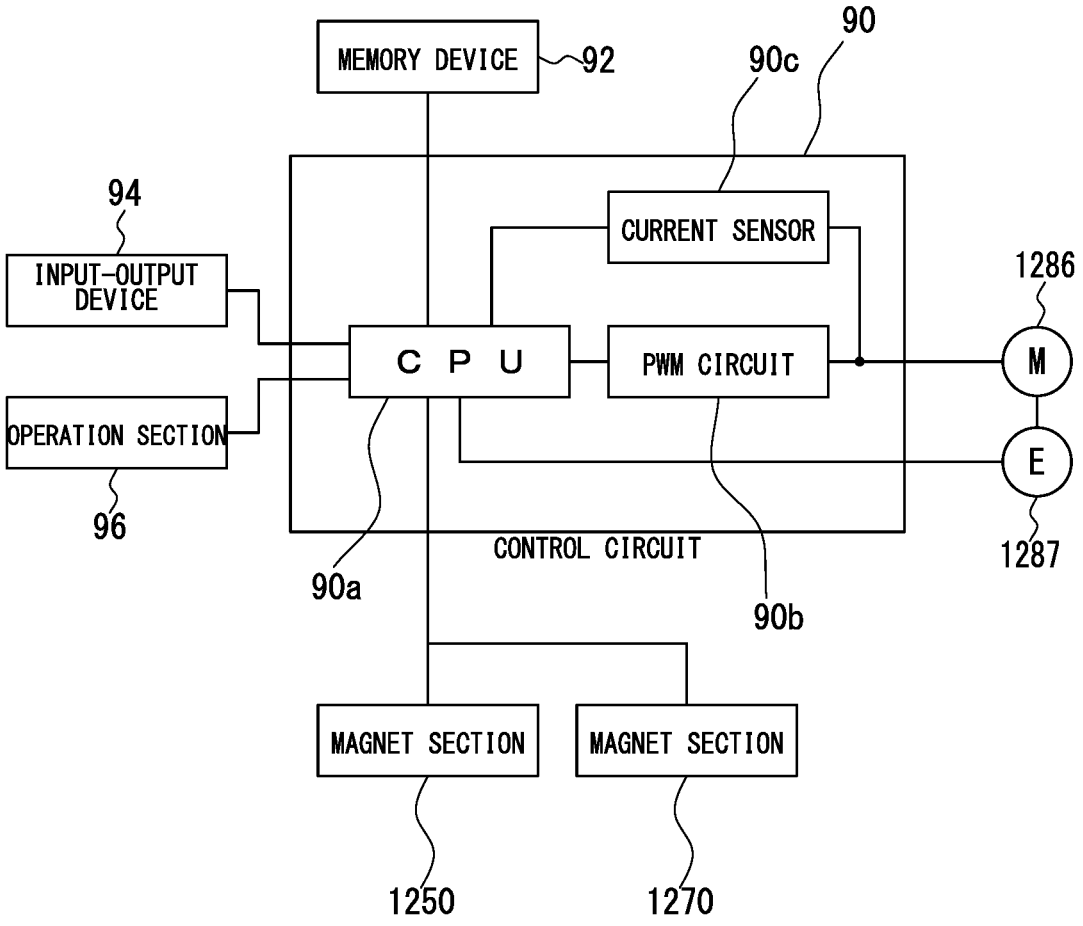

[FIG. 10]
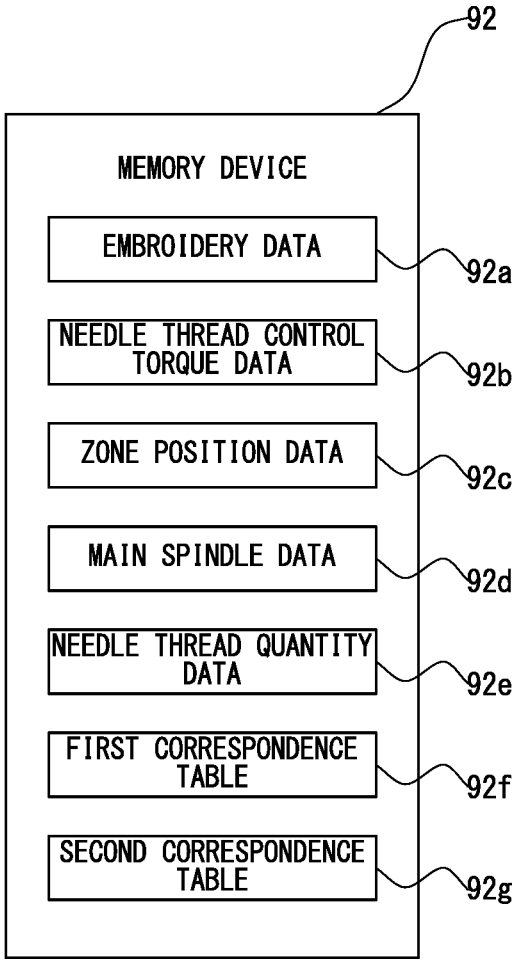

[FIG. 11]

92a

EMBROIDERY DATA

| STITCH | STITCH WIDTH (mm) | STITCHING DIRECTION (DEGREE) | THREAD ATTRIBUTE |
|---|---|---|---|
| STITCH 1 | ○○ | ○○ | ○○ |
| STITCH 2 | ○○ | ○○ | ○○ |
| STITCH 3 | ○○ | ○○ | ○○ |
| . | . | . | . |
| . | . | . | . |
| . | . | . | . |
| STITCH n | ○○ | ○○ | ○○ |
| . | . | . | . |
| . | . | . | . |

[FIG. 12]

92b

NEEDLE THREAD CONTROL TORQUE DATA

| STITCH | NEEDLE THREAD CONTROL TORQUE VALUE (N·m) |
|---|---|
| STITCH 1 | ○○ |
| STITCH 2 | ○○ |
| STITCH 3 | ○○ |
| . | . |
| . | . |
| . | . |
| . | . |
| . | . |
| . | . |

[FIG. 13]

92c

ZONE POSITION DATA

| | STARTING POINT | END POINT |
|---|---|---|
| TORQUE CONTROL ZONE (MAIN SPINDLE ANGLE) | $Z_1$ DEGREE | $Z_2$ DEGREE |
| FIRST POSITION CONTROL ZONE (MAIN SPINDLE ANGLE) | $Z_2$ DEGREE | $Z_3$ DEGREE |
| SECOND POSITION CONTROL ZONE (MAIN SPINDLE ANGLE) | $Z_3$ DEGREE | $Z_1$ DEGREE |
| THREAD PULL-OUT ZONE | $Z_4$ DEGREE | $Z_3$ DEGREE |
| INITIAL POSITION MOVEMENT ZONE | $Z_3$ DEGREE | $Z_5$ DEGREE |

[FIG. 14]

92d

MAIN SPINDLE DATA (POSITION)

| TIME | MAIN SPINDLE ANGLE |
|---|---|
| $t_0$ | $a_0$ (=0) |
| $t_1$ | $a_1$ |
| $t_2$ | $a_2$ |
| . | . |
| . | . |
| . | . |
| . | . |
| . | . |
| $t_n$ | $a_n$ |

[FIG. 15]
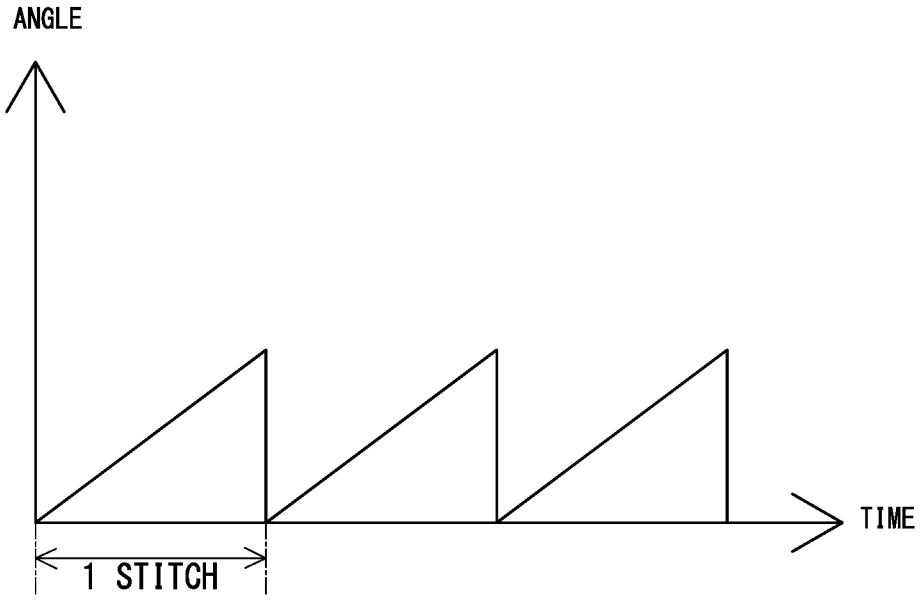

[FIG. 16]

92e

NEEDLE THREAD QUANTITY DATA

| STITCH | PRECORRECTED NEEDLE THREAD REQUIREMENT (mm) | POSTCORRECTED NEEDLE THREAD REQUIREMENT (mm) | NEEDLE THREAD CONSUMPTION (mm) | DIFFERENCE (NEEDLE THREAD REQUIREMENT − NEEDLE THREAD CONSUMPTION) (mm) |
|---|---|---|---|---|
| STITCH 1 | ○○ | ○○ | ○○ | ○○ |
| STITCH 2 | ○○ | ○○ | ○○ | ○○ |
| STITCH 3 | ○○ | ○○ | ○○ | ○○ |
| . | . | . | . | . |
| . | . | . | . | . |
| . | . | . | . | . |
| STITCH n | ○○ | ○○ | ○○ | ○○ |
| . | . | . | . | . |
| . | . | . | . | . |

[FIG. 17]

92f

FIRST CORRESPONDENCE TABLE

| ROTATION ANGLE (DEGREE) | NEEDLE THREAD CONSUMPTION (mm) |
|---|---|
| ○○ | ○○ |
| ○○ | ○○ |
| ○○ | ○○ |
| . | . |
| . | . |
| . | . |
| . | . |
| . | . |
| ○○ | ○○ |

[FIG. 18]
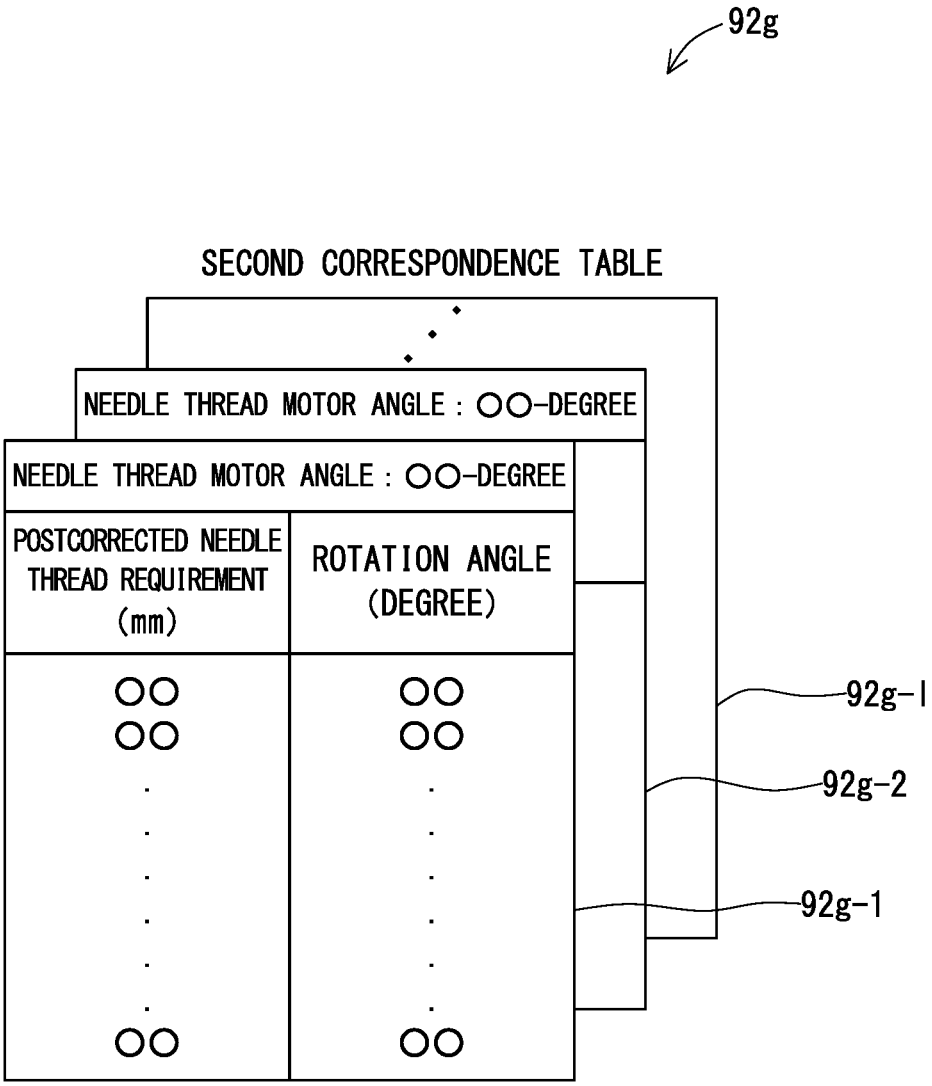

[FIG. 19]
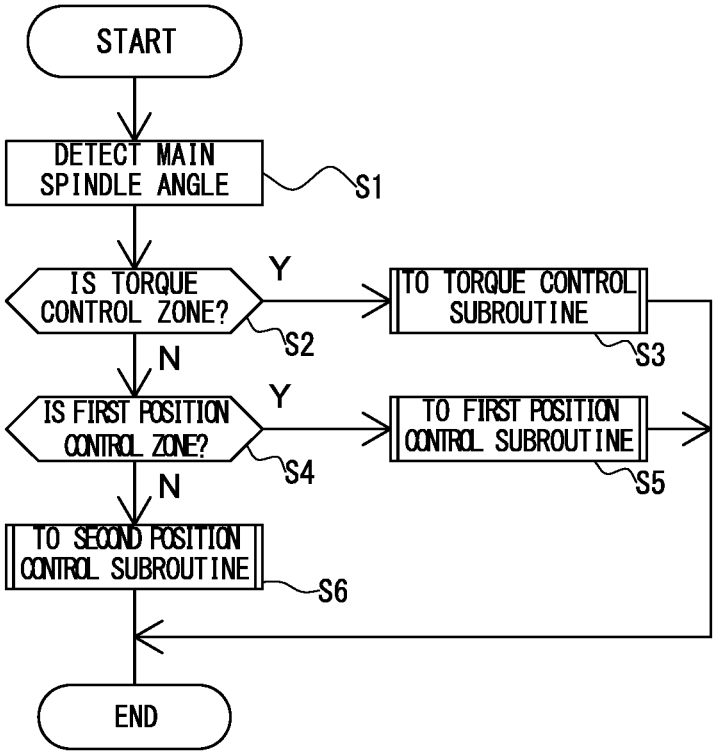

[FIG. 20]
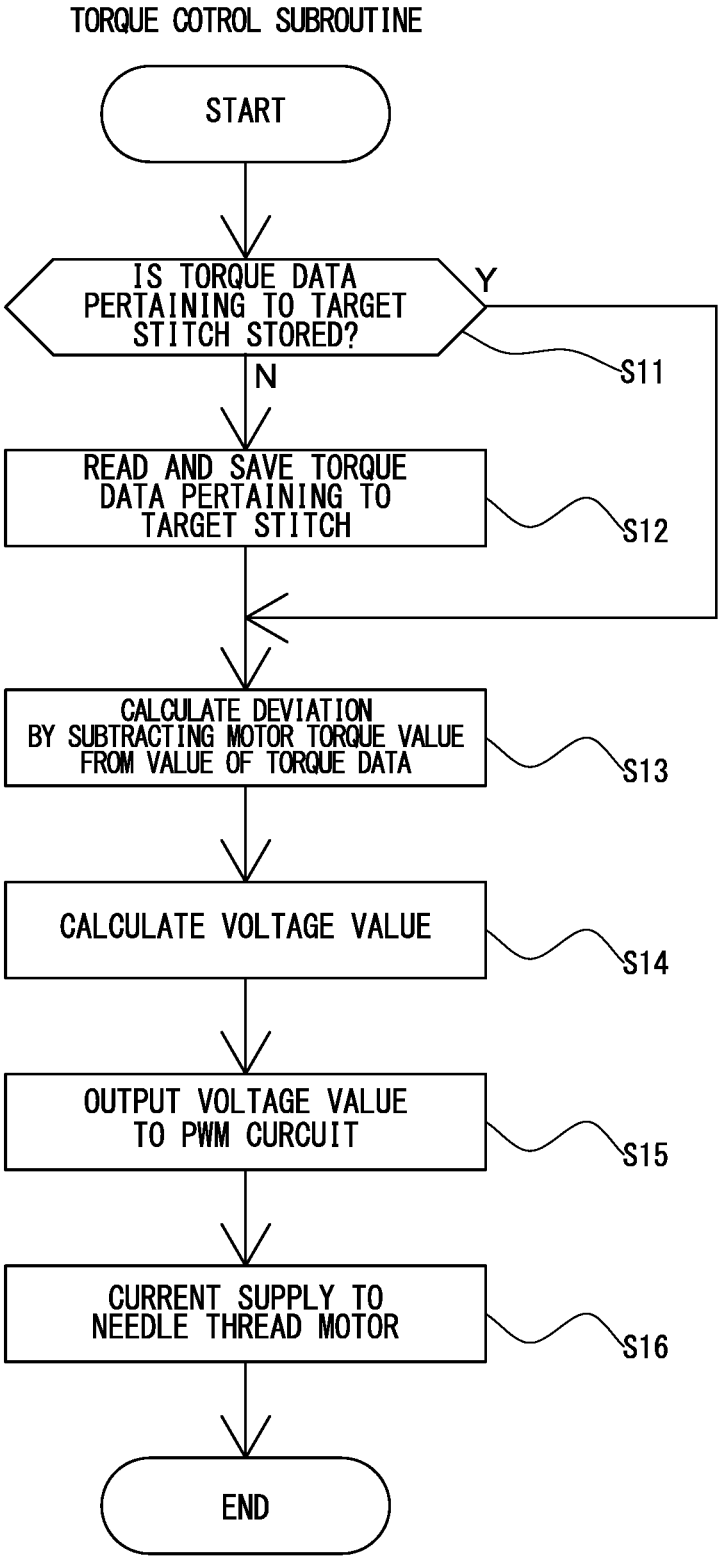

[FIG. 21]
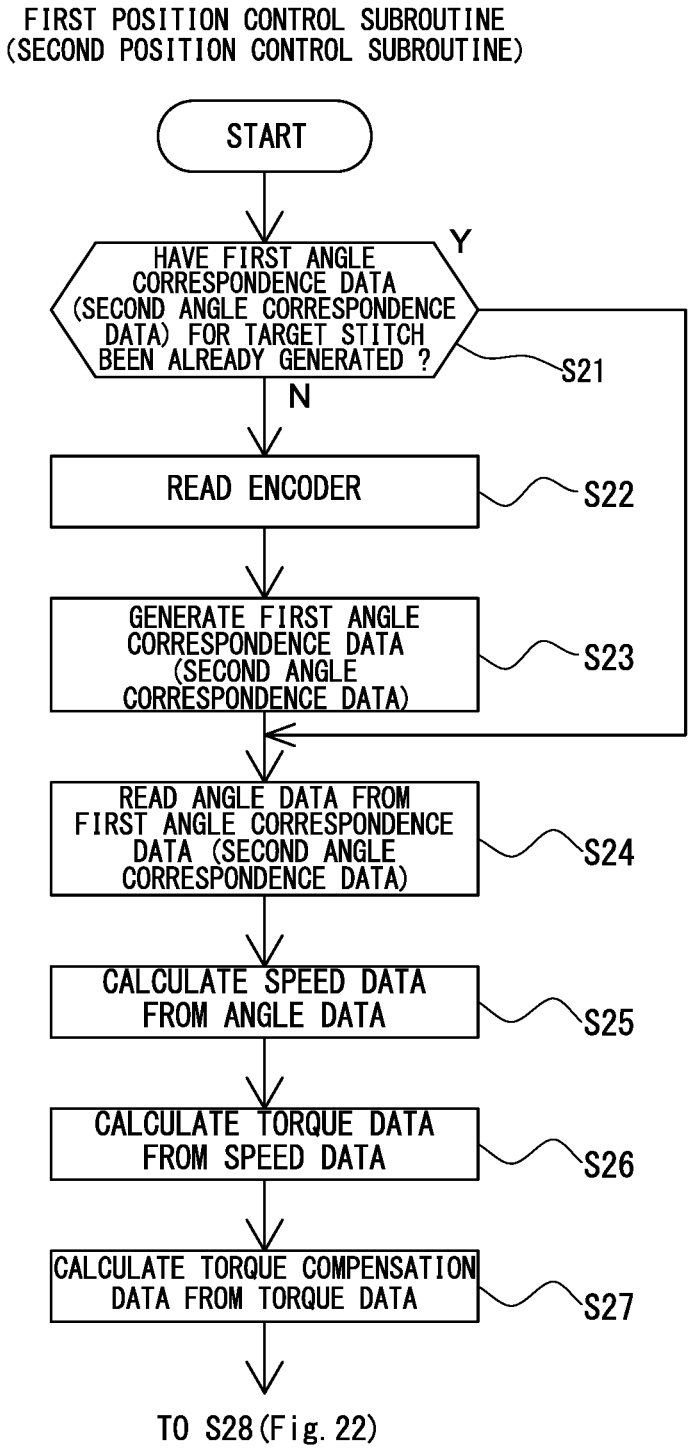

[FIG. 22]
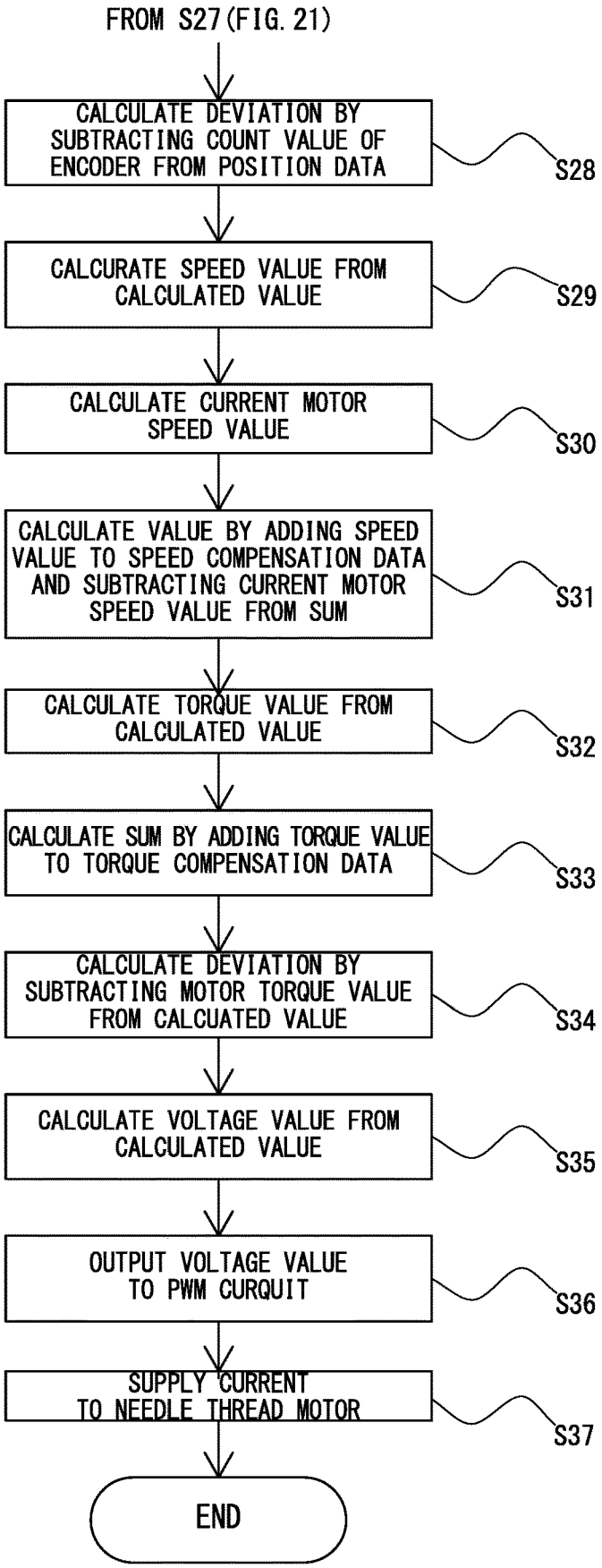

[FIG. 23]

FIRST ANGLE CORRESPONDENCE DATA

| MAIN SPINDLE ANGLE | NEEDLE THREAD MOTOR ANGLE |
|---|---|
| $a_0$ | $c_n$ |
| . | . |
| . | . |
| . | . |
| $a_x$ | $c_n$ |
| $a_{x+1}$ | $c_{n-1}$ |
| . | . |
| . | . |
| . | . |
| $a_{x+m}$ | $c_{n-m}$ |
| . | . |
| . | . |
| . | . |
| $a_{y-m}$ | $c_m$ |
| . | . |
| . | . |
| . | . |
| $a_{y-1}$ | $c_1$ |
| $a_y$ | $c_0$ |

[FIG. 24]

SECOND ANGLE CORRESPONDENCE DATA

| MAIN SPINDLE ANGLE | NEEDLE THREAD MOTOR ANGLE |
|---|---|
| $a_y$ | $d_{w(=C0)}$ |
| $a_{y+1}$ | $d_{w-1}$ |
| . | . |
| . | . |
| . | . |
| $a_{y+p}$ | $d_{w-p}$ |
| . | . |
| . | . |
| . | . |
| $a_{y+q-1}$ | $d_1$ |
| $a_{y+q}$ | $d_0$ |
| . | . |
| . | . |
| . | . |
| $a_{y+r}$ | $d_0$ |

[FIG. 25]
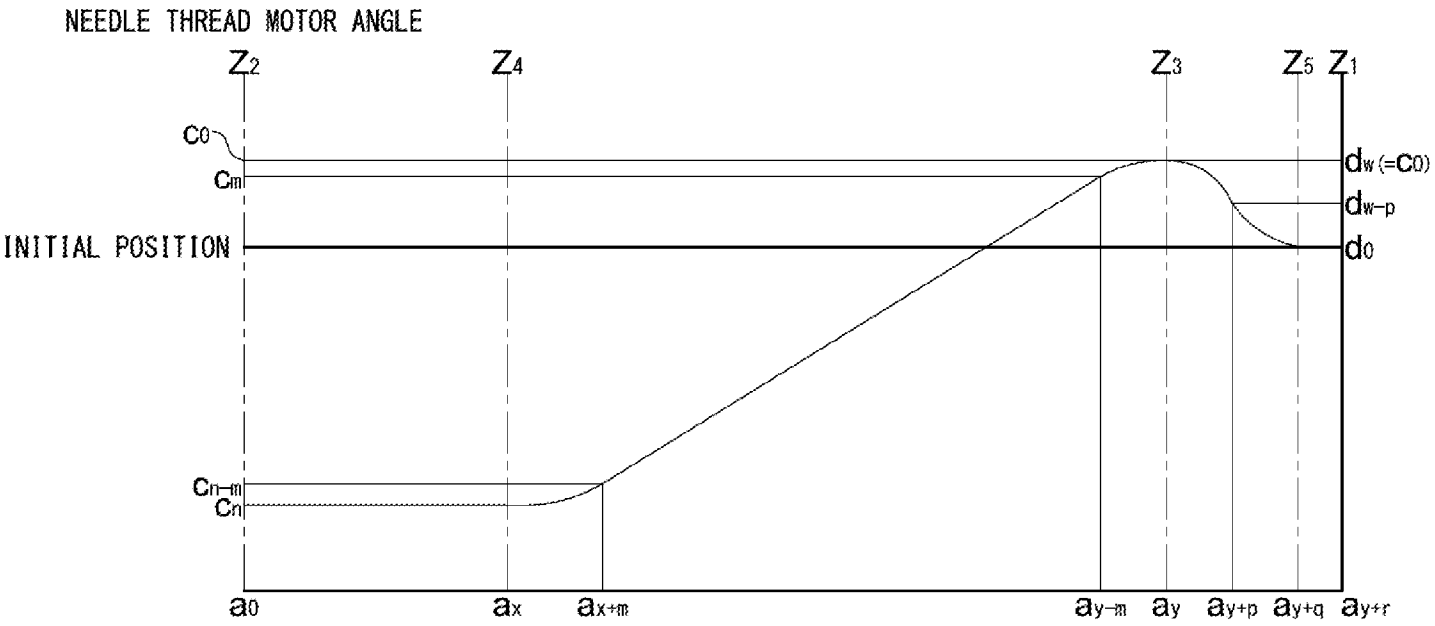

[FIG. 26]
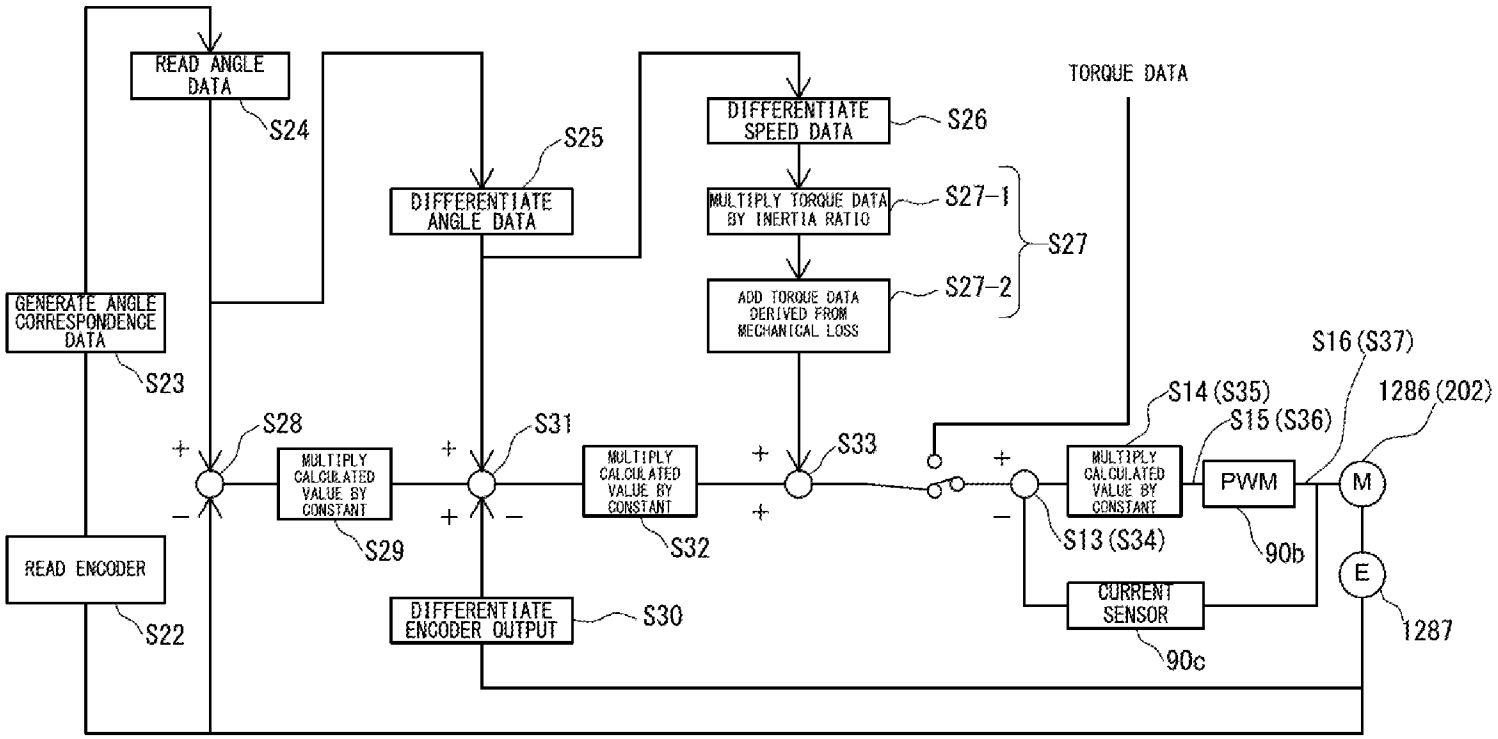

[FIG. 27]
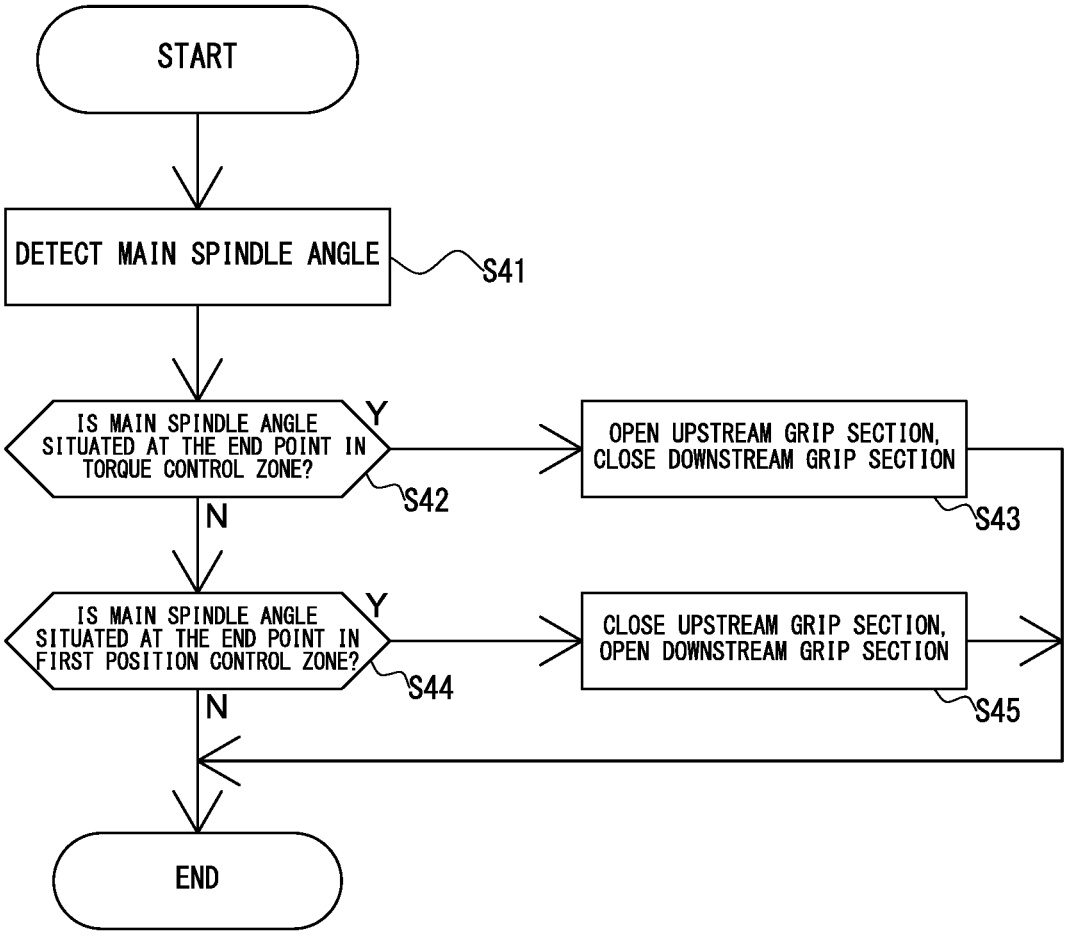

[FIG. 28]
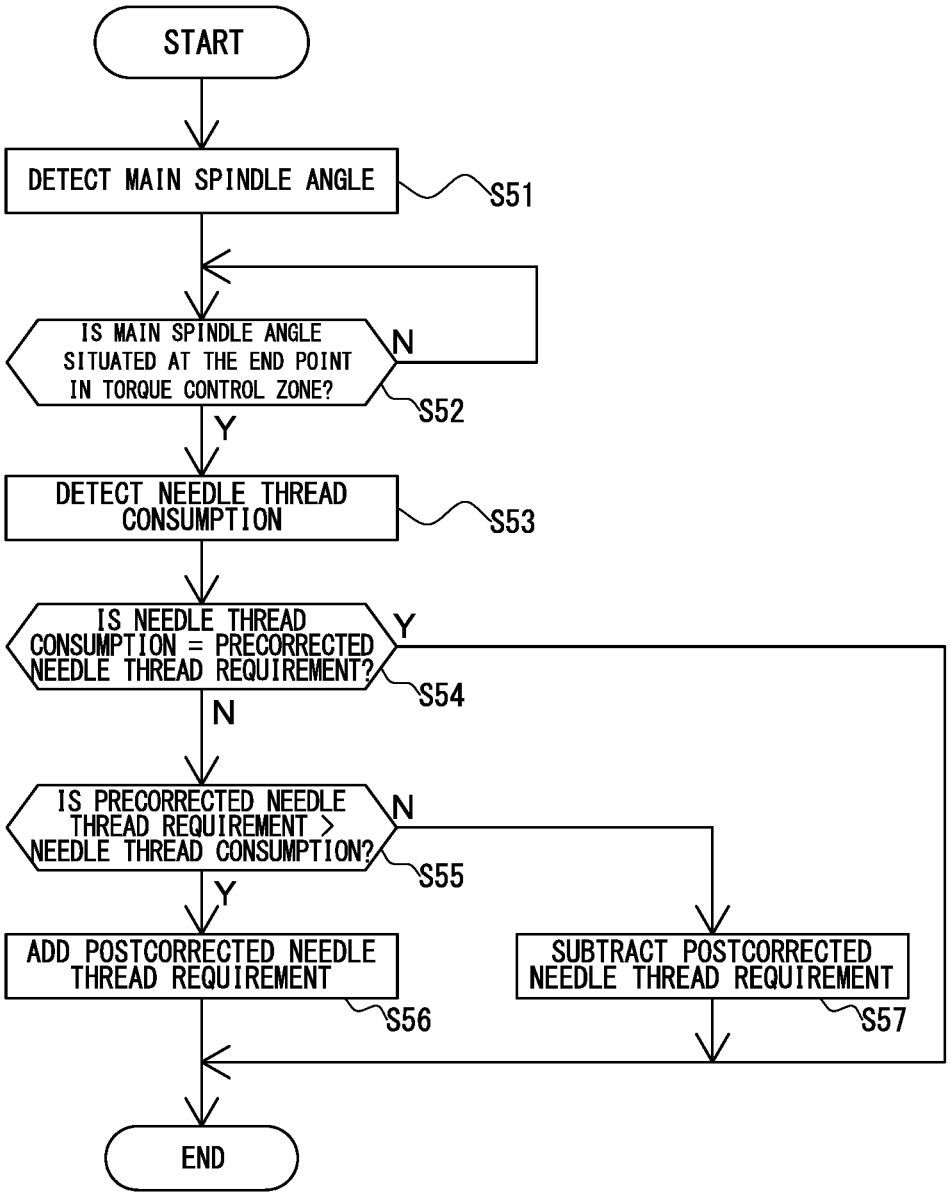

[FIG. 29 (a)]

| | PRECORRECTED NEEDLE THREAD REQUIREMENT (LENGTH) (mm) | POSTCORRECTED NEEDLE THREAD REQUIREMENT (LENGTH) (mm) | NEEDLE THREAD CONSUMPTION (LENGTH) (mm) | DIFFERENCE (NEEDLE THREAD REQUIREMENT - NEEDLE THREAD CONSUMPTION) (LENGTH) (mm) |
|---|---|---|---|---|
| STITCH $_{m}$ | $A_0$ | $A_0$ | | |
| STITCH $_{m+1}$ | $A_1$ | $A_1$ | | |
| STITCH $_{m+2}$ | $A_2$ | $A_2$ | | |
| STITCH $_{m+3}$ | $A_3$ | $A_3$ | | |
| . | . | . | | |
| . | . | . | | |
| . | . | . | | |

↓

[FIG. 29 (b)]

| | PRECORRECTED NEEDLE THREAD REQUIREMENT (LENGTH) (mm) | POSTCORRECTED NEEDLE THREAD REQUIREMENT (LENGTH) (mm) | NEEDLE THREAD CONSUMPTION (LENGTH) (mm) | DIFFERENCE (NEEDLE THREAD REQUIREMENT - NEEDLE THREAD CONSUMPTION) (LENGTH) (mm) |
|---|---|---|---|---|
| STITCH $_{m}$ | $A_0$ | $A_0$ | $B_0$ | $A_0-B_0 = +0.1$ |
| STITCH $_{m+1}$ | $A_1$ | $A_1 + 0.1$ | | |
| STITCH $_{m+2}$ | $A_2$ | $A_2 + 0.1$ | | |
| STITCH $_{m+3}$ | $A_3$ | $A_3 + 0.1$ | | |
| . | . | . | | |
| . | . | . | | |
| . | . | . | | |

↓

[FIG. 30 (c)]

↓

| | PRECORRECTED NEEDLE THREAD REQUIREMENT (LENGTH) (mm) | POSTCORRECTED NEEDLE THREAD REQUIREMENT (LENGTH) (mm) | NEEDLE THREAD CONSUMPTION (LENGTH) (mm) | DIFFERENCE (NEEDLE THREAD REQUIREMENT - NEEDLE THREAD CONSUMPTION) (LENGTH) (mm) |
|---|---|---|---|---|
| STITCH m | $A_0$ | $A_0$ | $B_0$ | $A_0-B_0 = +0.1$ |
| STITCH m+1 | $A_1$ | $A_1 + 0.1$ | $B_1$ | $A_1-B_1 = +0.2$ |
| STITCH m+2 | $A_2$ | $A_2 + 0.2$ | | |
| STITCH m+3 | $A_3$ | $A_3 + 0.2$ | | |
| . | . | . | | |
| . | . | . | | |
| . | . | . | | |

[FIG. 30 (d)]

↓

| | PRECORRECTED NEEDLE THREAD REQUIREMENT (LENGTH) (mm) | POSTCORRECTED NEEDLE THREAD REQUIREMENT (LENGTH) (mm) | NEEDLE THREAD CONSUMPTION (LENGTH) (mm) | DIFFERENCE (NEEDLE THREAD REQUIREMENT - NEEDLE THREAD CONSUMPTION) (LENGTH) (mm) |
|---|---|---|---|---|
| STITCH m | $A_0$ | $A_0$ | $B_0$ | $A_0-B_0 = +0.1$ |
| STITCH m+1 | $A_1$ | $A_1 + 0.1$ | $B_1$ | $A_1-B_1 = +0.2$ |
| STITCH m+2 | $A_2$ | $A_2 + 0.2$ | $B_2$ | $A_2-B_2 = -0.1$ |
| STITCH m+3 | $A_3$ | $A_3 + 0.1$ | | |
| . | . | . | | |
| . | . | . | | |

[FIG. 31 (a)]
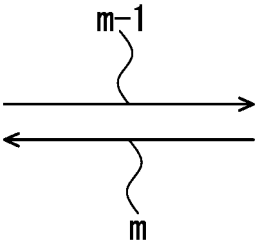
INNER ANGLE = 0 DEGREE
[FIG. 31 (b)]
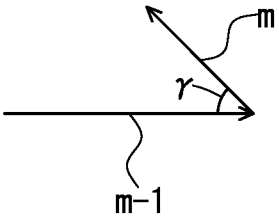
INNER ANGLE = γ
[FIG. 31 (c)]
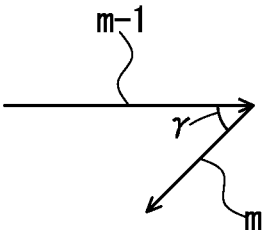
INNER ANGLE = γ
[FIG. 31 (d)]
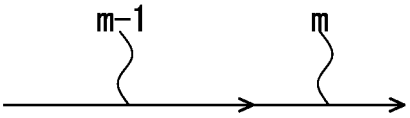
INNER ANGLE = 180 DEGREES

[FIG. 32]

92h

INNER ANGLE TABLE

| INNER ANGLE (DEGREE) | CORRECTION COEFFICIENT (w) |
|---|---|
| 0 | 1000 |
| 0.1 | 999 (≒1799/1800×1000) |
| 0.2 | 998 (≒1798/1800×1000) |
| 0.3 | 998 (≒1797/1800×1000) |
| 0.4 | 997 (≒1796/1800×1000) |
| . | . |
| . | . |
| . | . |
| 90.0 | 500 (≒900/1800×1000) |
| . | . |
| . | . |
| . | . |
| . | . |
| 179.8 | 1 (≒2/1800×1000) |
| 179.9 | 0 (≒1/1800×1000) |
| 180.0 | 0 (≒0/1800×1000) |

NEEDLE THREAD REQUIREMENT = L+(2×T)+(L×2/3×w/1000)

[FIG. 33 (a)]
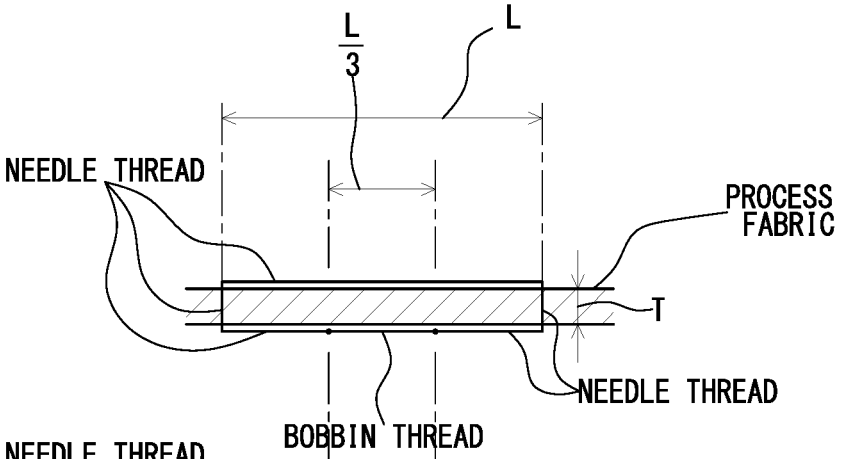
[FIG. 33 (b)]
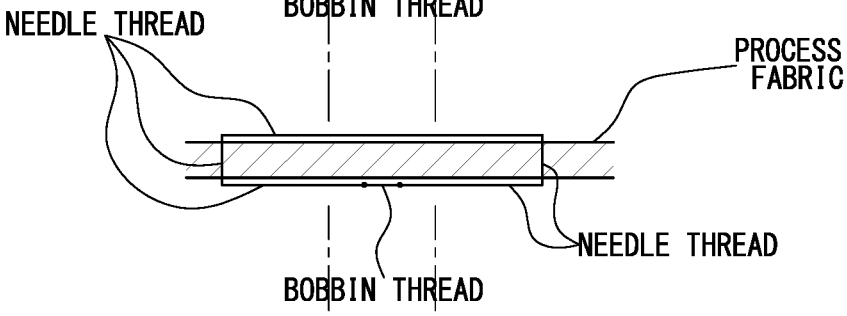
[FIG. 33 (c)]
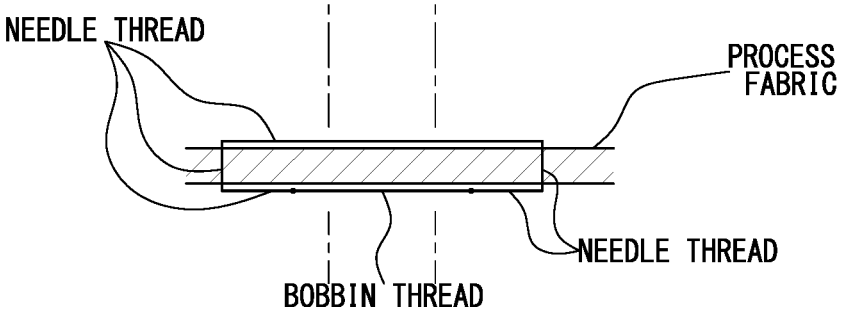

[FIG. 34]
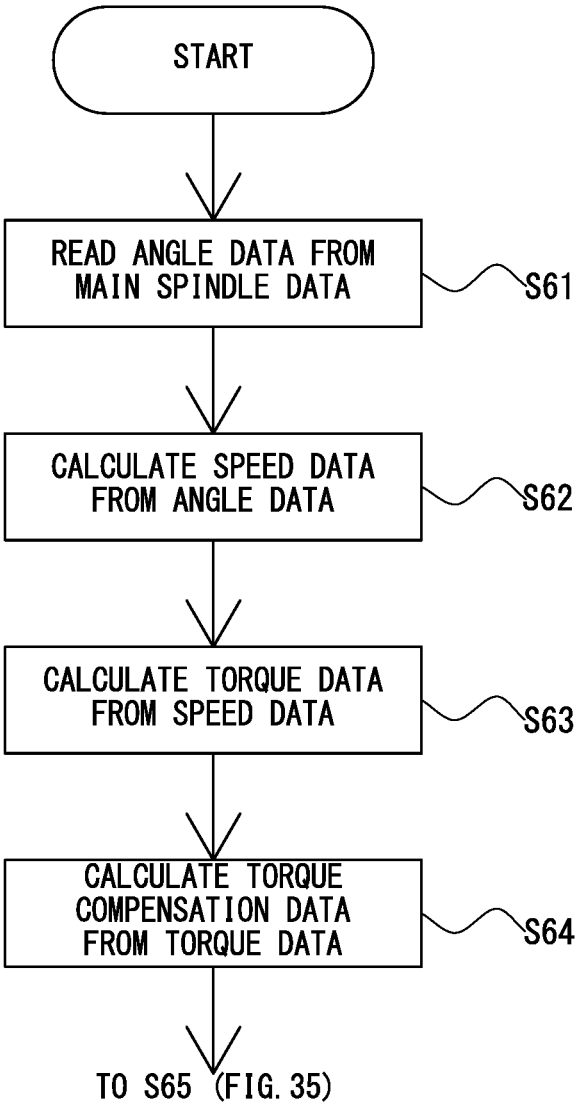

[FIG. 35]
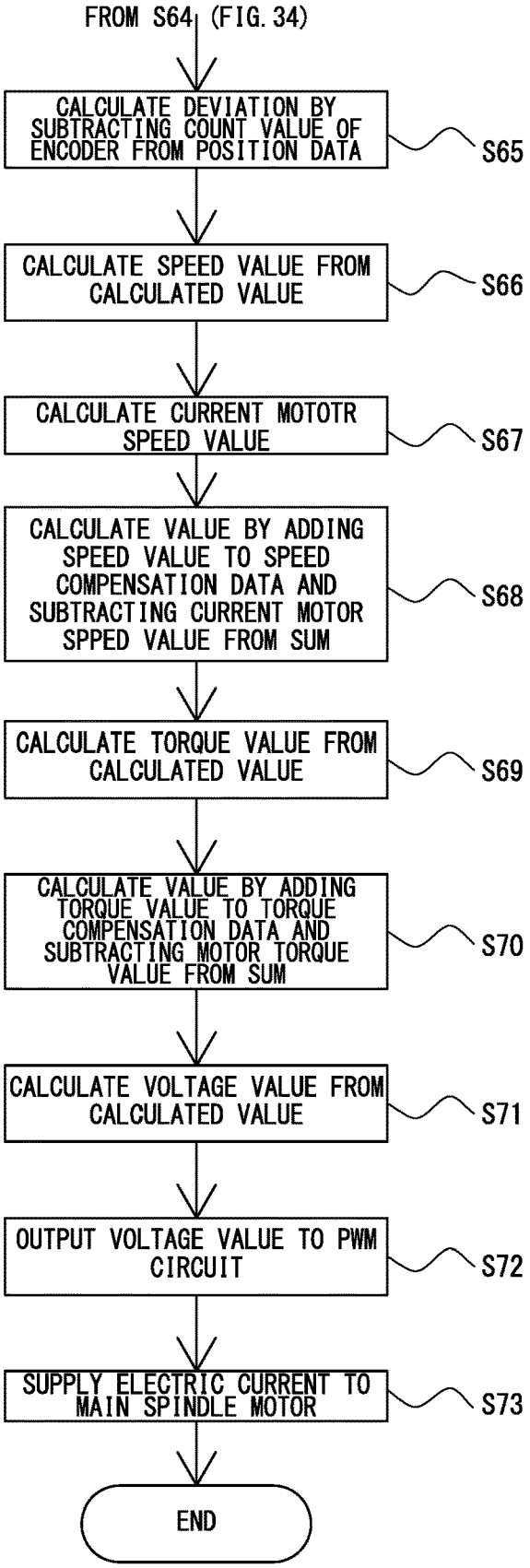

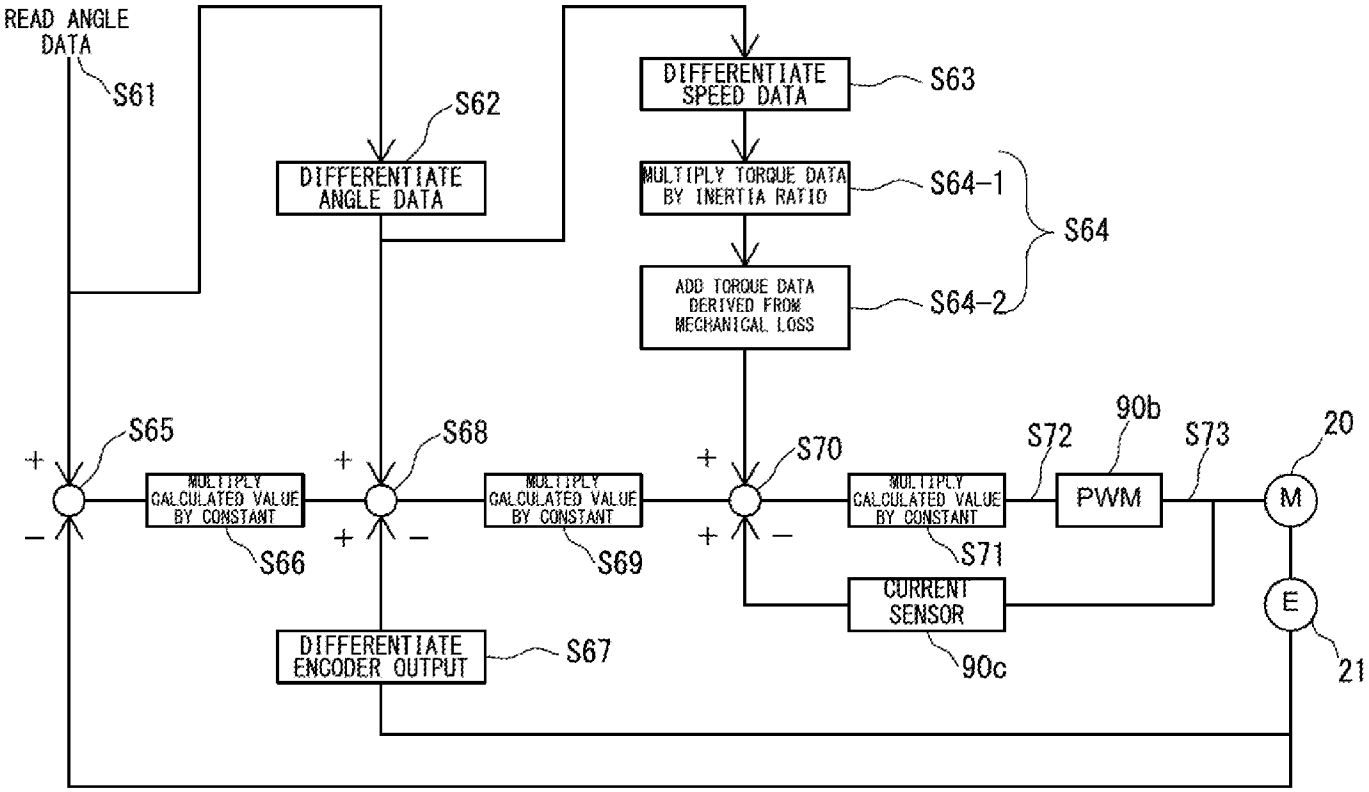
[FIG. 36]

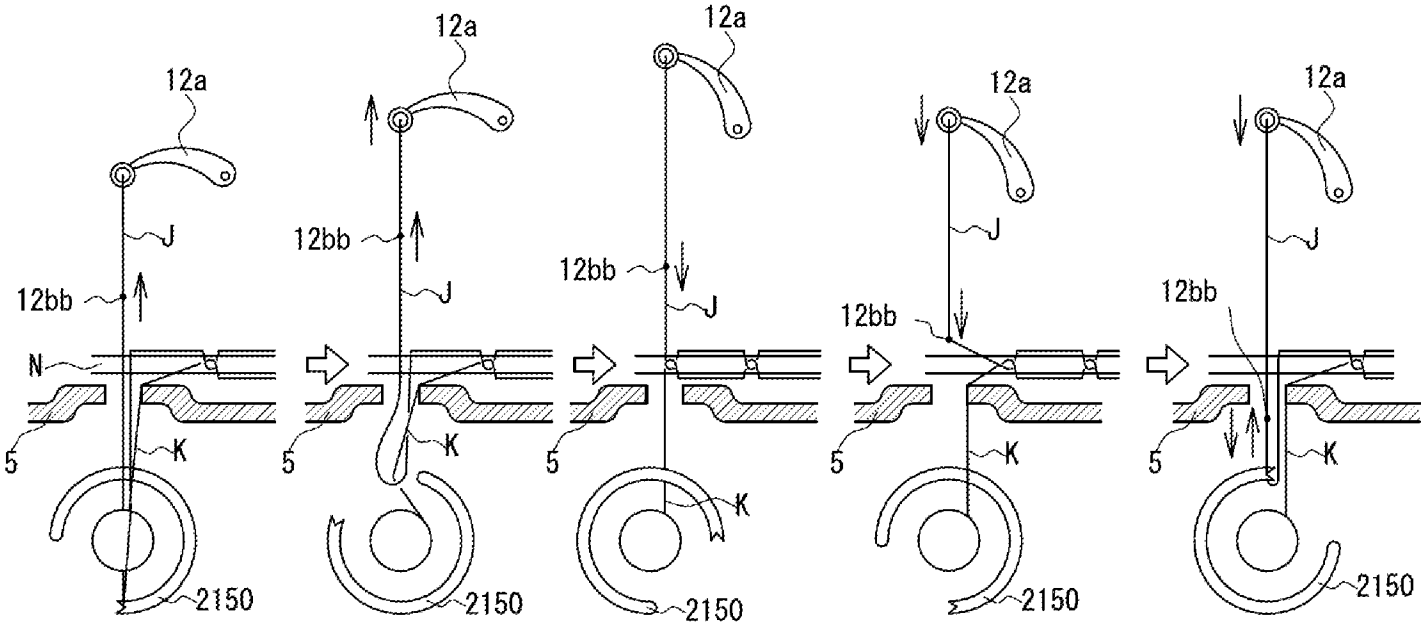
[FIG. 37 (a)]
[FIG. 37 (b)]
[FIG. 37 (c)]
[FIG. 37 (d)]
[FIG. 37 (e)]

[FIG. 38]
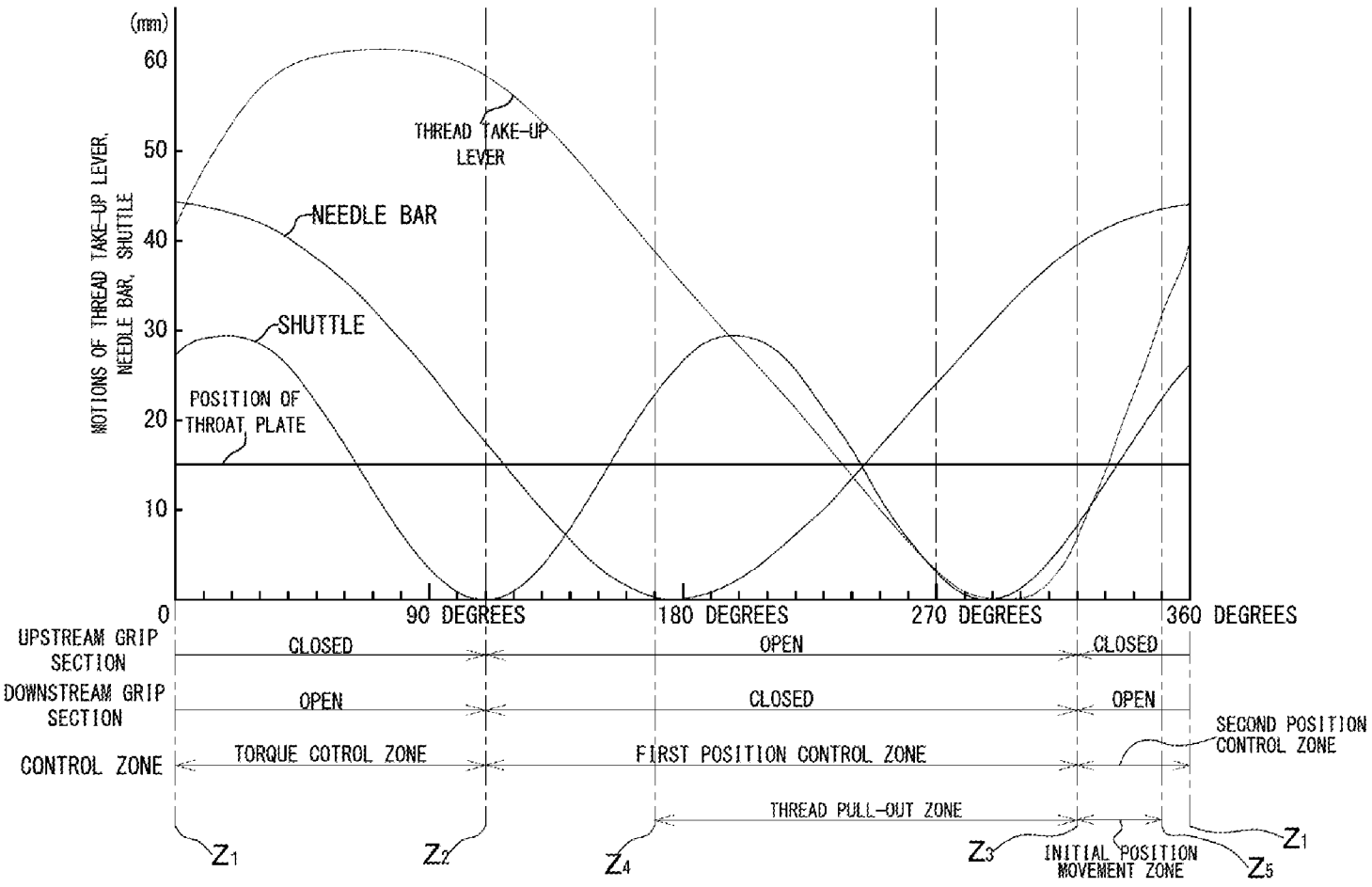

[FIG. 39]
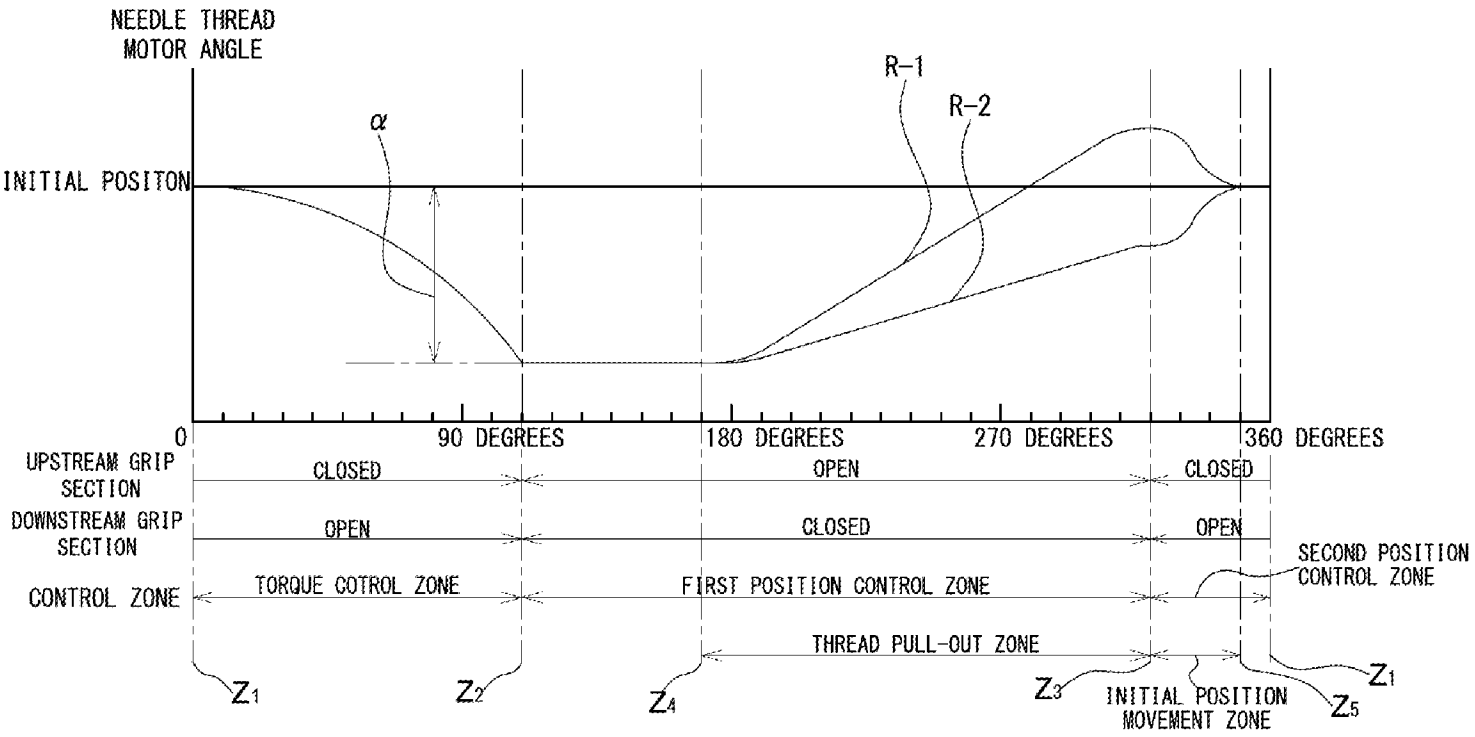

[FIG. 40]
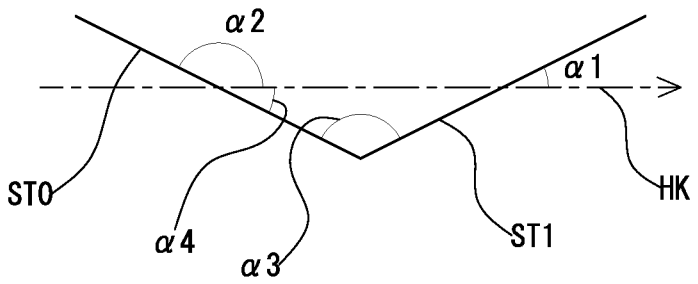

[FIG. 41]
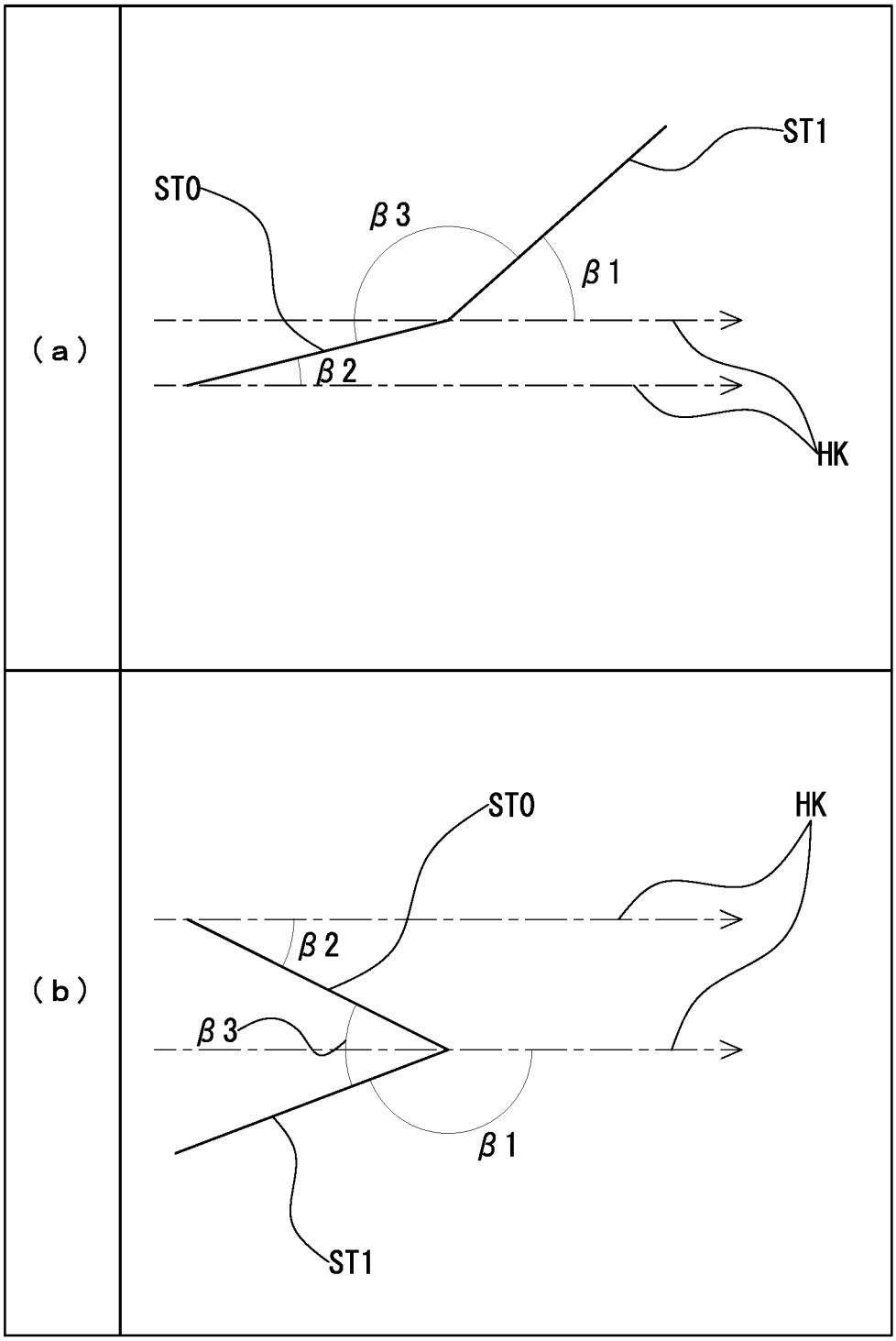

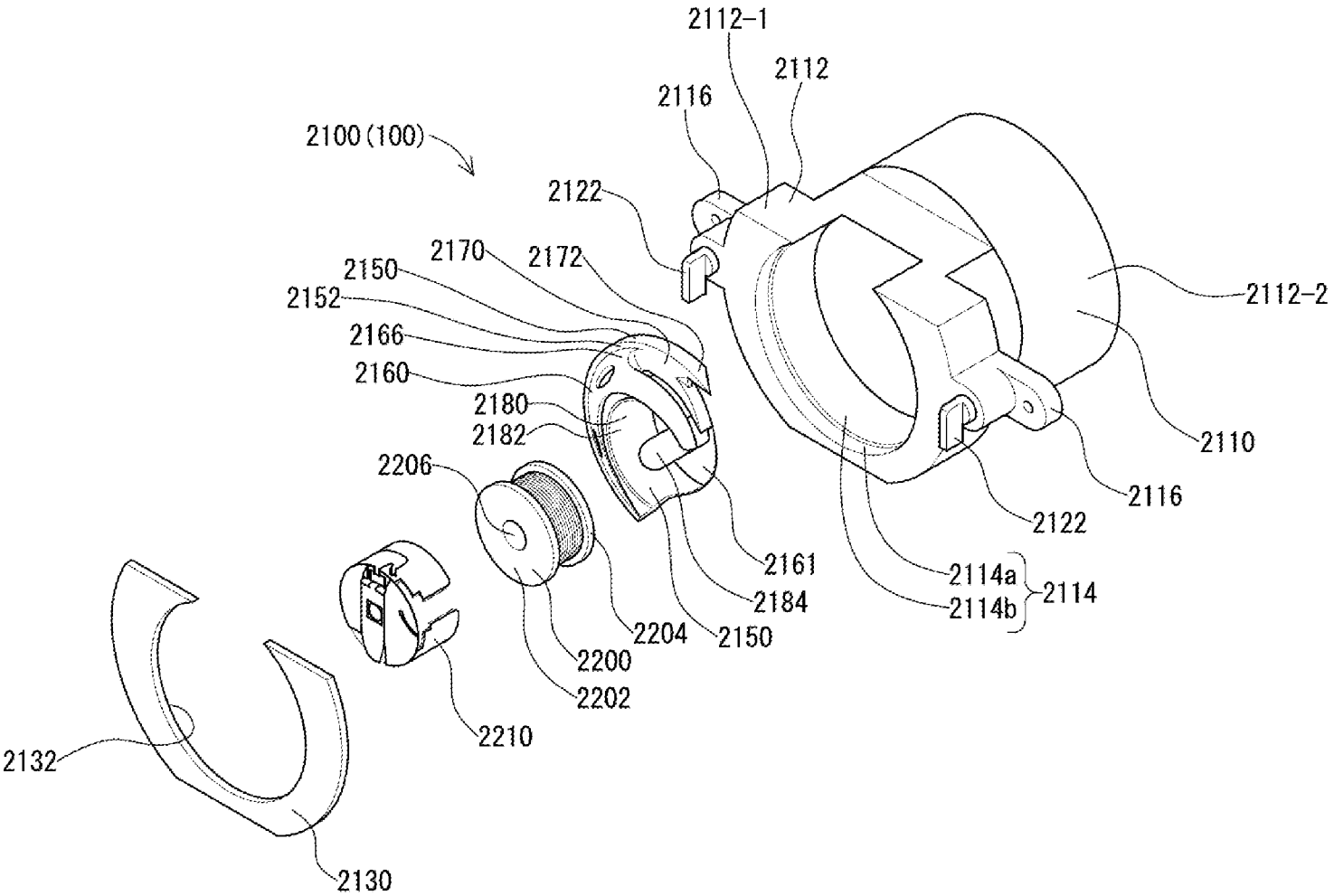
[FIG. 42]

[FIG. 43]
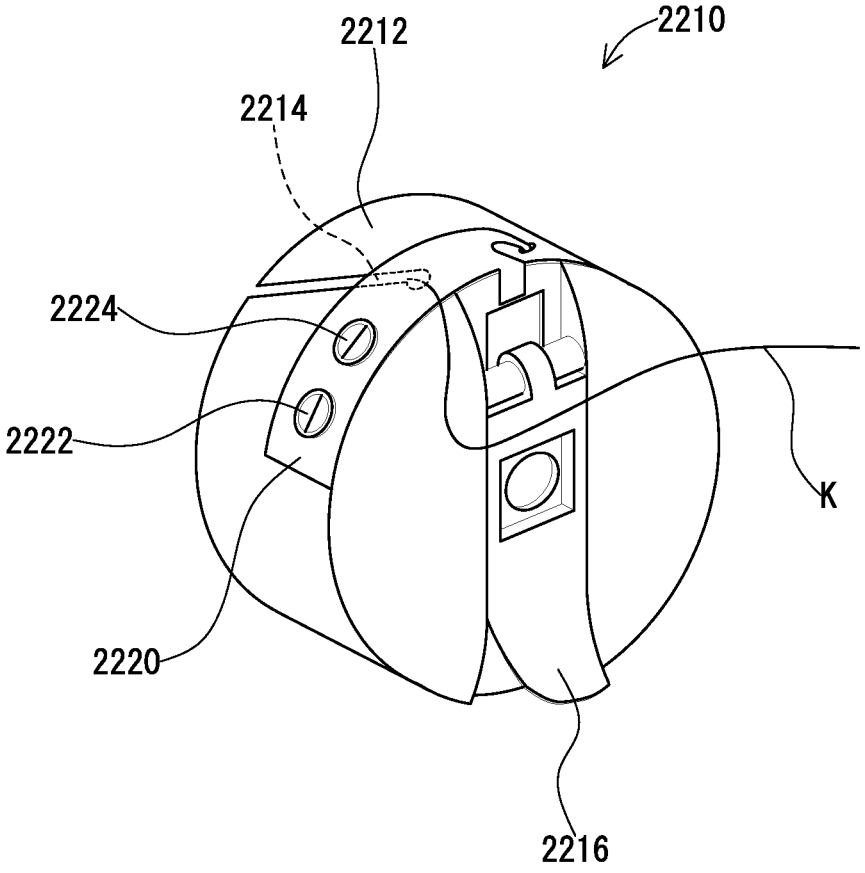

SEWING MACHINE

TECHNICAL FIELD

The present invention relates to a sewing machine (particularly, an embroidery sewing machine) and, more particularly, to control of the amount of needle thread used in a sewing machine.

BACKGROUND OF ART

In the related-art sewing machine, shuttle is configured as shown in FIG. 42, the shuttle 2100 comprises an outer shuttle 2110, a middle shuttle presser 2130, and a middle shuttle 2150. A bobbin 2200 and a bobbin case 2210 are stored in the middle shuttle 2150.

As illustrated in FIG. 43, a tension spring 2220 is attached to a case main body 2212 by mounting screws 2222 in a bobbin case 2210. A bobbin thread K of the bobbin 2200 housed in the bobbin case 2210 is guided so as to pass to the outside of the bobbin case 2210 via a thread guide slot 2214 opened in the case main body 2212. A tension on the bobbin thread K is adjusted by adjusting the degree of tightening of an adjustment screw 2224 fitted into the tension spring 2220. In short, the tension on the bobbin thread is adjusted by frictional resistance of the tension spring 2220.

The applicants have already filed the applications for Patent Document 1, Patent Document 2, and Patent Document 3. In the sewing machines disclosed in Patent Document 1 and Patent Document 2, the magnitude of a tension on a needle thread is controlled by controlling torque of a needle thread motor. Specifically, the needle thread motor is controlled according to a torque value so as to impart tension on the needle thread against the direction of a thread take-up lever pulling the needle thread, while an upstream grip section main body closing and while a downstream grip body opening, thereby rotating force is imparted to a turning arm and the tension on the needle thread is controlled.

The sewing machine disclosed in Patent Document 2 has an outer shuttle, a middle shuttle rotating along a guide groove of the outer shuttle, a bobbin axially supported in the middle shuttle, and a bobbin thread control part. A bobbin has a first magnet, and the bobbin thread control part has a bobbin thread motor that rotates a rotation shaft in the direction opposite to the rotating direction of the bobbin and a second magnet that is placed close to the middle shuttle and rotated by the bobbin thread motor. The tension on the bobbin thread is controlled by subjecting the bobbin thread motor to torque control. Even in the sewing-machine bobbin thread tension controller and the sewing machine in Patent Document 3, the tension control on the bobbin thread is performed in the same way as that is performed by the sewing machine of Patent Document 2. The bobbin thread controller of Patent Document 3 has an outer shuttle, a middle shuttle that rotates along a guide groove of the outer shuttle, and a bobbin axially supported in the middle shuttle, and a bobbin thread control mechanism. The bobbin has a first magnet, and the bobbin thread tension control mechanism has a bobbin thread tension control motor that rotates a rotation shaft in the direction opposite to the rotating direction of the bobbin, and a second magnet that is placed close to the middle shuttle and is rotated by the bobbin thread tension control motor. The tension on the bobbin thread is controlled by subjecting the bobbin thread tension control motor to torque control.

RELATED ART DOCUMENTS

Patent Documents

Patent Document 1: International Publication Pamphlet No. WO2012/014610

Patent Document 2: Internal Publication Pamphlet No. WO2013/047477

Patent Document 3: International Publication Pamphlet No. WO2010/147023

SUMMARY OF THE INVENTION

Problem that the Invention is to Solve

However, needle thread consumption and bobbin thread consumption in certain stitches are standardized as shown in FIG. 33(*a*); namely, the ratio between a needle thread and a bobbin thread being set to about two-third and one-third. As shown in FIG. 33(*b*), if the needle thread consumption is greater than the ratio, stitches will be loosely sewn. As shown in FIG. 33(*c*), if the needle thread consumption is less than the ratio, the bobbin thread may come out of an upper side of a cloth.

When the tension on the bobbin thread is adjusted by the bobbin case 2210 as shown in FIG. 42 and FIG. 43, the tension spring 2220 adjusts the tension on the bobbin thread by means of frictional resistance, so that the tension on the bobbin thread cannot be adjusted accurately. If the tension on the bobbin thread cannot be adjusted accurately, it will become difficult to achieve a desired balance between the needle thread consumption and the bobbin thread consumption.

Even when the tension on the needle thread is controlled under the control described in Patent Document 1 and Patent Document 2, the tension on the bobbin thread cannot be adjusted accurately alike if the tension on the bobbin thread is controlled by configurations in FIG. 42 and FIG. 43.

If the tension control on the needle thread and the tension control on the bobbin thread are performed by the sewing machine described in Patent Document 2, a balance between the needle thread consumption and the bobbin thread consumption can be attained. However, the configuration (among others, the first magnet and the bobbin thread control part) shown in Patent Document 2 is required for the bobbin thread, which in turn drives up costs. Even if both the tension control on the needle thread in Patent Document 1 and the tension control on the bobbin thread in Patent Document 3 are performed, the configuration (among others, the first magnet and the bobbin thread tension control mechanism) in Patent Document 3 becomes necessary, which in turn leads to an increase in cost.

Because of this, the present invention provides a sewing machine capable of attaining inexpensively a desired balance between the needle thread consumption and the bobbin thread consumption. In particular, the present invention aims at providing a sewing machine capable of attaining a desired balance between the needle thread consumption and the bobbin thread consumption even when the existing configuration using a bobbin case for a bobbin thread having a tension spring attached is used.

Means for Solving the Problem

The present invention has been created to resolve the drawbacks. First, a sewing machine comprising:

thread take-up lever (12*a*-1 through 12*a*-9) formed in a swayable manner, a needle thread control section (1230), a memory section (92), and a control section (90), wherein the needle thread control section that is disposed at an upstream position in a needle thread path of the thread take-up lever and that controls tension on a needle thread, has an upstream grip section (1240) including an upstream grip section main body (1241) which grips a needle thread in a pinching manner and an upstream actuation section (1250) that performs, with respect to the upstream grip section main body, switching between a closed state in which the needle thread is gripped and an open state in which the needle thread is released from a gripped state, a downstream grip section (1260) that is disposed at a downstream position in the needle thread path of the upstream grip section and that has a downstream grip section main body (1261) which grips a needle thread in a pinching manner and a downstream actuation section (1270) that performs, with respect to the downstream grip section main body, switching between a closed state in which the needle thread is gripped and an open state in which the needle thread is released from a gripped state, and a turning section (1280) that turns the needle thread between the upstream grip section main body and the downstream grip section main body and that has a turning arm (1281) which contacts the needle thread and a needle thread motor (1286) which turns the turning arm;

the memory section stores torque data (92*b*) and needle thread quantity data (92*e*), wherein the torque data stores a torque value for controlling a needle thread on a per-stitch basis in sewing data, the needle thread quantity data has precorrected needle thread requirement data and postcorrected needle thread requirement data, the precorrected needle thread requirement data stores a needle thread requirement showing a length of a required needle thread, on a per-stitch basis in the sewing data, and the postcorrected needle thread requirement data stores the needle thread requirement of the precorrected needle thread requirement data on a per-stitch basis in the sewing data, in which the needle thread requirement in the postcorrected needle thread requirement data is updated to the postcorrected needle thread requirement for a stitch where the needle thread requirement has been corrected by the control section; and when performing sewing operation in accordance with sewing data in the control zone for each stitch, the control section, in a torque control zone that is a zone including at least a portion from one dead point to the other dead point of the thread take-up lever in which the thread take-up lever pulls the needle thread with respect to a process fabric to be sewn with the needle thread, imparts a rotating force to the turning arm, while closing the upstream grip section main body and while opening the downstream grip body, by controlling the needle thread motor according to the torque value of the torque data so as to impart a tension to the needle thread against a direction in which the thread take-up lever pulls the needle thread;

in a first position control zone that is at least a portion of a zone other than the torque control zone, turns the turning arm in the same direction as the rotating force is imparted to the turning arm in the torque control zone so as to pulls out the needle thread from an upstream position, while opening the upstream grip section main body and while closing the downstream grip body, by controlling the needle thread motor so as to rotate through an angle corresponding to the needle thread requirement in the postcorrected needle thread requirement data for a stitch of an immediately-arriving torque control zone;

in a second position control zone that is at least a portion of the zone other than the torque control zone and subsequent to the first position control zone, controls the needle thread motor, while closing the upstream grip section main body and while opening the downstream grip body, such that the angle of the needle thread motor returns to an initial position at the angle of the needle thread motor that is the position of the needle thread motor in its rotating direction; and in relation to a target stitch that is one to be sequentially specified among stitches in the sewing data or a plurality of stitches including the target stitch, compares needle thread consumption showing the length of the needle thread used in the torque control zone with the needle thread requirement in the precorrected needle thread requirement data, performs a correction to increase the needle thread requirement in the postcorrected needle thread requirement data for the stitch next to the target stitch and subsequent stitches when the needle thread requirement is larger than the needle thread consumption, and performs a correction to decrease the needle thread requirement in the postcorrected needle thread requirement data for the stitch next to the target stitch and subsequent stitches when the needle thread requirement is smaller than the needle thread consumption.

According to the sewing machine having the first configuration, the needle thread quantity data are provided; the precorrected needle thread requirement is previously determined for each stitch; and the needle thread requirement of the postcorrected needle thread requirement data is corrected according to the magnitude of the difference between the needle thread requirement of the precorrected needle thread requirement data and the needle thread consumption. Accordingly, the needle thread consumption can be made closer to the needle thread requirement of the precorrected needle thread requirement data, and a desired balance between the needle thread consumption and the bobbin thread consumption can be achieved. Since the desired balance between the needle thread consumption and the bobbin thread consumption can be achieved, a seam finish involving the stable balance between the needle thread consumption and the bobbin thread consumption can be produced.

Even when the existing configuration using a bobbin case for a bobbin thread having a tension spring attached is used, a desired balance between the needle thread consumption and the bobbin thread consumption can be achieved. Accordingly, a low-cost sewing machine capable of achieving a desired balance between the needle thread consumption and the bobbin thread consumption can be provided.

In relation to the torque data, the torque value is specified on a per-stitch basis. Hence, in the torque control zone, a tension on the needle thread can be controlled on a per-stitch basis.

Second, according to the first configuration, an angle corresponding to the needle thread requirement in the postcorrected needle thread requirement data for a stitch of the immediately-arriving torque control zone is an angle that is specified by the angle of the needle thread motor at a starting point of the first position control zone and the needle thread requirement of the postcorrected needle thread requirement data for the stitch in the immediately-arriving torque control zone.

Third, according to the first or second configuration, the needle thread consumption is a length specified by the turning angle of the turning arm in the torque control zone. Therefore, since the needle thread consumption is detected in accordance with the turning angle of the turning arm, the needle thread consumption can be readily detected.

Fourth, according to any of the first through third configurations, the control section sequentially takes each stitch in the sewing data as a target stitch and compares, on each target stitch, the needle thread consumption with the needle thread requirement in the precorrected needle thread requirement data. Therefore, the needle thread consumption can be made minutely closer to the precorrected needle thread requirement.

Fifth, according to any one of the first through third configurations, the control section compares, with regard to a stitch group that includes a target stitch and a stitch preceding the target stitch and that is made up of a plurality of stitches exhibiting continuity, compares an aggregate of needle thread consumption with an aggregate of needle thread requirement in the precorrected needle thread requirement data, thus compares the needle thread consumption with the needle thread requirement in the precorrected needle thread requirement, and takes respective stitches in the sewing data sequentially as a target stitch. Therefore, the frequent occurrence of a variation in the difference between the needle thread requirement and the needle thread requirement to the positive or the negative can be made smaller, and hence a change in the ratio of the needle thread below the process fabric can be made smaller.

Sixth, according to any one of the first through third configurations, the control section compares, with regard to a stitch group that includes a target stitch and a stitch preceding the target stitch and that is made up of a plurality of stitches exhibiting continuity, compares an aggregate of needle thread consumption with an aggregate of needle thread requirement in the precorrected needle thread requirement data, thus compares the needle thread consumption with the needle thread requirement in the precorrected needle thread requirement, and sets a target stitch for each number of stitches that make up a stitch group. Therefore, the frequent occurrence of a variation in the difference between the needle thread requirement and the needle thread requirement to the positive or the negative can be made smaller, and hence a change in the ratio of the needle thread below the process fabric can be made smaller. And the target stitch is set for each stitch group, and hence a burden on the control section can be made smaller accordingly.

Seventh, according to any one of the first through six configurations, one unit correction value of absolute value to be used for correcting the needle thread requirement in the postcorrected needle thread requirement is provided, and, during the correction of the needle thread requirement, the control section increases or decreases the unit correction value with reference to the needle thread requirement.

Eighth, according to the first through sixth configurations, a plurality of unit correction values of absolute value to be used for correcting the needle thread requirement in the postcorrected needle thread requirement are provided; the plurality of unit correction values are different from each other; and, during the correction of the needle thread requirement, the control section increases or decreases the unit correction value selected from the plurality of unit correction values, with reference to the needle thread requirement. Therefore, since the unit correction value selected from among the plurality of unit correction values is increased or decreased with reference to the needle thread requirement, the needle thread can be immediately closer to the needle thread requirement in the precorrected needle thread requirement data.

Ninth, according to the eighth configuration, during correction of the needle thread requirement in the postcorrected needle thread requirement, the control section selects a unit correction value from the plurality of unit correction values according to the magnitude of the absolute value of a value determined by subtracting the needle thread consumption from the needle thread requirement in the precorrected needle thread requirement data, and selects the unit correction value such that the unit correction value becomes larger as the magnitude of the absolute becomes larger.

Tenth, according to the eighth configuration, during correction of the needle thread requirement in the postcorrected needle thread requirement, the control section selects a unit correction value from the plurality of unit correction values according to the number of times either positive or negative values, which are determined by subtracting the needle thread consumption from the needle thread requirement in the precorrected needle thread requirement data, are continuous; and selects the unit correction value such that the unit correction value becomes greater as the number of times either the positive or negative values are continuous becomes larger.

Eleventh, according to any one of the seventh through tenth configurations, the sewing machine is equipped with an input section for entering the unit correction value.

Twelfth, according to any one of the first through eleventh configurations, the needle thread requirement in the precorrected needle thread requirement data is calculated from a switch width and the thickness of the process fabric.

Thirteenth, according to the twelfth configuration, the needle thread requirement in the precorrected needle thread requirement data is calculated as a result of the length of the needle thread on the back of the process fabric being calculated according to a ratio between the length of the needle thread and the length of a bobbin thread on the back of the process fabric where the bobbin thread appears. Therefore, a desired balance between the length of the needle thread and the length of the bobbin thread on the back of the process fabric is achieved, and a desired balance between the needle thread consumption and the bobbin thread consumption can be achieved.

Fourteenth, according to the thirteenth configuration, the length of the needle thread on the back of the process fabric is calculated by weighting the length of the needle thread on the back of the process fabric, which is based on the ratio between the length of the needle thread and the length of the bobbin thread on the back of the process fabric, by the magnitude of an inner angle which a stitching direction of a stitch forms with a stitching direction of another stitch immediately preceding the stitch and which is an acute angle. Therefore, the needle thread requirement in the precorrected needle thread requirement data is calculated in consideration of the inner angle that is the angle which a certain stitch forms with the stitch immediately preceding the stitch and which is an acute angle. Hence, the needle thread requirement can be set to a more appropriate value.

Fifteenth, according to any one of the first through eleventh configurations, the needle thread requirement in the precorrected needle thread requirement data is calculated according to an expression of $L+2\times T+L\times A/(A+B)$, provided the stitch width is L, the ratio between the length of the needle thread and the length of the bobbin thread on the back of the process fabric is A:B, and the thickness of the process fabric is T. Therefore, a desired balance between the length of the needle thread and the length of the bobbin thread on the back of the process fabric can be achieved, whereby the desired balance between the needle thread consumption and the bobbin thread consumption can be achieved.

Sixteenth, according to any one of the first through eleventh configurations, the needle thread requirement in the precorrected needle thread requirement data is calculated according to an expression of $L+2\times T+L\times A/(A+B)\times W$, provided the stitch width is L, the ratio between the length of the needle thread and the length of the bobbin thread on the back of the process fabric is A:B, a coefficient corresponding to the magnitude of an inner angle which a stitching direction of a stitch forms with a stitching direction of another stitch immediately preceding the stitch and which is an acute angle is W, and the thickness of the process fabric is T. Therefore, the needle thread requirement in the precorrected needle thread requirement data is calculated in consideration of the inner angle that is the angle which a certain stitch forms with a stitch preceding the stich and which is an actuate angle, and hence the needle thread requirement can be set to a more appropriate value.

Seventeenth, according to any one of the first through twelfth configurations, the sewing machine further comprises an input section for entering data on each stitch width and data on the thickness of the process fabric; the control section generates the precorrected needle thread requirement data by calculating the length of the required needle thread from the data on the stitch width and the data on the thickness of the process fabric entered from the input section; and the thus-generated needle thread requirement is stored in the memory section. Therefore, the data on the stitch width and the data on the thickness of the process fabric are entered, whereby the control section can generate the precorrected needle thread requirement data, and can store the precorrected needle thread requirement data into the memory section.

Eighteenth, according to the seventeenth configuration, in relation to each stitch, data on the ratio between the length of the needle thread and the length of the bobbin thread on the back of the process fabric where the bobbin thread appears is entered from the input section, and the control section calculates the needle thread requirement in the precorrected needle thread requirement data by calculating the length of the needle thread on the back of the process fabric from the ratio.

Therefore, the data on the stitch width, the data on the thickness of the process fabric, and the ratio data are entered, whereby the control section can generate the precorrected needle thread requirement data and stores the data in the memory section. Further, the ratio data is entered, whereby the desired balance between the length of the needle thread and the length of the bobbin thread on the back of the process fabric can be achieved, and the desired balance between the needle thread consumption and the bobbin thread configuration can be achieved.

Nineteenth, according to the eighteenth configuration, either data on the stitching direction of each stitch or data on the magnitude of the inner angle which the stitching direction of the stitch forms with the stitching direction of another stitch immediately preceding the stitch and which is an acute angle is entered from the input section; and the control section calculated the length of the needle thread on the back of the process fabric by weighting the length of the needle thread which is based on the ratio between the length of the needle thread and the length of the bobbin thread on the back of the process fabric by the magnitude of the inner angle. Therefore, either the data on the stitching direction or the data on the magnitude of the inner angle is entered, whereby the needle thread requirement in the precorrected needle thread requirement data can be calculated in consideration of the inner angle, and the needle thread requirement can be set to a more appropriate value.

Twentieth, according to any one of the first through eleventh configurations, the sewing machine further comprises the input section for entering data on stitch width of each stitch, data for each stitch on the ratio between the length of the needle thread and the length of the bobbin thread on the back of the process fabric where the bobbin thread appears, and data on the thickness of the process fabric, wherein the control section generates the precorrected needle thread requirement data by calculating on the basis of the data entered by the input section according to $L+2\times T+L\times A/(A+B)$, provided the stitch width is L, the thickness of the process fabric is T, and the ratio is A:B, and the generated precorrected needle thread requirement data is stored in the memory section.

Therefore, the data on the stitch width, the data on the thickness of the process fabric, and the ratio data are entered, whereby the control section can generate the precorrected needle thread requirement data and stores the data in the memory section. Further, the ratio data is entered, whereby the desired balance between the length of the needle thread and the length of the bobbin thread on the back of the process fabric can be achieved, and the desired balance between the needle thread consumption and the bobbin thread configuration can be achieved.

Twenty-first, according to any one of the first through eleventh configurations, the sewing machine further comprises an input section for entering either data on the stitching direction of each stitch or data on the magnitude of an inner angle which the stitching direction of a stitch forms with the stitching direction of another stitch immediately preceding the stitch and which is an acute angle, data on the stitch width of each stitch, data for each stitch on a ratio between the length of the needle thread and the length of the bobbin thread on the back of the process fabric where the bobbin thread appears, and data on the thickness of the process fabric, wherein the control section generates the precorrected needle thread requirement data by calculating on the basis of the data entered by the input section according to $L+2\times T+L\times A/(A+B)\times W$, provided the stitch width is L, the thickness of the process fabric is T, the ratio is A:B, and a coefficient corresponding to the magnitude of the inner angle is W, and the generated precorrected needle thread requirement data is stored in the memory section.

Therefore, either the data on the stitching direction or the data on the magnitude of the inner angle, the data on the stitch width, the data on the thickness of the process fabric, and the ratio data are entered, whereby the control section can generate the precorrected needle thread requirement data and stores the data in the memory section. Further, the ratio data is entered, whereby the desired balance between the length of the needle thread and the length of the bobbin thread on the back of the process fabric can be achieved, and the desired balance between the needle thread consumption and the bobbin thread configuration can be achieved. Moreover, the needle thread requirement in the precorrected needle thread requirement data can be calculated in consideration of the inner angle. Hence, the needle thread requirement can be set to a more appropriate value.

Twenty-second, according to any one of the fourteenth configuration, the sixteenth configuration, the nineteenth configuration, and the twenty-first configuration, the coefficient achieved when the inner angle is 0 degree is 1; the coefficient achieved when the inner angle is 180 degrees is 0; and the coefficient is proportional to the angle.

Twenty-third, according to any one of the first through twenty-second configurations, the end point of the torque control zone coincides with the starting point of the first position control zone; the end point of the first position control zone coincides with the starting point of the second position control zone; the end point of the second position control zone coincides with the starting point of the torque control zone; and, in the first position control zone, the control section detects a current position at the angle of the needle thread motor at the starting point of the first position control zone; generates first angle correspondence data which specifies the angle of the needle thread motor from the current position at the angle of the needle thread motor to the position where the needle thread motor rotates through an angle specified on the basis of the current position at the angle of the needle thread motor and the needle thread requirement in the post-corrected needle thread requirement data on each angle of the main spindle motor that is a position of a main spindle in its rotation direction where the main spindle motor transmit power to the thread take-up lever; and controls the position of the needle thread motor at the angle of the needle thread motor corresponding to the angle of the main spindle motor as the main spindle motor rotates and the angle of the main spindle motor changes;

in the second position control zone, detects the current position at the angle of the needle thread motor at the starting point of the second position control zone; generates second angle correspondence data which specifies the angle of the needle thread motor from the angle at the current position of the needle thread motor to the initial position on each angle of the main spindle motor; and controls the position of the needle thread motor at the angle of the needle thread motor commensurate with the angle of the main spindle motor as the main spindle motor rotates and the angle of the main spindle motor rates.

Therefore, in the first position control zone, the first angle correspondence data is generated. In the second position control zone, the second angle correspondence data is generated. Accordingly, the angle of the needle thread motor can be subjected to position control.

Twenty-fourth, a configuration below may be adopted. Specifically, according to any one of the first through twenty-third configurations, a sewing unit having thread take-up arms and a needle thread control section. The sewing unit further includes: an arm making up an enclosure of the sewing machine, a needle bar case that is provided so as to be slidable in a horizontal direction with respect to the arm and that includes first opening sections made at positions between the upstream grip section main body and the downstream grip section main body in a vertical direction such that a leading end of the turning arm of a turning section can be exposed to the front side, a second opening section which is provided above the first opening section and on which the upstream magnet section fronts, and a third opening section which is provided below the first opening section and on which a downstream magnet section fronts, a plurality of needle bars provided in the needle bar case, and needle thread supporting members that each is provided in the needle bar case and that each supports the needle thread in its horizontal direction at the position of the first opening section; wherein the thread take-up lever is placed while being exposed from a position in the needle bar case below the downstream grip section to a front, and the turning arm is turned while remaining in contact with the needle thread supported by the needle thread supporting member, thereby turning the needle thread; wherein the upstream grip section main body is placed on a front side of the needle bar case and, and has upstream first plate-like sections which is formed into a shape of a plate from a magnetic substance; that is, a material attracted by the magnet and which is provided for the respective needle bars and an upstream second plate-like section which is provided at back side of the upstream first plate-like sections and on a front side of the second opening section and which is formed into a shape of a plate from a non-magnetic substance unattracted by the magnet; wherein the upstream actuation section is a magnet section serving as the upstream magnet section and secured to the arm-side at a back side of the upstream second plate-like section and switches between a closed state in which the upstream first plate-like section is attracted by magnetic force, to thus pinch and grip the needle thread between the upstream first plate-like section and the upstream second plate-like section and an open state in which attraction caused by the magnetic force is released to thereby release the needle thread from the gripped state; wherein the downstream grip section main body is placed on a front side of the needle bar case and below the upstream grip section main body and has downstream first plate-like sections which are formed from a magnetic substance which is attracted by the magnet into a shape of a plate and which are provided for the respective needle bars and a downstream second plate-like section which is provided at back side of the downstream first plate-like sections and on a front side of the second opening section and which is formed into a shape of a plate from a non-magnetic substance unattracted by the magnet; and wherein the downstream actuation section is a magnet section serving as the downstream magnet section and secured to the arm-side at a back side of the downstream second plate-like section and switches between a closed state in which the downstream first plate-like section is attracted by magnetic force, to thus pinch to thereby grip the needle thread between the downstream first plate-like section and the downstream second plate-like section and an open state in which the needle thread is released from the gripped state by means of canceling attraction caused by the magnetic force.

Advantages of the Invention

In the sewing machine of the invention, the needle thread quantity data are provided; the precorrected needle thread requirement is previously determined for each stitch; and the needle thread requirement of the postcorrected needle thread requirement data is corrected according to the magnitude of the difference between the needle thread requirement of the precorrected needle thread requirement data and the needle thread consumption. Accordingly, the needle thread consumption can be made closer to the needle thread requirement of the precorrected needle thread requirement data, and a desired balance between the needle thread consumption and the bobbin thread consumption can be achieved. Since the desired balance between the needle thread consumption and the bobbin thread consumption can be achieved, a seam finish involving the stable balance between the needle thread consumption and the bobbin thread consumption can be produced.

Even when the existing configuration using a bobbin case for a bobbin thread having a tension spring attached is used, a desired balance between the needle thread consumption and the bobbin thread consumption can be achieved. Accordingly, a low-cost sewing machine capable of achieving a desired balance between the needle thread consumption and the bobbin thread consumption can be provided.

BRIEF DESCRIPTION OF THE DRAWINGS

FIG. 1 It is an explanatory view showing a sewing machine.

FIG. 2 It is a forward perspective view showing a head of the sewing machine.

FIG. 3 It is a backward perspective view showing the head of the sewing machine.

FIG. 4 It is a front view showing a principal section of the head of the sewing machine.

FIG. 5 It is a fragmentary cross sectional left-side view showing the head of the sewing machine.

FIG. 6 It is an enlarged view of the principal section shown in FIG. 5.

FIG. 7 It is a fragmentary cross sectional left-side view showing the head of the sewing machine.

FIG. 8 It is a backward perspective view of a first plate-like section unit.

FIG. 9 It is an explanatory view showing a principal section of a sewing section.

FIG. 10 It is an explanatory view showing a configuration of a memory device.

FIG. 11 It is an explanatory view showing a configuration of embroidery data.

FIG. 12 It is an explanatory view showing a configuration of needle thread control toque data.

FIG. 13 It is an explanatory view showing zone position data.

FIG. 14 It is an explanatory view showing main spindle data.

FIG. 15 It is an explanatory view showing the main spindle data.

FIG. 16 It is an explanatory view showing needle-thread quantity data.

FIG. 17 It is an explanatory view showing a first correspondence table.

FIG. 18 It is an explanatory view showing a second correspondence table.

FIG. 19 It is a flowchart that illustrates a method for controlling a needle thread motor FIG. 20 It is a flowchart that illustrates the method for controlling the needle thread motor, in particular, a method for the torque control.

FIG. 21 It is a flowchart that illustrates the method for controlling the needle thread motor, in particular, a method for first position control and second position control.

FIG. 22 It is a flowchart that illustrates the method for controlling the needle thread motor, in particular, the method for first position control and second position control.

FIG. 23 It is an explanatory view showing first angle correspondence data.

FIG. 24 It is an explanatory view showing the first angle correspondence data.

FIG. 25 It is an explanatory view that illustrates a method for position control of the needle thread control motor.

FIG. 26 It is a functional block diagram showing a method for control of the needle thread motor.

FIG. 27 It is a flowchart showing operation of an upstream grip section and operation of a downstream grip section.

FIG. 28 It is a flowchart showing a method for correcting needle thread requirement.

FIGS. 29(*a*) and (*b*) It is an explanatory view showing a method for correcting the needle thread requirement.

FIGS. 30(*c*) and (*d*) It is an explanatory view showing the method for correcting the needle thread requirement.

FIGS. 31(*a*), (*b*), (*c*) and (*d*) It is an explanatory view that illustrates interior angles formed by target stitch and a stitch immediately preceding the target stitch.

FIG. 32 It is an explanatory view showing an interior angle table.

FIGS. 33(*a*), (*b*) and (*c*) It is an explanatory view showing a relationship between a needle thread and a bobbin thread in a process fabric.

FIG. 34 It is a flowchart showing a method for controlling a main spindle motor.

FIG. 35 It is a flowchart showing the method for controlling the main spindle motor.

FIG. 36 It is a functional block diagram showing a method for controlling the main spindle motor.

FIG. 37 It is an explanatory view showing operation of a shuttle.

FIG. 38 It is an explanatory view showing operation of the sewing machine.

FIG. 39 It is an explanatory view showing operation of the sewing machine.

FIG. 40 It is an explanatory view that illustrates the direction of a stitch in embroidery data.

FIG. 41 It is an explanatory view that illustrates the direction of the stitch in the embroidery data.

FIG. 42 It is an exploded perspective view showing the configuration of the shuttle.

FIG. 43 It is a perspective view of a bobbin case.

EMBODIMENTS FOR IMPLEMENTING THE INVENTION

The present invention provides a sewing machine capable of attaining inexpensively a desired balance between a needle thread consumption and a bobbin thread consumption and, more particularly, a sewing machine capable of attaining a desired balance between a needle thread consumption and a bobbin thread consumption even when the existing configuration using a bobbin case for a bobbin thread having a tension spring attached is used.

A sewing machine 1 based on the invention is an embroidery sewing machine, configured as shown in FIGS. 1 through 24, FIG. 32, FIG. 42, and FIG. 43, and has a sewing table (not shown), a head (an embroidery head) 3, a sewing frame 12*d*, a main spindle motor 20, a main spindle 22, a frame actuator 24, a control circuit 90, a memory device 92, an input-output device 94, an operation section 96, a shuttle 100. The sewing machine 1 is a multi-needle sewing machine; specifically, a nine-needle embroidery sewing machine compatible with nine types of needle threads.

In the sewing machine 1, the head 3, the shuttle 100 make up a sewing unit 2. The sewing unit 2 is provided in numbers, and the sewing frame 12*d*, the main spindle motor 20, the main spindle 22, the frame actuator 24, the control circuit (control section) 90, the memory device (storage section) 92, the input-output device (the input-output section, the input section) 94, and the operation section 96 are provided commonly for the plurality of sewing units 2.

FIGS. 5 and 6 are fragmentary cross sectional left-side views showing cutaways of only a needle thread control mounting section 1340 and a needle thread control section 1230 taken along position P-P shown in FIG. 4. FIG. 7 is a fragmentary cross sectional left-side view showing cutaways of only the needle thread control mounting section 1340 and the needle thread control section 1230 taken at position Q-Q shown in FIG. 4. FIG. 5 to FIG. 7 are plots from which the needle thread is omitted.

The sewing machine table assuming a substantially flat shape includes a plate-like table body and a throat plate 5 (see FIG. 37) positioned in an aperture formed in the table body.

The head 3 is disposed at an elevated position above an approximately-plate-like sewing machine table. Specifically, a frame (not shown) is disposed upright on the upper surface of the sewing machine table. The head 3 is provided on the front side of the frame. The head 3 is provided in numbers in the sewing machine 1.

The head 3 is structured as shown in FIG. 1 to FIG. 8 and has the machine element group 10, the needle thread control section 1230, and a case 1310.

The case 1310 makes up an enclosure of the sewing machine 1 (specifically, the head 3). The case 1310 has an arm 1312 (this may also be taken as an "arm section") secured to the frame and a needle bar case 1314 that slides in a horizontal direction with respect to the arm 1312 provided on a front side (Y1 side) of the arm 1312.

The arm 1 is formed approximately into a shape of a case extended in its front-back direction, making up an enclosure of the sewing machine 1205 (specifically the head 3). The arm 1312 has a shape enclosed by a square-shaped upper surface section 1312*a*; side surface sections 1312*b* and 1312*c* that continually extend from both lateral ends of the upper surface section 1312*a* in the downward direction and a front-side upper end of each of which has a square cutout; front surface section 1312*d* continually extending from front-side ends of the respective side surface sections 1312*b* and 1312*c* except their upper ends; front surface sections 1312*e* continually extending from the front-side ends in upper end areas of the respective side surface sections 1312*b* and 1312*c*; and upper surface section 1312*f* formed between lower ends of the respective front surface section 1312*e* and upper ends of the respective front surface section 1312*d*. A back-side end of the arm 1312 is connected to the frame.

A rail supporting section 1312*g* is provided on a front side of the arm 1312, and a rail section 1334 provided on a back side of a needle bar case main body 1330 slidably fits on the rail supporting section 1312*g*.

A rail 1312*h* having a shape of an approximately inverted letter T is disposed on the upper surface section 1312*f*. The needle bar case main body 1330 is equipped with a sliding member 1314*h* that slides over the rail 1312*h*.

Power transmission means, such as a cam mechanism or a belt mechanism, for transmitting rotating force of the main spindle 22 to respective machine elements is provided in the arm 1312.

A motor 1313*b* for letting the needle bar case 1314 slide and a clutch housing section 1313*a* are provided on an upper surface of the arm 1312. The clutch housing section 1313*a* is provided with a clutch 1313*a*-1 that is rotated by the motor 1313*b*. The clutch 1313*a*-1 has a helical groove. The helical groove of the clutch 1313*a*-1 is engaged with a cylindrical clutch engagement section 1339*b* provided on a back side of the needle bar case main body 1330. As a result of the clutch 1313*a*-1 being rotated, the needle bar case 1314 slides in the horizontal direction.

The needle bar case 1314 is formed approximately into a shape of a case that can slide in the horizontal direction with respect to the arm 1312. The needle bar case 1314 has the needle bar case main body (a needle bar housing case) 1330 and the needle thread control mounting section 1340.

The needle bar case main body 1330 is structured as shown in FIGS. 2, 3, 5, 6, and 7. The needle bar case main body 1330 has an enclosure section 1332; the rail section 1334 formed on a back side of the enclosure section 1332 along the horizontal direction; and supporting sections 1335, guide members 1336, tension springs (generally called "high tension springs") 1337, and needle thread guides 1338 that are all provided on a front side of the enclosure section 1332.

The enclosure section 1332 assumes a shape of a case that is formed in a vertically-elongated manner when viewed sideways. The enclosure section 1332 has a side surface section 1332*a* that is vertically long when viewed sideways and that has an upper end area protruding to the front and back sides; a side surface section 1332*b* formed symmetrical to the side section 1332*a*; a square-shaped front section 1332*c* interposed between a lower area of the side surface section 1332*a* and a lower area of the side surface section 1332*b*; an upper surface section 1332*d* that is interposed on the level between an upper end of the side surface section 1332*a* and an upper end of the side surface section 1332*b* in the horizontal direction; and a projecting section 1332*e* that is interposed between the front section 1332*c* and the upper surface section 1332*d* and that projects to the front rather than the front section 1332*c*. In relation to the projecting section 1332*e*, a plurality of projecting sections 1332*e* are spaced apart from each other. Opening sections (not shown) used for letting the thread take-up levers 12*a*-1 to 12*a*-9 project to the front are provided among the adjacent projecting sections 1332*e*.

The rail section 1334 is laid on the back side of the enclosure section 1332; assumes a square-rod-shaped cross section; and is formed along the horizontal direction. The rail section 1334 is supported so as to be slidable in the horizontal direction by the rail supporting section 1312*g* secured to the arm 1312. The rail supporting section 1312*g* and the rail section 1334 make up a linear way.

A plurality of cylindrical clutch engagement sections 1339*b* are provided along the horizontal direction, while spaced apart from each other, at an upper end on the back side of the enclosure section 1332 of the needle bar case main body 1330 by way of a horizontally-laid rod-shaped section 1339*a*. As a result of rotation of the motor 1313*b*, the clutch 1313*a*-1 rotates, whereupon the needle bar case 1314 slides in the horizontal direction.

The supporting sections 1335 are mounted on the level (or approximately on the level) to an upper area of a front side of the front section 1332*c* of the enclosure section 1332 along the horizontal direction. The guide members 1336 are provided at intervals for respective thread take-up levers on the supporting sections 1335 and assume the shape of an approximately-L-shaped plate. The tension springs 1337 are provided at intervals for the respective thread take-up levers and attached to the supporting sections 1335 beneath the respective guide members 1336. The tension springs 1337 are provided for guiding the needle threads J fed from above (namely, fed from the downstream grip section 1260) to the respective thread take-up levers while preventing occurrence of a flexure or looseness of the needle thread J. The tension springs 1337 invert the respective needle threads J guided from above and subsequently lead the respective needle threads J to the respective thread take-up levers while exerting tension on the respective needle threads J. The needle thread guides 1338 are provided at a lower end on the front side of the front section 1332*c* along the horizontal direction.

The needle thread control mounting section 1340 is mounted on an upper surface of the needle bar case main body 1330 (particularly the enclosure section 1332). The needle thread control mounting section 1340 has a plate-like plate section 1341; plate section supporting sections 1344 that support the plate section 1341 in an upright position; guide members 1252, 1254, 1272, 1274, and 1290 attached to the plate section 1341; and needle thread guides 1300 and 1302, guide plates 1346*a* and 1346*b*, rest sections 1347*a* and 1347*b*, and presser plates 1348*a* and 1348*b*.

The plate section 1341 assumes a shape of a (or approximately) rectangular plate. Formed in the plate section 1341 are an opening section (a second opening section) 1342*a* on which a magnet section 1250 fronts, a plurality of (nine in the illustrated example) opening sections (first opening sections) 1342*b* on which a turning arm 1281 fronts and that each are used for mounting a pair of needle thread supporting members 1288; and an opening section (a third opening section) 1342*c* on which a magnet section 1270 fronts. The plate section 1341 is formed in the horizontal direction, and upper and lower sides of the plate section 1341 are oriented along the horizontal direction.

The opening section 1342*a* is formed into a horizontally elongated rectangular shape above the opening sections 1342*b*. A vertical width of the opening section 1342*a* is larger than a leading end portion of the magnet section 1250, to thus make it possible to insert the leading end portion of the magnet section 1250 into the opening section 1342*a*. Likewise, the opening section 1342*c* is formed into a horizontally elongated rectangular shape below the opening sections 1342*b*. A vertical width of the opening section 1342*c* is larger than a leading end portion of the magnet section 1270, to thus make it possible to insert the leading end portion of the magnet section 1270 into the opening section 1342*c*.

The opening sections 1342*b* are provided in correspondence with the respective needle bars. The opening sections 1342*b* are formed at a position between a first plate-like section unit in a grip section main body 1241 and a first plate-like section unit in a grip section main body 1261 corresponding to the counterpart first plate-like section unit (i.e., a position between the a first plate-like section 1242*a* and a first plate-like section 1262*a* corresponding to the first plate-like section 1242*a*). Specifically, the opening sections 1342*b* assume a vertically-long rectangular shape. In the illustrated example, a total number of nine opening sections 1342*b* are provided. The opening sections 1342*b* are placed along the horizontal direction at spacing (specifically regular intervals). The opening sections 1342*b* are formed so that a leading end of the turning arm 1281 can project to the front side (Y1 side) of the plate section 1341 (the front side is on the other side of the plate section 1341 with respect to the arm 1312) in an exposed manner.

The plate section supporting section 1344 is provided at each of horizontal ends on the back side of the plate section 1341, assuming an approximately-C-shaped frame. Each of the plate section supporting sections 1344 is attached to an upper surface of the enclosure section 1332. The plate section 1341 is attached to the front side of the enclosure section 1332 and supported by the enclosure section 1332. The plate section 1341 is attached in such a way that a front-side surface of the plate section 1341 faces in an oblique upward direction.

The guide members 1252, 1254, 1272, 1274, and 1290 are provided vertically to a front-side surface of the plate section 1341 upright on the front-side surface of the plate section 1341. The guide member 1252 and the guide member 1254 are provided for each of first plate-like section units 1242-1 to 1242-9. The guide members 1252 are disposed at intervals along an upper side of the opening section 1342*a*. The guide members 1254 are disposed at intervals along a lower side of the opening section 1342*a*. The guide members 1272, the guide members 1274, and the guide members 1290 are provided for each of first plate-like section units 1262-1 to 1262-9. The guide members 1272 are disposed at intervals along an upper side of the opening section 1342*c*. The guide members 1274 are disposed at intervals along a lower side of the opening section 1342*c*. The guide members (the first needle thread path inverting members) 1290 are disposed at intervals along an upper side surface of the opening section 1342*c* while spaced apart from the respective guide members 1272.

The guide members 1252, 1254, 1272, 1274, and 1290 assume a substantially columnar shape.

The needle thread guides 1300 are disposed in an upper region on the front side of the plate section 1341 (a region above the guide members 1252), thereby guiding the respective needle threads in an insertable manner. In the illustrated example, the five needle thread guides 1300 are provided.

The needle thread guides 1302 are disposed in a lower region on the front side of the plate section 1341 (a region beneath the guide members 1274), thereby guiding the respective needle threads in an insertable manner. In the illustrated example, the five needle thread guides 1302 are provided.

The guide plate 1346*a* assumes the shape of an elongated rectangular plate and disposed in the horizontal direction on the back side of the plate section 1341 and along an upper side on a back surface of the opening section 1342*a*. The guide plate 1346*a* is placed on the back side of a retaining section 1242*b* for the first plate-like section units 1242-1 to 1242-9, preventing droppage of the first plate-like section units 1242-1 to 1242-9 from the plate section 1341. The rest section 1347*a* is provided at each of right and left lateral ends of the back side of the plate section 1341 while interposed between the guide plate 1346*a* and the back side of the plate section 1341, thereby forming spacing between the guide plate 1346*a* and the plate section 1341. Thus, the rest section 1347*a* makes it possible for the first plate-like section units 1242-1 to 1242-9 to make sliding actions in the front-back direction with no difficulty.

The guide plate 1346*b* assumes the shape of an elongated rectangular plate and disposed in the horizontal direction on the back side of the plate section 1341 and along an upper side on a back surface of the opening section 1342*c*. The guide plate 1346*b* is placed on the back side of a retaining section 1262*b* for the first plate-like section units 1262-1 to 1262-9, preventing droppage of the first plate-like section units 1262-1 to 1262-9 from the plate section 1341. The rest section 1347*b* is provided at each of right and left lateral ends of the back side of the plate section 1341 while interposed between the guide plate 1346*b* and the back side of the plate section 1341, thereby forming spacing between the guide plate 1346*b* and the plate section 1341. Thus, the rest section 1347*b* makes it possible for the first plate-like section units 1262-1 to 1262-9 to make sliding actions in the front-back direction with no difficulty.

The presser plates 1348*a* are provided on both sides of the opening section 1342*a* on the front surface of the plate section 1341. Right and left lateral side ends of a second plate-like section 1244 are sandwiched between the presser plates 1348*a* and the plate section 1341. The presser plates 1348*b* are provided on both sides of the opening section 1342*c* on the front surface of the plate section 1341. Right and left lateral side ends of a second plate-like section 1264 are sandwiched between the presser plates 1348*b* and the plate section 1341.

The machine element group 10 is comprised of machine elements to be actuated in the head 3. The machine elements include the plurality of thread take-up levers, the plurality of needle bars, and the presser feet. However, in the embodiment, the head is equipped with nine thread take-up levers 12*a*-1 to 12*a*-9, nine needle bars 12*b*-1 to 12*b*-9, and nine presser feet 12*e*. The thread take-up levers 12*a*-1 to 12*a*-9, the needle bars 12*b*-1 to 12*b*-9, and the shuttle 100 are actuated by means of transmitting rotating force of the main spindle 22 by way of the power transmission means, like a cam mechanism or a belt mechanism, as in the case of the related-art sewing machine. Incidentally, the number of thread take-up levers, needle bars, and presser feet can also be any number other than nine (e.g., 12).

The thread take-up levers 12*a*-1 to 12*a*-9 are provided in the enclosure section 1332 of the needle bar case main body 1330 of the case 1310 and are formed so as to be able to sway around an axis line (the rotating center) in the horizontal direction (the direction X1-X2) and turn between the bottom dead center (one dead center) and the top dead center (the other dead center).

Specifically, the thread take-up levers 12*a*-1 to 12*a*-9 are axially supported by the needle bar case main body 1330 so as to sway around the rotating center (this can also be taken as a "swaying center") 12*ab* (see FIG. 1). Needle threads to be inserted into the respective sewing needles are inserted into the respective thread take-up levers 12*a*-1 to 12*a*-9. Power is transmitted to only a selected, specific thread take-up lever as a result of the needle bar case 1314 sliding in the horizontal direction with respect to the arm 1312, whereupon the specific thread take-up lever is swayed. In other words, base ends 12*az* (see FIG. 3) of the respective thread take-up levers 12*a*-1 to 12*a*-9 are engaged with engagement members 1313*z* of the arm 1312. The thread take-up levers are then swayed as a result of the engagement members 1313*z* turning around a turning center. Leading ends of the respective thread take-up levers 12*a*-1 to 12*a*-9 project to the front (in direction Y1), in an exposed manner, from the respective opening sections provided between the adjacent projecting sections 1332*e* on the front side of the enclosure section 1332. In this respect, leading ends of the respective thread take-up levers 12*a*-1 to 12*a*-9 just outside in an exposed manner to the front side (side Y1) by way of respective openings opened among adjacent projections 1332*e* among a plurality of projections 1332*e* provided on the front side of the enclosure section 1332.

The needle bars 12*b*-1 to 12*b*-9 are provided in the enclosure section 1332 so as to be movable in the vertical direction. Sewing needles 12*ba* (each of the sewing needles 12*ba* has a pin hole) are fixedly provided at lower ends of the respective needle bars. A needle bar connecting stud 14*a* is fixedly provided at the upper end of each of the needle bars 12*b*. Moreover, a needle bar actuation member 14*b* comes into engagement with the needle bar connecting stud 14*a*. A base needle bar 14*c* provided in the vertical direction is inserted into each of the needle bar actuation member. The needle bar actuation member 14*b* is formed so as to be movable in the vertical direction along the base needle bar 14*c*. Rotating force of the main spindle 22 is transmitted by the power transmission means, whereupon the needle bar actuation member 14*b* is vertically actuated. The needle bars are thereby moved in the vertical direction. The needle bar case 314 slides in the horizontal direction with respect to the arm 1312, whereby the needle bar actuation member is engaged with a specific needle bar connecting stud 14*a*, so that a selected needle bar is vertically actuated. The presser foot 12*e* is provided for each of the needle bars.

The needle thread control section 1230 is for pulling out a needle thread from the thread roll (not shown) wound around the needle thread bobbin and controlling tension exerted on the needle threads. The needle thread control section 1230 has an upstream grip section 1240, the downstream grip section 1260, a turning section 1280 (see FIG. 1, FIG. 6, and FIG. 7), needle thread supporting members 1288 and a supporting section (a magnet section and a motor supporting member) 1360.

Incidentally, the upstream grip section 1240 is placed at an upper area of the plate section 1341; namely, an area above the turning sections 1280. The upstream grip section 1240 has the grip section main body (an upstream grip section main body) 1241 and the magnet section (an upstream drive section and an upstream magnet section) 1250 provided on a back side of the grip section main body 1241.

The grip section main body 1241 has the first plate-like section units 1242-1 to 1242-9 provided for the respective needle bars and the second plate-like section (an upstream second plate-like section) 1244 that is provided on the back side of the first plate-like section 1242*a* in the first plate-like section units 1242-1 to 1242-9 and on the front side of the needle bar case 1314 (specifically the plate section 1341).

As shown in FIG. 8, each of the first plate-like section units 1242-1 to 1242-9 includes the first plate-like section (an upstream first plate-like section) 1242*a* assuming the shape of a square-shaped plate and the retaining section (a mounting member) 1242*b* formed so as to project from an upper end of the first plate-like section 1242*a* to the back. The retaining section 1242*b* assumes the shape of an approximately-L-shaped plate (a shape made by bending a rectangular plate approximately into the letter L). The first plate-like section unit is integrally formed from a material which is attracted by a magnet (a material to which a magnet adheres); that is, a magnetic substance (or a ferromagnetic substance instead). Specifically, each of the first plate-like section units 1242-1 to 1242-9 is formed from metal attracted by a magnet, like iron. The first plate-like section units are formed in (or approximately) a same size and a same shape. As a result of the retaining sections 1242*b* being engaged with retaining holes 1342*d* formed in the plate section 1341, the first plate-like section units 1242-1 to 1242-9 are arranged at spacing (specifically uniform intervals) side by side along the horizontal direction. Spacing exists between two adjacent first plate-like section units. The plurality of (specifically, a total of nine) retaining holes 1342*d* are arranged at spacings (specifically uniform intervals) side by side along the horizontal direction and at an area on the plate section 1341 above the opening section 1342*a*. The first plate-like sections are suspended by means of the plate section 1341 (or may also hang from the plate section) as a result of the retaining sections 1242*b* being engaged with the respective retaining holes 1342*d*. The first plate-like section 1242*a* slides in the vertical direction with respect to the front surface of the second plate-like section 1244, whereby spacing between the first plate-like section 1242*a* and the second plate-like section 1244 varies.

The second plate-like section 1244 is a single plate-like member that is provided at the back side of the first plate-like sections 1242*a* of the respective first plate-like section units 1242-1 to 1242-9 and that assumes the shape of an elongated rectangle. Specifically, the second plate-like section 1244 is formed so as to become, in the horizontal direction, longer than a distance from a left lateral side of the first plate-like section 1242*a* of the first plate-like section unit 1242-1 provided at a left end to a right lateral side of the first plate-like section 1242*a* of the first plate-like section unit 1242-9 provided at a right end when viewed from the front. In addition, the second plate-like section 1244 is formed so as to have, in the vertical direction, (approximately) the same width as a vertical width of each of the first plate-like sections 1242*a* of the first plate-like section units 1242-1 to 1242-9. The left end of the second plate-like section 1244 when viewed from the front is situated more left than the left lateral side of the first plate-like section 1242*a* of the first plate-like section unit 1242-1 and fixed to the plate section 1341 by means of the presser plate 1348*a*. The right end of the second plate-like section 1244 when viewed from the front is situated more right than the right lateral side of the first plate-like section 1242*a* of the first plate-like section unit 1242-9 and fixed to the plate section 1341 by means of the presser plate 1348*a*. Specifically, the second plate-like section 1244 is present on the back of each of the respective first plate-like section units 1242-1 to 1242-9 and in parallel with the respective first plate-like sections of the respective first plate-like section units 1242-1 to 1242-9. The second plate-like section 1244 is formed from a substance unattracted by the magnet (a material to which the magnet does not adhere); that is, a non-magnetic substance, for instance, a film made from a synthetic resin. The second plate-like section 1244 can also be made from aluminum or stainless steel.

The second plate-like section 1244 is made larger than the opening section 1342*a* and provided so as to cover the opening section 1342*a* from the front.

The magnet section 1250 is formed from an electromagnet, and a leading end of the magnet section is formed so as to be placed in the opening section 1342*a* and contact the back side of the second plate-like section 1244. A surface (facing the second plate-like section 1244) of the leading end of the magnet section 1250 works as an attracting surface. The magnet section 1250 assumes a shape of an approximately cylindrical shape (the same also holds true for the magnet section 1270). FIG. 5 to FIG. 7 depict the magnet sections 1250 and 1270 while their detailed cross-sectional profiles are omitted. The magnet sections 1250 and 1270 have the same structure as an ordinary electromagnet and include a core made of a magnetic substance and a coil wound around the core. When energized, the coil generates magnetic force. One magnet section 1250 is provided for the upstream grip section 1240. The control circuit 90 activates the magnet section 1250, whereupon the first magnet section 1242*a* of any one of the first plate-like section units 1242-1 to 1242-9 corresponding to the position of the magnet section 1250 is attracted by the magnetic force. Spacing between the first plate-like section 1242*a* and the second plate-like section 1244 is thus closed. The magnet section 1250 is attached to an upper end of a front surface of a plate-like section 1360*e* in the supporting section 1360 in a direction perpendicular to a back side of the plate section 1341. Specifically, the magnet section 1250 is secured in the direction of the arm 1312.

When the respective first plate-like sections 1242*a* of the first plate-like section units 1242-1 to 1242-9 are viewed from the front, the guide members (first guide members) 1252 are provided above the respective first plate-like section units 1242-1 to 1242-9, and the guide members (first guide members) 1254 are provided below the respective first plate-like section units 1242-1 to 1242-9. As shown in FIG. 4, the guide members 1252 and 1254 are arranged in such a way that the needle thread J diagonally passes on the back side of each of the first plate-like sections. Each of the guide members 1252 is provided at an upper left point above each of the first plate-like sections when viewed from the front. Each of the guide members 1254 is provided at a lower right point below each of the first plate-like sections when viewed from the front. A longer path can be assured for the needle thread J that is at the back side of each of the first plate-like sections, so that the needle thread J can be caught between the first plate-like sections and the second plate-like section 1244 in a more reliable manner.

The downstream grip section 1260 is placed on a lower area of the plate section 1341; namely, an area below the turning section 1280. The downstream grip section 1260 has the grip section main body (a downstream grip section main body) 1261 and the magnet section (a downstream actuation section or a downstream magnet section) 1270 provided at the back side of the grip section main body 1261.

The grip section main body 1261 has the same structure as that of the grip section main body 1241. The grip section main body 1261 has the first plate-like section units 1262-1 to 1262-9 provided for the respective needle bars and the second plate-like section (a downstream second plate-like section) 1264 that is provided at the back side of the first plate-like sections 1262*a* of the respective first plate-like section units 1262-1 to 1262-9 and on the front side of the needle bar case 1314 (specifically, the plate section 1341).

The first plate-like section units 1262-1 to 1262-9 have the same structure as the first plate-like section units 1242-1 to 1242-9. As shown in FIG. 8, each of the first plate-like sections 1262*a* of the first plate-like section units 1262-1 to 1262-9 includes the first plate-like section (a downstream first plate-like section) 1262*a* assuming the shape of a square-shaped plate and a retaining section (a mounting member) 1262*b* formed so as to project from an upper end of the first plate-like section 1262*a* to the back. The retaining section 1262*b* assumes the shape of an approximately-L-shaped plate. Specifically, each of the first plate-like section units 1262-1 to 1262-9 is formed from a material which is attracted by the magnet (a material to which the magnet adheres); that is, a magnetic substance (or a ferromagnetic substance instead). The respective first plate-like section units are formed in (or approximately) a same size and a same shape. As a result of the retaining sections 1262*b* being engaged with retaining holes 1342*e* formed in the plate section 1341, the first plate-like section units 1262-1 to 1262-9 are arranged at spacing (specifically uniform intervals) side by side along the horizontal direction. Specifically, spacing exists between two adjacent first plate-like section units. The plurality of (specifically, a total of nine) retaining holes 1342*e* are arranged at spacings (specifically uniform intervals) side by side along the horizontal direction and at an area on the plate section 1341 above the opening section 1342*c* (and below the opening section 1342*b*). The first plate-like sections are suspended by means of the plate section 1341 (or may hang from the plate section) as a result of the retaining sections 1262*b* being engaged with the respective retaining holes 1342*e*. The first plate-like section 1262*a* slides in the vertical direction with respect to the front surface of the second plate-like section 1264, whereby spacing between the first plate-like section 1262*a* and the second plate-like section 1264 varies. In relation to the first plate-like section units 1242-1 to 1242-9 and the first plate-like section units 1262-1 to 1262-9, the first plate-like section units assigned to the same needle thread are placed at the same position with reference to the horizontal direction.

The second plate-like section 1264 has the same structure as the second plate-like section 1244. The second plate-like section 1264 is a single plate-like member that is provided on the back side of the first plate-like sections 1262*a* of the respective first plate-like section units 1262-1 to 1262-9. Specifically, the second plate-like section 1264 is formed so as to become, in the horizontal direction, longer than a distance from a left lateral side of the first plate-like section 1262*a* of the first plate-like section unit 1262-1 provided at a left end to a right lateral side of the first plate-like section 1262*a* of the first plate-like section unit 1262-9 provided at a right end when viewed from the front. In addition, the second plate-like section 1264 is formed so as to have, in the vertical direction, (or approximately) the same width as a vertical width of each of the first plate-like sections 1262*a* of the first plate-like section units 1262-1 to 1262-9. The left end of the second plate-like section 1264 when viewed from the front is situated more left than the left lateral side of the first plate-like section 1262*a* of the first plate-like section unit 1262-1 and fixed to the plate section 1341 by means of the presser plate 1348*b*. The right end of the second plate-like section 1264 when viewed from the front is situated more right than the right lateral side of the first plate-like section 1262*a* of the first plate-like section unit 1262-9 and fixed to the plate section 1341 by means of the presser plate 1348*b*. Specifically, the second plate-like section 1264 is present at a back side of each of the first plate-like sections of the respective first plate-like section units 1262-1 to 1262-9 and in parallel with the respective first plate-like sections of the respective first plate-like section units 1262-1 to 1262-9. The second plate-like section 1264 is formed from a material unattracted by the magnet (a material to which the magnet does not adhere); that is, a non-magnetic substance.

The second plate-like section 1264 is made larger than the opening section 1342*c* and provided so as to cover the opening section 1342*c* from the front.

Like the magnet section 1250, the magnet section 1270 is formed from an electromagnet, and a leading end of the magnet section is formed so as to be placed in the opening section 1342*c* and contact the back side of the second plate-like section 1264. A surface (facing the second plate-like section 1264) of the leading end of the magnet section 1270 works as an attracting surface. One magnet section 1270 is provided for the downstream grip section 1260 and formed in (or approximately) the same size and the same shape as that of the magnet section 1250. The control circuit 90 activates the magnet section 1270, whereupon the first plate-like section 1262*a* of any one of the first plate-like section units 1262-1 to 1262-9 corresponding to the position of the magnet section 1270 is attracted by the magnetic force. Spacing between the first plate-like section 1262*a* and the second plate-like section 1264 is thus closed. The magnet section 1270 is attached to a lower end of a front surface of the plate-like section 1360*e* in the supporting section 1360 in a direction perpendicular to a back side of the plate section 1341, thereby being secured in the direction of the arm 1312.

The magnet section 1250 and the magnet section 1270 are placed at the same position with reference to the horizontal direction. When the magnet section 1250 and the magnet section 1270 are activated, the magnet sections grip the same needle thread. For instance, in the example shown in FIG. 2, FIG. 3, FIG. 5, and FIG. 7, the magnet section 1250 is situated at the back side of the first plate-like section of the first plate-like section unit 1242-8, and the magnet section 1270 is situated at the back side of the first plate-like section of the first plate-like section unit 1262-8. Therefore, the magnet sections 1250 and 1270 grip the same thread.

When the respective first plate-like sections 1262*a* of the first plate-like section units 1262-1 to 1262-9 are viewed from the front, the guide members (second guide members) 1272 are provided above the respective first plate-like section units 1262-1 to 1262-9, and the guide members (second guide members) 1274 are provided below the respective first plate-like section units 1262-1 to 1262-9. As shown in FIG. 4, the guide members 1272 and 1274 are arranged in such a way that the needle thread J diagonally passes at the back side of each of the first plate-like sections. Each of the guide members 1272 is provided at an upper left point above each of the first plate-like sections when viewed from the front. Each of the guide members 1274 is provided at a lower right point below each of the first plate-like sections when viewed from the front. A longer path can be assured for the needle thread J that is at the back side of each of the first plate-like sections, so that the needle thread J can be caught between the first plate-like sections and the second plate-like section 1264 in a more reliable manner.

The turning section 1280 is placed at an intermediate position between the upstream grip section 1240 and the downstream grip section 1260 along the vertical direction. More specifically, the turning section 1280 is disposed at a downstream position in the direction in which the upstream grip section 1240 feeds a needle thread and an upstream position in the direction in which the downstream grip section 1260 feeds a needle thread. The turning section 1280 is for turning the needle thread between the grip section main body 1241 and the grip section main body 1261 (or an area (a position) of the needle thread located between the grip section main body 1241 and the grip section main body 1261).

The turning section 1280 has a turning arm 1281, a needle thread motor 1286 for turning the turning arm 1281, and an encoder 1287 connected to the needle thread motor 1286. The turning section 1280 has the turning arm 1281 and a needle thread motor 1286 for rotating the turning arm 1281. As shown in FIG. 3, FIG. 5, FIG. 6, and FIG. 7, the turning arm 1281 has a rod-shaped main body section 1282 and a hook section 1284 provided at one leading end of the main body section 1282. An output shaft 1286*a* of the needle thread motor 1286 is fastened to the other leading end of the main body section 1282. Specifically, when viewed sideways, the output shaft is arranged in such a way that the center axis of the output shaft 1286*a* of the needle thread motor 1286 passes through the center axis of the main body section 1282. The hook section 1284 assumes a (or approximately) circular-arc rod shape and is arranged so as to enable the hook section 1284 to hook the needle thread J as a result of turning of the turning arm 1281. Specifically, the hook section 1284 is structured so as to be able to contact and retain the needle thread J laid in parallel to the axis line of the output shaft 1286*a* of the needle thread motor 1286 as a result of the turning arm 1281 being upwardly turned around the output shaft 1286*a* (more specifically, an axis line (a rotating center) of the output shaft 1826*a*) of the needle thread motor 1286. The turning arm 1281 is interposed between the magnet section 1250 and the magnet section 1270 and at the same position where the magnet sections 1250 and 1270 are placed with reference to the horizontal direction; and can retain a selected needle thread.

The needle thread motor 1286 is secured to L-shaped hardware 1360*f*, thereby being secured in the direction of the arm 1312. When the needle thread motor 1286 rotates, the turning arm 1281 is turned upward from the receded position (a position 1281(B) shown in FIG. 6 and FIG. 7) that is obliquely downward on the front, to thus project to the front from the opening section 1342*b* of the plate section 1341. A direction of the output shaft 1286*a* of the needle thread motor 1286 (a direction of an axis line of the output shaft 1286*a*) lies in a horizontal direction (namely, a direction parallel with the back surface of the plate section 1341 and along the horizontal direction). The needle thread motor is configured in such a way that, when the turning arm 1281 is situated at the receded position, the turning arm 1281 will not contact the plate section 1341 or any member provided on the plate section 1341 (e.g., the needle thread supporting member 1288, the guide member 1346*b*, or the like) even if the needle bar case 1314 slides in the horizontal direction. Specifically, the receded position is a position where the turning arm 1281 will not contact the needle bar case 1314 (in particular, the plate section 1341 and any member provided on the plate section 1341) even if the needle bar case 1314 slides in the horizontal direction; at least, a position achieved as a result of the turning arm 281 having turned lower than a position where the turning arm 1281 contacts the needle thread supported by the needle thread supporting member 1288 and also a position where the leading end of the turning arm 1281 will not reach the opening section 1342*b*.

The lower end of a turning range of the turning arm 1281 is the receded position, and the upper end of the turning range is an upward position than an initial position. More specifically, during the course of correction of needle thread requirement, the turning arm 1281 can turn to an upward position than the initial position, so that an upper end of the turning range of the turning arm 1281 comes upward higher than the initial position. When the turning arm 1281 turn, a turning angle of the turning arm 1281 and a turning angle of the needle thread motor 1286 are the same.

In a torque control zone, the control circuit 90 subjects the needle thread motor 1286 to torque control on the basis of needle thread control toque data that are input by an input-output device 94 and stored in a memory device 92. In a first position control zone, the control circuit 90 prepares first angle correspondence data as shown in FIG. 23, and controls the position of the needle thread motor 1286 in accordance with the first angle correspondence data. In a second position control zone, the control circuit 90 prepares second angle correspondence data as shown in FIG. 24, and controls the position of the needle thread motor 1286 in accordance with the second angle correspondence data. The control circuit 90 performs torque control according to a flowchart shown in FIG. 20 and performs position control according to flowcharts shown in FIGS. 21 and 22.

In a zone from an end point of the first position control zone to an end point of the torque control zone, the control circuit 90 controls the magnets 1250 and 1270 so as to close the upstream grip section 1240 and open the downstream grip section 1250. In a zone from the end point of the torque control zone to the end point of the first position control zone, the control circuit 90 controls the magnets 1250 and 1270 so as to open the upstream grip section 1240 and close the downstream grip section 1260. Specifically, according to a flowchart shown in FIG. 27, the control circuit 90 controls opening and closing of the upstream grip section 1240 and the downstream grip section 1260.

The control circuit 90 compares a precorrected needle thread requirement with needle thread consumption, thereby correcting a postcorrected needle thread requirement. Specifically, the control circuit 90 corrects the postcorrected needle thread requirement according to a flowchart shown in FIG. 28. Details of the correction will be described later.

Specifically, as shown in FIG. 9, the control circuit 90 has a CPU 90*a*, a PWM (Pulse Width Modulation) circuit 90*b*, and a current sensor 90*c*. In accordance with data from the memory device 92, the CPU 90*a* outputs to the PWM circuit 90*b* data pertaining to a current value to be fed to the motor. The PWM circuit 90*b* converts an amplitude of the current value output from the CPU 90*a* into a pulse signal having a constant amplitude and feeds the pulse signal to the main spindle motor 20 and the needle thread motor 1286. The current sensor 90*c* converts a pulse signal output from the PWM circuit 90*b* into a current value, multiplies the current value by a constant to calculate a torque value, and outputs the torque value to the CPU 90*a*. The PWM circuit 90*b* and the current sensor 90*c* are provided for each of the main spindle motor 20 and the needle thread motor 1286, to be exact. Each set consisting of the PWM circuit 90*b* and the current sensor 90*c* is connected to a corresponding motor. Specifically, the PWM circuit 90*b* is connected to the CPU 90*a* and the corresponding motor, and the current sensor 90*c* is connected to the CPU 90*a* and a junction between the corresponding motor and the corresponding PWM circuit 90*b*.

An encoder 21 for detecting an angle of the main spindle motor 20 (the rotational position of the main spindle motor 20) is interposed between the main spindle motor 20 and the control circuit 90. The encoder 1287 for detecting an angle of the needle thread motor 1286 (a rotational position of the needle thread motor 1286) is interposed between the needle thread motor 1286 and the control circuit 90. The control circuit 90 detects angles of the respective motors (the rotational positions of the respective motors) from information delivered from the respective encoders.

As shown in FIG. 10, embroidery data 92*a*, needle thread control torque data 92*b*, zone position data (zone data) 92*c*, main spindle data 92*d*, needle thread quantity data 92*e*, a first correspondence table 92*f*, and a second correspondence table 92*g* are stored in the memory device 92. The memory device 92 is a storage section for storing the data.

As shown in FIG. 11, data pertaining to a stitch width (in other words, a value of a stitch width), a stitching direction (in other words, a value representing a stitching direction), and thread attributes (a thread type and a thread thickness) is stored for each stitch in the embroidery data (sewing data) 92*a*. The embroidery data 92*a* are input from the outside by way of the input-output device 94 and thereby stored in the memory device 92. The stitching direction referred to herein means data pertinent to an angle value in a predetermined direction (e.g., a single orientation along a horizontal direction). For instance, in an example shown in FIG. 40, when the predetermined direction is taken as HK, an angle value of a stitch ST0 is a value of angle $\alpha$4, and an angle value of a stitch ST1 is taken as a value of angle $\alpha$1. The value of the angle $\alpha$1 is oriented upward with respect to the direction HK and therefore a positive value, and the value of the angle $\alpha$4 is oriented downward with respect to the direction HK and therefore a negative value. Moreover, in an example shown in FIG. 41(*a*), an angle value of the stitch ST0 is taken as a value of angle β2 (a positive value), and an angle value of the stitch ST1 is taken as a value of angle β1 (a positive value). In an example shown in FIG. 41(*b*), an angle value of the stitch ST0 is taken as a value of the angle β2 (a negative value), and an angle value of the stitch ST1 is taken as an angle value of the angle β1 (a negative value).

As shown in FIG. 12, a needle thread control torque value is stored for each stitch in relation to the needle thread control torque data 92*b*.

A torque value in the needle thread control torque data determined for each stitch is generated in accordance with a stitch width, a stitching direction, and a thread type of each stitch. For instance, in the case of a large stitch width, tightening of the needle thread must be augmented; therefore, the torque value is increased (the torque value is decreased in the case of a small stitch width). Moreover, when a large angular difference exists between a current stitching direction and a preceding stitching direction, tightening of the needle thread is originally hard, and consequently the torque value is decreased (when a small angular difference exists between the current stitching direction and the preceding stitching direction, the torque value is increased). Furthermore, when a thread has a large thickness, the tightening of the needle thread must be augmented; therefore, the torque value is increased (when the thread has a small thickness, the torque value is decreased). When the needle thread is strongly tightened, the torque value is increased (when the needle thread is weakly tightened, the torque value is decreased). When embroidery is finished tightly, the torque value is increased. As will be described later, in the torque control zone, the torque value is set to a value at which no hindrance is placed to withdrawal of the needle thread J to be performed by the thread take-up lever. A torque value in the needle thread control torque data determined for each stitch can also be generated in accordance with a stitch width and a stitching direction of each stitch. In an example shown in FIG. 40, an angular difference between a certain stitching direction and a preceding stitching direction is α1 (positive)-α4 (negative).

The needle thread control torque data 92*b* are input from the outside by way of the input-output device 94 and thereby stored in the memory device 92. Specifically, there are stored the needle thread control torque data 92*b* whose specifics correspond to the embroidery data 92*a*.

As shown in FIG. 13, data on the starting point and the end point of the torque control zone is stored as information about a main spindle angle (i.e., information about the position of the main spindle motor 20 in its rotating direction) in the zone position data 92*c* (the starting point is $Z_1$, and the end point is $Z_2$). Further, data on the starting point and the end point of the first position control zone is stored as information about the main spindle angle (i.e., information about the position of the main spindle motor 20 in its rotating direction) in the zone position data 92*c* (the starting point is $Z_2$, and the end point is $Z_3$). Furthermore, data on the starting point and the end point of the second position control zone is stored as information about the main spindle angle (i.e., information about the position of the main spindle motor 20 in its rotating direction) in the zone position data 92*c* (the starting point is $Z_3$, and the end point is $Z_4$). The "starting point" may be taken also as a "starting point position," and the "end point" may be taken also as an "end point position."

As seen from motion diagrams shown in FIGS. 38 and 39, the end point of the torque control zone coincides with the starting point of the first position control zone; the end point of the first position control zone coincides with the end point of the second position control zone; and the end point of the second position control zone coincides with the starting point of the torque control zone.

The starting point of the torque control zone is at any arbitrary position in an area from the bottom dead center (one dead center) to the top dead center (the other dead center) within a turning range of the thread take-up lever (an area in which the thread take-up lever shifts from its bottom dead center to its top dead center) in association with rotation of the main spindle 22. The top dead center of the thread take-up lever (the other dead center) can be said to be an end of the turning range of the thread take-up lever in the direction where the needle thread is pulled from the process fabric.

The end point of the torque control zone is any position in a zone from the top dead center to some midpoint before the bottom dead center of the thread take-up lever and also a position before the sewing needle 12*ba* is inserted into process fabric (e.g., a position where a leading end of the sewing needle 12*ba* is higher than the needle plate 5). To minimize a tension on the needle thread in the middle of the process fabric being sewn, the torque control zone is not taken in the course of the needle being inserted into the process fabric. Therefore, the end point of the torque control zone may also be the position of the top dead center of the thread take-up lever. The top dead center of the shuttle (the top dead center of the shuttle achieved in the state of the sewing needle 12*ba* being inserted into the process fabric. Hereinafter it will be called "specific top dead center"). The top dead center at a position of around 200 degrees shown in FIG. 38, is not taken as the torque control zone to let the needle thread run smoothly through the shuttle. Therefore, the end point of the torque control zone is placed in front of the top dead center of the shuttle.

In the torque control zone, tension is imparted to the needle thread J by means of pulling the needle thread J in a direction opposite to a direction of pull-up of the thread take-up lever 12*a* while the thread take-up lever 12*a* is pulling up the needle thread J. For these reasons, at least a portion of the torque control zone is set in a period during which the thread take-up lever is in the middle of ascending action (a period during which the needle thread is pulled with respect to the process fabric). Specifically, the torque control zone can be said to be a zone including at least a portion of the area from the bottom dead center to the top dead center of the thread take-up lever. If torque control is performed even after the sewing needle 12*ba* has been inserted, tension will be exerted on the needle thread that is in the middle of sewing operation. For these reasons, the end point of the torque control zone is set to a position achieved before the sewing needle 12*ba* is inserted into the process fabric.

The starting point of the first position control zone is any position in a zone from the top dead center to the bottom dead center of the thread take-up lever (a zone of a shift from the top dead center to the bottom center of the thread take-up lever). However, neither a position before the sewing needle 12*ba* is inserted into the process fabric (e.g., a position where the leading end of the sewing needle 12*ba* is higher than the needle plate 5) nor a position after the sewing needle 12*ba* has been inserted (e.g., a position where the leading end of the sewing needle 12*ba* is lower than the needle plate 5) matters. To let the needle thread smoothly run through the shuttle, the starting point of the first position control zone is set in front of the top dead center (the specific top dead center) of the shuttle, and the top dead center of the shuttle is situated in the first position control zone.

The end point of the first position control zone is situated behind the bottom dead center of a shuttle 100. The reason for this is that the downstream grip section 1260 is opened at the end point of the first position control zone, the end point of the first position control zone is set behind the bottom dead center (the bottom dead center (the bottom dead center around 290 degrees in FIG. 38) immediately behind the specific top dead center) of the shuttle 100 because the downstream grip section 1260 must be closed before the needle thread passes through the shuttle 100 (the shuttle 100 pulls the needle thread from the upstream side when the downstream grip section 1260 is opened).

The end point of the second position control zone is at any position in a zone from the bottom dead center to the top dead center of the thread take-up lever. Further, since the torque control zone immediately follows the end point, it is desirable to set the end point of the position control zone to a location where the sewing needle 12*ba* comes out of the process fabric (e.g., a location where the leading end of the sewing needle 12*ba* is higher than the needle plate 5).

In the first position control zone, the needle thread J is pulled out of a thread roll (the thread roll is placed upstream higher than the needle thread guide 1300). However, the needle thread is pulled as slowly as possible over time to minimize the risk of a break occurring in the needle thread by slowly drawing. For this reason, it is preferable to assure the longest possible length for the first position control zone. For instance, the starting point of the first position control zone is set to any position between the top dead center to the bottom dead center of the thread take-up lever and also in front of the top dead center of the shuttle. Further, the end point of the first position control zone is set to any position in a zone from the bottom dead center to the top dead center of the thread take-up lever. Thus, a long length can be assured for the first position control zone. Further, the zone from the bottom dead center to the top dead center of the thread take-up lever corresponds to a zone in which the thread take-up lever pulls the needle thread against the process fabric. Hence, the zone is preferably taken as the torque control zone. As a result, it can be desirably said that the starting point of the toque control zone is set in an area from the point where the sewing needle 12*ba* is released from the action of being inserted to the top dead center of the thread take-up lever (or immediately behind the top dead center) within the zone from the bottom dead center to the top dead center of the thread take-up lever.

With regard to the zone position data 92*c*, data on the starting and end points of a thread pull-out zone is stored as information about the angle of main spindle angle (the starting point $Z_4$ and the end point $Z_3$). Further, data on the starting and end points of an initial position movement zone is stored as information about the angle of the main spindle (the starting point $Z_3$ and the end point $Z_5$).

The starting point of the thread pull-out zone is a position where the turning arm 1281 starts turning action and pulling the needle thread in the first position control zone. The end point of the thread pull-out zone is a position where the turning arm 1281 stops turning action and pulling the needle thread in the first position control zone. The end point of the thread pull-out zone coincides with the end point of the first position control zone.

The starting point of the initial position movement zone is a position where the turning arm 1281 starts turning action in the second position control zone. The needle thread motor 1286 returns to the initial position at the end point of the initial position movement zone. The starting point of the initial position movement zone coincides with the starting point of the second position control zone.

The zone position data 92*c* is previously stored in the memory device 92 by way of the input-output device 94. However, the zone position data 92*c* may also be replaced, as appropriate, with specifics of the zone position data 92*c* stored in the memory device 92 by way of the input-output device 94. As mentioned above, the data on the starting and end points of the torque control zone and the data on the starting and end points of the position control zone are specified as the information about the angle of the main spindle; hence, the term "zone" is used. However, the main spindle motor 20 and the main spindle 22 rotate in only one direction, and the control zone becomes later in time sequence as the angle of the main spindle becomes greater in the control zone for one stitch. Hence, a "period" may also be used in place of the "zone." For instance, a "torque control period" may also be used instead of the "torque control zone." A "first position control period" may also be used instead of the "first position control zone," and a "second position control period" may also be used instead of the "second position control zone." Further, a "control period" may also be used in place of the "control zone."

As shown in FIG. 14, the main spindle data 92*d* is data on the angle of the main spindle (i.e., the position of the main spindle motor 20 in its rotating direction) on a per-angular-unit-time basis in time sequence.

As shown in FIG. 16, the precorrected needle thread requirement, the postcorrected needle thread requirement, the needle thread consumption, and a difference between the needle thread requirement and the needle thread consumption are stored on a per-stitch basis as the needle thread quantity data 92*e*.

The precorrected needle thread requirement is a data on the length of a needle thread originally required for each stitch. The precorrected needle thread requirement is a value calculated from a stitch width and the thickness of the process fabric. Given that the stitch width is L and the thickness of the process fabric is T and that a ratio between the length of the needle thread and the length of the bobbin thread on the back (that may also be a lower side) of the process fabric is taken as 2:1 as shown in FIG. 33(*a*), the needle thread requirement for the stitch is $L+2\times T+L\times 2/3$ (taken as Expression (1)). Hence, the needle thread requirement is calculated according to the expression. Specifically, the length of the needle thread on the front of the process fabric is L, and the length of the needle thread on the back of the process fabric is $L\times 2/3$. The length of the needle thread commensurate with the thickness of the process fabric is $2\times T$. Hence, the needle thread requirement is calculated according to the expression. In the case of the needle thread requirement being calculated according to Expression (1), the needle thread requirement is calculated by inputting the stitch width L and the thickness T of the process fabric into Expression (1). The back of the process fabric is the side of the process fabric where the bobbin thread appears during embroidery sewing. The front of the process fabric is the side of the process fabric where only the needle thread appears during embroider sewing.

Given that a ratio between the length of the needle thread and the length of the bobbin thread on the back of the process fabric is A:B, the expression (taken as (Expression 2)) is $L+2\times T+L\times A/(A+B)$. In the case of Expression (2), the length of the needle thread on the back of the process fabric is $L\times A/(A+B)$.

As mentioned above, the length of the needle thread on the back of the process fabric is calculated from the ratio between the length of the needle thread and the length of the bobbin thread on the back of the process fabric, whereby the precorrected needle thread requirement is calculated. The needle thread requirement (i.e., the precorrected needle thread requirement) for each stitch in the field of the precorrected needle thread requirement is precorrected needle thread requirement data.

As mentioned above, the precorrected needle thread requirement is calculated according to the ratio between the length of the needle thread and the length of the bobbin thread on the back of the process fabric. Hence, control (which will be described in detail later) is performed so as to make the needle thread consumption close to the precorrected needle thread requirement, thereby making it possible to achieve a desired balance between the length of the needle thread and the length of the bobbin thread on the back of the process fabric and a desired balance between the needle thread consumption and bobbin thread consumption.

The postcorrected needle thread requirement is, at the outset, data equal to the precorrected needle thread requirement. However, when the needle thread requirement to be described later is corrected, the quantity is updated to the postcorrected needle thread requirement. In other words, the postcorrected needle thread requirement is sequentially updated as the needle thread requirement is sequentially corrected. Details will be described later. The needle thread requirement (i.e., postcorrected needle thread requirement) for each stitch in the field of postcorrected needle thread requirement is postcorrected needle thread requirement data.

The needle thread consumption is the length of the needle thread used in the torque control zone (i.e., the length of the needle thread used for sewing). To be more specific, in the torque control zone of each stitch, the turning angle (may also be called a "rotation angle") of the turning arm 1281 is detected, and the length of the needle thread commensurate with the detected turning angle is taken as needle thread consumption. To acquire the needle thread consumption from the turning angle, the first correspondence table 92*f* shown in FIG. 17 is used. The turning angle of the turning arm 1281 in the torque control zone is equal to the rotation angle of the needle thread motor 1286. The angle $\alpha$ in FIG. 39 corresponds to the rotation angle. Data on the needle thread consumption for each stitch is data on needle thread consumption.

The turning angle of the turning arm 1281 is a turning angle achieved when the turning arm 1281 turns from a certain position to another position. For instance, the turning angle is an angle through which the body 1282 of the turning arm 1281 turns. When the turning arm 1281 turns from 1281(B) to 1281(A) in FIG. 6, the turning angle is an angle through which the body 1282 turns from 1281(B) to 1281(A).

A difference between the needle thread requirement and the needle thread consumption is determined by subtracting a length for the needle thread consumption from a length for the needle thread requirement. In actual embroidery sewing, data on a difference between the needle thread requirement and the needle thread consumption is stored for each stitch at timing detected by the needle thread consumption.

A unit correction value to be applied to needle thread quantity data is stored in the needle thread quantity data. When a correction is made to the needle thread requirement to be described later, the unit correction value is incremented or decremented with respect to the needle thread requirement. Specifically, one unit correction value is provided into correspondence with one embroidery data. The unit correction value can be input by the input-output device 94 or an operation section 96. In this case, the input-output device 94 or the operation section 96 corresponds to an input section for inputting a unit correction value.

The needle thread quantity data in FIG. 16 is updated as embroidery sewing is actually performed. Specifically, as will be described, the postcorrected needle thread requirement data is updated by a comparison between the precorrected needle thread requirement and the needle thread consumption.

As shown in FIG. 17, the first correspondence table 92*f* is a table showing a relationship between the rotation angle of the needle thread motor 1286 and the needle thread consumption in the torque control zone. The needle thread consumption is specified according to the angle through which the needle thread motor 1286 turns from the home position (i.e., the angle through which the turning arm 1281 turns). The first correspondence table 92*f* is used at the time of detection of the needle thread consumption. The needle thread consumption may also be calculated by use of a predetermined calculation expression; that is, an expression for calculating needle thread consumption from the rotation angle of the needle thread motor 1286, in place of the first correspondence table 92*f*.

As shown in FIG. 18, the second correspondence table 92*g* is a table showing a relationship between the postcorrected needle thread requirement and the rotation angle of the needle thread motor 1286. The relationship between the postcorrected needle thread requirement and the rotation angle is specified for each angle of the needle thread motor 1286 achieved when the needle thread motor 1286 starts rotating (i.e., a angle of the needle thread motor 1286 at the starting point in the thread pull-out zone). Namely, individual tables 92*g*-1 to 92*g*-1 showing a relationship between the postcorrected needle thread requirement and the rotation angle are specified for each angle of the needle thread motor (e.g., each one degree). The relationship between the postcorrected needle thread requirement and the rotation angle varies according to the angle of the needle thread motor 1286 at the starting point of the thread pull-out zone. Hence, an individual table is provided according to an angle at the starting point of the thread pull-out zone of the needle thread motor 1286. The second correspondence table 92*g* is used when the needle thread is pulled out in the first position control zone and when the rotation angle of the needle thread motor 1286 is detected from the postcorrected needle thread requirement. The rotation angle can also be calculated according to a predetermined expression, in place of the second correspondence table 92*g*; namely, an expression for calculating the rotation angle of the needle thread motor 1286 from the angle of the needle thread motor 1286 at the starting point of the thread pull-out zone (which may also be taken as an angle of the needle thread motor 1286 at the starting point of the first position control zone) and the postcorrected needle thread requirement. The angle of the needle thread motor 1286 at the starting point of the first position control zone is maintained up to the starting point of the thread pull-out zone. Hence, the angle of the needle thread motor 1286 at the starting point of the first position control zone is identical with the angle of the needle thread motor 1286 at the starting point of the thread pull-out zone.

As to the precorrected needle thread requirement data, precorrected needle thread requirement data generated outside can also be stored in the needle thread quantity data via the input-output device 94. Alternatively, the precorrected needle thread requirement data may also be stored in the needle thread quantity data by calculating the precorrected needle thread requirement with the control circuit 90. In other words, data on the stitch width is stored in the embroidery data 92*a* input from outside. Hence, the precorrected needle thread requirement may also be calculated by inputting, via the input-output device 94, the data on the thickness of the process fabric and the data on the ratio between the length of the needle thread and the length of the bobbin thread on the back of the process fabric.

An explanation is now given to the path of the needle threads J. Nine needle threads run along similar paths. Therefore, the needle thread situated at the right end when viewed from the front is taken as an example. The needle thread J guided from a thread roll (not shown) contacts the guide member 1252 by way of the needle thread guide 1300; passes through spacing between the first plate-like section 1242*a* of the first plate-like section unit 1242-9 and the second plate-like section 1244 of the upstream grip section 1240, then contacts the guide member 1254, undergoes inversion on the guide member 1290, and subsequently reaches the needle thread supporting member 1288. The needle thread J passed through the pair of needle thread supporting members 1288 contacts the guide member 1272, passes through spacing between the first plate-like section 1262*a* of the first plate-like section unit 1262-9 and the second plate-like section 1264 of the downstream grip section 1260, then contacts the guide member 1274. In addition, the needle thread J reaches the thread take-up lever 12*a*-9 by way of the needle thread guide 1302 and the tension spring 1337 and further reaches a sewing needle of the needle bar 12*b*-9 from the thread take-up lever 12*a*-9 by way of the needle thread guide 1338. The needle thread travels from the upstream side to the downstream side along the sequence mentioned above.

The input-output device 94 is a device that is connected to a CPU 90*a* of the control circuit 90 mainly for exchanging data from the memory device 92, and has a connection terminal for connecting with an external terminal and another connection terminal for connecting to a memory device. The input-output device 94 has a function of an input device and a function of an output device. By way of the input-output device 94, the memory device 92 acquires the embroidery data 92*a*, the needle thread control torque data 92*b*, the needle thread quantity data 92*e* (in particular, the precorrected needle thread requirement), the first correspondence table 92*f*, and the second correspondence table 92*b*.

In this respect, a storage medium that stores the data can also be used while connected to the input-output device 94 in lieu of the memory device 92 rather than the memory device 92 storing the embroidery data 92*a* and the needle thread control torque data. In short, the data are read directly from the storage medium.

The operation section 96 is an operation device for operation of the sewing machine 1 and made up of operation keys, a display screen, and others.

The shuttle 100 is disposed, for each head, at each of positions below the respective heads 3 and below the upper surface of the sewing machine table. Specifically, the shuttles 100 are supported by respective shuttle bases (not shown) positioned below the sewing machine table.

The shuttle 100 is analogous to the existing shuttle 2100 in terms of a configuration. As shown in FIG. 42, the shuttle 100 has an outer shuttle 2110, a middle shuttle presser 2130, and a middle shuttle 2150. The middle shuttle 2150 houses a bobbin 2200 and a bobbin case 2210.

The outer shuttle 2110 has an outer middle shuttle 2112 shaped so as to connect a substantially-ring-shaped open top portion 2122-1 to a cylindrical portion 2122-2, and a mount section 2116 jutting from both sides of the outer middle shuttle 2112.

A substantially columnar cutout 2114 is formed in the substantially ring-shaped portion 2112-1 of the outer middle shuttle 2112. The cutout 2114 is circumferentially stepped and made up of a large diameter portion (a guide groove) 2114*a* on one side facing the middle shuttle presser 2130 and a small diameter portion 2114*b* on the other side. A race section 2152 of the middle shuttle 2150 is placed in and slides along the large diameter portion 2114*a*.

Levers 122 used for fastening the middle shuttle presser 2130 to the outer shuttle 2110 are attached to both sides of the outer shuttle 2110. Further, the mounts 2116 used for attaching the outer shuttle 2110 to the shuttle base are also projectingly formed on both sides of the outer shuttle 2110.

The middle shuttle presser 2130 is an substantially-ring-shaped top open plate-like member, and a cutout 1232 is provided in the middle shuttle presser 2130. The middle shuttle presser 2130 covers a part of the middle shuttle 2150 in the outer shuttle 2110, which faces the middle shuttle presser 2130, thereby preventing the middle shuttle 2150 from coming off toward the middle shuttle presser 2130.

The middle shuttle 2150 is placed rotatably in the outer shuttle 2110 having the middle shuttle presser 2130 attached. The middle shuttle 2150 has a race section 2152, a main middle shuttle 2160, a leading end 2170, and an accommodation section 2180.

The race 2152 assumes a shape of a substantially circular-arc plate; namely, a shape defined by forming a circular-arc shape from a rod-shaped plate-like member. An exterior surface of the race 2152 is formed so as to be slidable along the large diameter portion 2114*a* of the outer shuttle 2110. The entirety of the main middle shuttle 2160 is formed from a plate-like member. The main middle shuttle has a rear portion 2161 and a front-side tapered portion 2166. The rear portion 2161 is provided so as to be continual rearwardly from an inner rear-side end of the race 2152. The front-side tapered portion 2166 is provided so as to be continual forwardly from an inner front-side end of the race 2152.

The leading end 2170 is made in a circumferential direction from an end of the race section 2152, and a pointed top 2172 is formed at an extremity of the leading end 2170. The accommodation section 2180 has a tubular section 2182 forming a part of a tubular shape and a shaft 2184. The tubular section 2182 and the shaft 2184 are fixed to the front surface of a rear section 2161.

The bobbin 2200 has a plate-like section 2202 having a circularly-opened center; a plate-like section 2204 that is the same size and shape as that of the plate-like section 2202; and a cylindrical tubular section 2206 interposed between the opening of the plate-like section 2202 and the opening of the plate-like section 2204. A bobbin thread can be wound in a space between the plate-like section 2202 and the plate-like section 2204.

As shown in FIG. 43, the bobbin case 2210 has a case body 2212 and a tension spring 2220 attached to the case body 2212, and the tension spring 2220 is attached to the case body 2212 with a bobbin case cap screw 2222. An adjustment screw 2224 is attached to the tension spring 2220. A lever 2216 is provided on the bobbin case 2210 for preventing the bobbin 2200 from falling off.

A bobbin thread K of the bobbin 2200 housed in the bobbin case 2210 is led outside the bobbin case 2210 through a thread guide slot 2214 opened in the case body 2212. The degree of fastening of the adjustment screw 2224 is adjusted, whereby a tension on the bobbin thread K is adjusted. Specifically, the tension on the bobbin thread is adjusted by the frictional resistance originating from the tension spring 2220.

The shaft 2184 is inserted into the tubular section 2206 of the bobbin 2200 while the bobbin case 2210 housed in the bobbin 2200 is attached to the middle shuttle 2150.

A leading end of a shuttle shaft is placed in the outer middle shuttle 2112, and the middle shuttle 2150 is joined to the leading end of the shuttle shaft. The middle shuttle 2150 rotates as the shuttle shaft rotates.

Operation of the sewing machine 1 will now be described by reference to FIG. 14 through FIG. 41.

The control circuit 90 prepares the main spindle data (see FIG. 14) on a per-stitch basis according to the embroidery data stored in the memory device 92. Information about an embroidery to be created, such as a stitch width, a stitching direction, and thread attributes (a thread type and the thickness of a thread), is stored on a per-stitch basis in the memory device 92. Hence, the main spindle data is created in accordance with a stitch width, a stitching direction, and thread attributes of each stitch. As shown in FIG. 14, the main spindle data is data on the angle of the main spindle (i.e., the position of the main spindle data 20 in its rotating direction) acquired on a per-unit-time basis in time sequence. For instance, when the stitch width is large, an amount of change in the angle of the main spindle is made smaller. On the contrary, when the stitch width is small, the amount of change in the angle of the main spindle is made larger. When the stitching direction becomes opposite to that of the previous stitch, the amount of change of the angle of the main spindle is made smaller. Specifically, when the angle (the angle $\alpha$3 in FIG. 40) which the stitching direction forms with the previous stitching direction is small, the amount of change in the angle of the main spindle is made smaller. On the contrary, when an angle which the stitching direction forms with the previous stitching direction is large, the amount of change in the angle of the main spindle is made larger. With regard to the needle attributes, when the thread is fine or when the thread is fragile, the amount of change in the angle of the main spindle is made smaller.

When the control circuit 90 generates the main spindle data, an entirety of embroidery data made up of a plurality of stitches can have been generated in advance. Alternatively, there can also be generated main spindle data pertaining to a stitch located several stitches ahead of a stitch by means of which the respective machine elements (the needle bar, the thread take-up lever, the shuttle, and the like) actually perform embroidering. Thereby, actual embroidering can also be performed while the main spindle data are being generated.

FIG. 15 shows example main spindle data. The main spindle data shown in FIG. 15 pertain to a case where the main spindle keeps rotating with constant velocity. When the respective stitches have a constant stitch width and when angles of the stitches are also oriented in the same direction, such main spindle data can be adopted. Incidentally, when a certain stitch has a large width, a time consumed to make one stitch is made longer. By contrast, when a certain stitch has a smaller stitch width, a time for one stitch is made shorter. The main spindle may rotate with constant velocity regardless of a stitch width, a stitching direction, and thread attribute as shown in FIG. 15.

Operation to be performed during actual embroidering is described. As shown in FIG. 19, a main spindle angle is first detected (S1). Specifically, a main spindle angle is detected from information about the encoder 21 connected to the main spindle motor 20. The main spindle angle is detected at a predetermined cycle (in other words, processing shown in FIG. 19 is carried out at predetermined cycles); for instance, a cycle that is one-tenths to one-thousandths of a cycle for one stitch.

Since the needle bar is provided in numbers, a needle bar is selected from among the plurality of needle bars (in short, a thread is selected), to be exact, a main spindle angle is detected (S1), and a determination is then made as to whether or not a change is made to a needle thread. When a change is made to the needle thread, the needle bar case 1314 is slid, to thus place the magnet sections 1250 and 1270 at a position of the selected thread. In addition, the turning arm 1281 of the turning section 1280 is moved to a position of the opening section 1342*b* corresponding to the needle thread so as to be able to retain and pull up the selected thread. When a change is made to the needle thread, the turning arm 1281 is receded to the receded position.

Specifically, a process of determining whether or not a change is made to the needle thread is set between step S1 and step S2. In the process of determining whether or not a change is made to a needle thread, a determination is made as to whether or not a detected main spindle angle is one that corresponds to a head of one stitch (for instance, a zero degree in FIG. 38; in other words, timing when a shift is made to the next stitch). When the main spindle angle corresponds to the head of one stitch, a process of determining from the embroidery data whether or not a change is made to the needle thread is set between step S1 and step S2. When a change is made to the needle thread, there is set a process of controlling sliding action of the needle bar case 1314. After sliding action of the needle bar case 1314, processing proceeds to step S2. When the detected angle of the main spindle is not the main spindle angle corresponding to the head of one stitch or when no change is made to the needle thread despite the detected main spindle angle corresponding to the head of one stitch, processing proceeds to step S2 without modifications.

According to the detected angle of the main spindle, it is determined that the main spindle motor is situated in which one of zone as to the needle thread, namely, the torque control zone, the first position control zone and the second position control zone. Specifically, as shown in FIG. 13, the memory device 92 includes the information about the starting and end points of the torque control zone, the starting and end points of the first position control zone, and the starting and end points of the second position control zone. Hence, a determination is made by comparing the detected main spindle angle with the information.

Specifically, a determination is made as to whether or not the main spindle angle is in the needle thread torque control zone (S2). When the main spindle angle is in the torque control zone, processing proceeds to a torque control subroutine (S3).

When the main spindle angle is not in the torque control zone, a determination is made as to whether or not the main spindle angle is in the first position control zone (S4). When the main spindle angle is in the first position control zone, processing moves to the first position control subroutine (S5). Further, when the main spindle angle is not in the first position control zone, processing moves to the second position control subroutine (S6). In short, when the main spindle angle is in neither the torque control segments nor the first position control zone, the main spindle angle is in the second position control, and hence processing moves to the second position control zone.

Next, in the torque control subroutine, torque data (a torque value) pertaining to a target stitch are read from the needle thread control torque data value (torque data) at the starting point of the torque control zone. In the torque control zone for the stitch, torque is controlled in accordance with the thus-read needle thread control torque value. Specifically, as shown in FIG. 20, it is determined whether or not the torque data pertaining to the target stitch are stored in the control circuit 90 (S11). When the torque data are not yet retained at the starting point of the torque control zone, the torque data pertaining to the target stitch are read from the needle thread control torque data and retained in the control circuit 90 (S12).

When the needle thread control torque value pertaining to the target stitch are retained, a torque value is read from the current sensor 90*c*, and the torque value thus detected by the current sensor 90*c* is subtracted from a value of the torque data pertaining to the target stitch (S13 shown in FIG. 20, and S13 shown in FIG. 26).

Next, the value calculated in step S13 is multiplied by a predetermined constant, thereby calculating a voltage value (a voltage command to the PWM circuit) to be output to the PWM circuit 90*b* (S14 shown in FIG. 20, and S14 shown in FIG. 26). The thus-calculated voltage value is output to the PWM circuit 90*b* (S15 shown in FIG. 20, and S15 shown in FIG. 26). In accordance with the thus-input signal, the PWM circuit 90*b* outputs a pulse signal as a voltage signal, thereby supplying an electric current to the needle thread motor 1286 (S16 shown in FIG. 20, S16 shown in FIG. 26: a current supply step).

In the above descriptions, the needle thread control torque data are read at the starting point of the torque control zone. However, the needle thread control torque data may also be read from an area from the end point of the initial position movement zone to the starting point of the torque control zone.

Control executed by the subroutine of the first position control includes detecting, at the starting point of the first position control zone, the angle of the needle thread motor 1286; that is, the current position of the needle thread motor 1286 in its rotating direction (i.e., the position of an output shaft of the needle thread motor 1286); preparing the first angle correspondence data for performing position control such that the output shaft of the needle thread motor 1286 rotates through the angle commensurate with the postcorrected needle thread requirement; performing position control according to the first angle correspondence data. First, as to a target stitch, a determination is made as to whether or not the first angle correspondence data is prepared (S21 in FIG. 21).

When the first angle correspondence data are not generated yet; namely, at the starting point of the position control zone, the angle of the needle thread motor 1286 is detected by means of the encoder 1287 (S22 shown in FIG. 21, and S22 shown in FIG. 26). In accordance with the thus-detected angle of the needle thread motor 1286, the angle correspondence data are generated (S23 shown in FIG. 21, and S23 shown in FIG. 26). As shown in FIG. 23, the first angle correspondence data are data pertaining to a correspondence between the main spindle angle (i.e., the rotational position of the main spindle motor 20) and a needle thread motor angle (an angle of the needle thread motor) (the rotational position of the needle thread motor 1286). More specifically, the first angle correspondence data are data pertaining to a correspondence between the main spindle angle and the needle thread motor angle from when the needle thread motor angle changes from $C_n$ achieved at the starting point of the first position control zone (the main spindle angle achieved at the starting point of the first position control zone is taken as $a_0$) to $C_0$ achieved at the end point of the first position control zone (the main spindle angle achieved at the end point of the first position control zone is taken as $a_y$). The angle from an angle $C_n$ of the needle thread motor at the starting point of the first position control zone to an angle $C_0$ of the needle thread motor at the end point of the first position control zone is an angle corresponding to needle thread requirement in a stitch of the immediately-arriving torque control zone (a stitch next to the target stitch in an example in FIG. 39) in the needle thread quantity data 92*e* and the angle of the needle thread motor at the starting point of the first position control zone of the target stitch (see FIG. 16 and FIG. 18).

As to the angle from an angle $a_0$ of the main spindle corresponding to the starting point of the first position control zone to an angle $a_x$ of the main spindle at the starting point of the thread pull-out zone, the angle $C_n$ of the needle thread motor at the end point in the torque control zone is left unchanged (in other words, the angle $C_n$ of the needle thread motor is maintained) at the time of preparation of the first angle correspondence data. Subsequently, an extent from the angle $a_x$ of the main spindle corresponding to the starting point of the thread pull-out zone to an angle $a_y$ of the main spindle corresponding to the end point of the first position control zone is equally divided at a predetermined spacing (a unit angle) (in other words, equally divided every 1/n ("n" is an integer)). As shown in FIG. 25, in a first zone that is a predetermined zone followed by the starting point of the thread pull-out zone (e.g., angles $a_x$ to $a_{x+m}$ of the main spindle), the amount of change in the angle of the needle thread motor per unit angle increases gradually, whereby the turning speed of the turning arm 1281 increases. In a second zone (e.g., angles $a_{x+m}$ to $a_{y-m}$ of the main spindle) followed by the first zone, the amount of change in the angle of the needle thread motor per unit angle becomes constant. In a third zone (e.g., angles $a_{y-m}$ to $a_y$ of the main spindle) followed by the second zone, the amount of change in the angle of the needle thread motor per unit angle decreases gradually, whereby the turning speed of the turning arm 1281 decreases. The angle range of the first zone and the angle range of the third zone is shorter than the angle range of the second zone.

Data pertaining to the needle thread motor angle are read from the first angle correspondence data (S24 shown in FIG. 21 and S24 shown in FIG. 26). Specifically, a main spindle angle closest to the main spindle angle detected in step S1 is detected from the first angle correspondence data (FIG. 23), and the needle thread motor angle corresponding to the main spindle angle is read. When data pertaining to two main spindle angles adjoining to the main spindle angle detected in step S1 are found in the first angle correspondence data, the needle thread motor angle can also be calculated according to a ratio of the detected main spindle angle to the two adjoining main spindle angles.

Speed data are now calculated by detecting an amount of change per unit time from the thus-read needle thread motor angle (S25 shown in FIG. 21, S25 shown in FIG. 26: a speed data calculation step). Speed data are calculated by dividing the amount of change in angle data by a time. Specifically, a relationship between the main spindle angle and the needle thread motor angle is specified by the first angle correspondence data shown in FIG. 23. Further, a relationship between a time and a main spindle angle is specified by the main spindle data shown in FIG. 14. The amount of change in needle thread motor angle per unit time is thereby detected. When no match exists between main spindle angle data of the main spindle data and the main spindle angle data of the angle correspondence data, all you need to do; for instance, is to calculate a time from a ratio of the main spindle angle data of the main spindle data to a difference between two main spindle angles adjoining the main spindle angle of the angle correspondence data (the main spindle angle of the main spindle data).

Torque data are now calculated by detecting an amount of change in speed data per unit time (S26 shown in FIG. 21, S26 shown in FIG. 26: a torque data calculation step). Specifically, torque data are calculated by dividing the amount of change in speed data by a time. In step S25, the speed data pertaining to the needle thread motor are calculated on a per-time basis; hence, torque data are calculated by differentiating the speed data.

Next, torque compensation data are calculated from the torque data calculated in step S26 (S27 shown in FIG. 21, and S27 shown in FIG. 26). Specifically, the torque data are multiplied by an inertia ratio (S27-1 shown in FIG. 26), torque derived from a mechanical loss is added to a value determined by multiplying the torque data by the inertia ratio, thereby calculating torque compensation data (S27-2 shown in FIG. 26). The inertia ratio is a constant previously determined according to a mass of each of the machine elements, or the like. Further, the torque derived from a mechanical loss is a value previously determined in correspondence with each of the machine elements.

Data (a count value of the encoder) output from the encoder 1287 (the encoder corresponding to the needle thread motor 1286) are subtracted from the angle data read in step S24 (S28 shown in FIG. 22, S28 shown in FIG. 26: a location deviation calculation step). A value calculated in step S28 can be said to be a value of a location deviation.

The value calculated in step S28 is now multiplied by a predetermined constant, thereby calculating a speed value (S29 shown in FIG. 22 and S29 shown in FIG. 26).

A current motor speed value is calculated by differentiating the output from the encoder 87 (S30 shown in FIG. 22 and S30 shown in FIG. 26). Specifically, an amount of change in encoder count value per unit time is calculated, thereby calculating a current motor speed value.

Next, the current motor speed value calculated in step S31 is subtracted from the speed value calculated in step S30, and the speed data calculated in step S25 are added to a subtraction result (S31 shown in FIG. 22, S31 shown in FIG. 26: a speed deviation calculation step). A value calculated in step S31 can be said to be a value of speed deviation.

The value calculated in step S31 is multiplied by a predetermined constant, thereby calculating a torque value (S32 shown in FIG. 22 and S32 shown in FIG. 26).

Torque compensation data calculated in step S27 are added to the torque value calculated in step S32 (S33 shown in FIG. 22, and S33 shown in FIG. 26). Subsequently, the torque value output from the current sensor 90*c* is subtracted from the value calculated in step S33 (S34 shown in FIG. 22, S34 shown in FIG. 26: a torque deviation calculation step). The value calculated in step S34 can be said to be a torque deviation value.

The value calculated in step S34 is multiplied by a predetermined constant, thereby calculating a voltage value (a voltage command to the PWM circuit) output to the PWM circuit 90*b* (S35 shown in FIG. 22, S35 shown in FIG. 26). The voltage value is then output to the PWM circuit 90*b* (S36 shown in FIG. 22, and S36 shown in FIG. 26).

The PWM circuit 90*b* outputs a pulse signal as a voltage signal in accordance with an input signal, thereby supplying an electric current to the needle thread motor 1286 (S37 shown in FIG. 22, S37 shown in FIG. 26: a current supply step).

As set forth above, the angle of the needle thread motor 1286 is detected at the starting point of the first position control zone to create the first angle correspondence data. However, the angle of the needle thread motor 1286 stays the same from the end point of the torque control zone to the starting point of the thread pull-out zone. Therefore, the first angle correspondence data may also be created between the end point of the torque control zone and the starting point of the thread pull-out zone. In this case, the first angle correspondence data correspond to the data from the starting point to end point of the thread pull-out zone.

Control executed by the subroutine of the second position control includes detecting, at the starting point of the second position control zone, a current position at the angle of the needle thread motor 1286; preparing the second angle correspondence data for performing position control up to the initial position (which may also be called an "origin position") at an angle of the needle thread motor 1286 (i.e., the angle of the needle thread motor 1286 which is the position of the needle thread motor 1286 in its rotating direction); and performing position control according to the second angle correspondence data. Specifically, as to a target stitch, a determination is made as to whether or not the second angle correspondence is prepared (S2121 in FIG. 21).

When the second angle correspondence data is not prepared; that is, at the starting point of the second position control zone, an angle of the needle thread motor 1286 is detected by means of encoder 1287 (S22 in FIG. 21 and S22 in FIG. 26). The second angle correspondence data is prepared from the angle of the detected needle thread motor 1286 (S23 in FIG. 21 and S23 in FIG. 26). As shown in FIG. 24, the second correspondence data is correspondence data on the angle of the main spindle (i.e., the position of the main spindle motor 20 in its rotating direction) and the angle of the needle thread motor (the angle of the needle thread motor) (the position of the needle thread motor 1286 in its rotating direction). In relation to the second angle correspondence data, the angle of the needle thread motor at the starting point of the second position control zone (the angle of the main spindle at the starting point of the second position control zone is taken as $a_y$) is $C_0$ ($=d_w$). The angle of the needle thread motor at the end point of the initial position movement zone (the angle of the main spindle at the end point of the initial position movement zone is taken as $a_{y+0}$) is $d_0$. Further, the angle $d_0$ of the needle thread motor is held up to the end point $a_{y+r}$ of the second position control zone. The angle $d_0$ is the initial position of the angle of the needle thread motor.

As is the case with the first angle correspondence data, at the time of preparation of the second angle correspondence data, an extent from the angle $a_y$ of the main spindle corresponding to the starting point of the second position control zone to an angle $a_{y+r}$ of the main spindle corresponding to the end point of the second position control zone is equally divided at a predetermined spacing (a unit angle) (in other words, equally divided every 1/n ("n" is an integer)). As shown in FIG. 25, in the first zone (e.g., angles $a_y$ to $a_{y+p}$ of the main spindle) that is a predetermined zone followed by the starting point of the second position control zone (the starting point of the initial position movement zone), the amount of change in the angle of the needle thread motor per unit angle increases gradually, whereby the turning speed of the turning arm 1281 increases. In the second zone (e.g., angles $a_{y+p}$ to $a_{y+q}$ of the main spindle) that is a zone from the end point of the first zone to the end point of the initial position movement zone), the amount of change in the angle of the needle thread motor per unit angle degrees gradually, whereby the turning speed of the turning arm 1281 decreases. From the end point ($a_{y+q}$) of the initial position movement zone to the end point ($a_{y+r}$) of the second position control zone, the angle $d_0$ at the initial position is maintained. As in the case with the first position control zone, a zone where the amount of change in the angle of the needle thread motor becomes constant may also be provided at an area between the first zone and the second zone.

Data pertaining to the needle thread motor angle are read from the second angle correspondence data (S24 shown in FIG. 21 and S24 shown in FIG. 26). Specifically, a main spindle angle closest to the main spindle angle detected in step S1 is detected from the second angle correspondence data (FIG. 24), and the needle thread motor angle corresponding to the main spindle angle is read. When data pertaining to two main spindle angles adjoining to the main spindle angle detected in step S1 are found in the second angle correspondence data, the needle thread motor angle can also be calculated according to a ratio of the detected main spindle angle to the two adjoining main spindle angles.

Subsequent processing is the same as that performed in the case of the controlling performed in the first position control zone. Specifically, the speed data is calculated by detecting the amount of change per unit time from the read angle of the needle thread motor (S25 in FIG. 21 and S25 in FIG. 26: a speed data calculation process).

Torque data are now calculated by detecting an amount of change in speed data per unit time (S26 shown in FIG. 21, S26 shown in FIG. 26: a torque data calculation step).

Next, torque compensation data are calculated from the torque data calculated in step S26 (S27 shown in FIG. 21, and S27 shown in FIG. 26).

Data (a count value of the encoder) output from the encoder 1287 (the encoder corresponding to the needle thread motor 1286) are subtracted from the angle data read in step S24 (S28 shown in FIG. 22, S28 shown in FIG. 26: a location deviation calculation step).

The value calculated in step S28 is now multiplied by a predetermined constant, thereby calculating a speed value (S29 shown in FIG. 22 and S29 shown in FIG. 26).

A current motor speed value is calculated by differentiating the output from the encoder 87 (S30 shown in FIG. 22 and S30 shown in FIG. 26).

Next, the current motor speed value calculated in step S31 is subtracted from the speed value calculated in step S30, and the speed data calculated in step S25 are added to a subtraction result (S31 shown in FIG. 22, S31 shown in FIG. 26: a speed deviation calculation step).

The value calculated in step S31 is multiplied by a predetermined constant, thereby calculating a torque value (S32 shown in FIG. 22 and S32 shown in FIG. 26).

Torque compensation data calculated in step S27 are added to the torque value calculated in step S32 (S33 shown in FIG. 22, and S33 shown in FIG. 26). Subsequently, the torque value output from the current sensor 90*c* is subtracted from the value calculated in step S33 (S34 shown in FIG. 22, S34 shown in FIG. 26: a torque deviation calculation step).

The value calculated in step S34 is multiplied by a predetermined constant, thereby calculating a voltage value (a voltage command to the PWM circuit) output to the PWM circuit 90*b* (S35 shown in FIG. 22, S35 shown in FIG. 26). The voltage value is then output to the PWM circuit 90*b* (S36 shown in FIG. 22, and S36 shown in FIG. 26).

The PWM circuit 90*b* outputs a pulse signal as a voltage signal in accordance with an input signal, thereby supplying an electric current to the needle thread motor 1286 (S37 shown in FIG. 22, S37 shown in FIG. 26: a current supply step).

As mentioned above, in the second position control zone, the turning arm 1281 returns to the initial position. This is for preventing the turning arm 1281 from going out of a turnable range. Specifically, in relation to the correction (which will be described later) of the needle thread requirement; for example, if stitches, by means of which a value determined by subtracting the needle thread consumption from the needle thread requirement becomes positive, are continuous and the turning arm 1281 is not returned to the initial position, the position of the turning arm 1281 will be positioned upward stitch by stitch at the end point of the first position control zone, and the stitches may go out of an upper end of the turnable range of the turning arm 1281. In the meantime, if stitches, by means of which the value determined by subtracting the needle thread consumption from the needle thread requirement becomes negative, are continuous and the turning arm 1281 is not returned to the initial position, the position of the turning arm 1281 will be positioned downward stitch by stich at the end point of the first position control zone, and the stitches may go out of a lower end of the turnable range of the turning arm 1281.

In the descriptions, the end point of the first position control zone coincides with the starting point o the initial position movement zone. However, the starting point of the home position movement zone may also be positioned behind the starting point of the second position control zone, and the position of the needle thread motor 1286 at the starting point of the second position control zone (i.e., the end point of the first position control zone) may also be maintained from the starting point of the second position control zone to the starting point of the initial position movement zone.

As above, the needle thread motor 1286 is controlled by repetition of processing depicted by flowcharts shown in FIG. 19 to FIG. 22. In descriptions about the flowcharts shown in FIG. 19 to FIG. 22 in relation to needle thread control, the PWM circuit 90*b* and the current sensor 90*c* are the PWM circuit 90*b* and the current sensor 90*c* that correspond to the needle thread motor 1286.

As shown in FIG. 38 and FIG. 39, in relation to control of switching between the upstream grip section 1240 and the downstream grip section 1260, the grip section main body 1241 of the upstream grip section 1240 is opened, and the grip section main body 1261 of the downstream grip section 1260 is closed from the end point of the torque control zone to the end point of the first position control zone of the needle thread motor 1286. In the meantime, the grip section main body 1241 of the upstream grip section 1240 is closed, and the grip section main body 1261 of the downstream grip section 1260 is opened from the end point of the first position control zone to the end point of the torque control zone.

Specifically, explanations are given along a flowchart shown in FIG. 27. A main spindle angle is detected (S41) (detection of a main spindle angle is performed in the same manner as described in connection with the stitch S1). A determination is made as to whether or not the main spindle angle is situated at the end point of the torque control zone (S42). When the main spindle angle is at the end point of the torque control zone, the grip section main body 1241 of the upstream grip section 1240 is opened, and the grip section main body 1261 of the downstream grip section 1260 is closed. Specifically, the needle thread J is not fixed by the grip section main body 1241 but fixed by the grip section main body 1261. Even when the main spindle angle has not reached the end point of the torque control zone yet on the occasion of detection of the previous main spindle angle (S41) and when the main spindle angle has passed on the end point of the torque control zone on the occasion of detection of the current main spindle angle (S41), the main spindle angle is determined to be at the end point of the torque control zone.

Further, when the main spindle angle is not at the end point of the torque control zone, a determination is made as to whether or not the main spindle angle is at the end point of the first position control zone (S44). When the main spindle angle is at the end point of the first position control zone, the grip section main body 1241 of the upstream grip section 1240 is closed, and the grip section main body 1261 of the downstream grip section 1260 is opened. Incidentally, even when the main spindle angle has not reached the end point of the first position control zone yet on the occasion of detection of a previous main spindle angle (S41) and when the main spindle angle has passed on the end point of the first position control zone on the occasion of detection of a current main spindle angle (S41), the main spindle angle is determined to be at the end point of the position control zone.

In the torque control zone and the second position control zone, the grip section main body 1241 is closed, and the grip section main body 1261 is opened as mentioned above. In the first position control zone, the grip section main body 1241 is opened, and the grip section main body 1261 is closed. When the grip section main bodies 1241 and 1261 are closed, the gripped needle thread is fixed. In contrast, when the grip section main bodies 1241 and 1261 are opened, the needle thread is released from a fixed state.

As a result of activation of the magnet section 1250, the first plate-like section of the first plate-like section unit corresponding to the position of the magnet section 1250, among the first plate-like section main units 1242-1 to 1242-9, is attracted by magnetic force. Spacing between the first plate-like section 1242*a* and the second plate-like section 1244 is thereby closed tightly, and the grip section main body 1241 is also closed. Thus, there is achieved a closed state in which the needle thread J is pinched between the first plate-like section 1242*a* and the second plate-like section 1244. As shown in; for instance, FIG. 3, FIG. 4, FIG. 5, FIG. 6, and FIG. 7, when the magnet section 1250 is situated on the back side of the first plate-like section 1242*a* of the first plate-like section unit 1242-8, the magnet section 1250 is activated, whereby the spacing between the first plate-like section 1242*a* and the second plate-like section 1244 is tightly closed. Thus, the needle thread is gripped between the first plate-like section 1242*a* and the second plate-like section 1244. When the magnet section 1250 is not activated, the spacing between the first plate-like section 1242*a* and the second plate-like section 1244 is not tightly closed (namely, the first plate-like section and the second plate-like section remain in simple contact with each other). Hence, the grip section main body 1241 is opened, thereby achieving an open state in which the needle thread is released. As above, the magnet section 1250 acting as the upstream drive section switches between the closed state in which the grip section main body 1241 grips the needle thread and the open state in which the needle thread is released.

Likewise, as a result of activation of the magnet section 1270, the first plate-like section of the first plate-like section unit corresponding to the position of the magnet section 1270, among the first plate-like sections 1262-1 to 1262-9, is attracted by magnetic force. Spacing between the first plate-like section 1262*a* and the second plate-like section 1264 is thereby tightly closed, and the grip section main body 1261 is also closed. Thus, there is achieved a closed state in which the needle thread J is pinched between the first plate-like section 1262*a* and the second plate-like section 1264. As shown in; for instance, FIG. 3, FIG. 4, FIG. 5, FIG. 6, and FIG. 7, when the magnet section 1270 is situated on the back side of the first plate-like section 1262*a* of the first plate-like section unit 1262-8, the magnet section 1270 is activated, whereby the spacing between the first plate-like section 1262*a* and the second plate-like section 1264 is tightly closed. Thus, the needle thread is gripped between the first plate-like section 1262*a* and the second plate-like section 1264. When the magnet section 1270 is not activated, the spacing between the first plate-like section 1262*a* and the second plate-like section 1264 is not tightly closed (specifically, the first plate-like section and the second plate-like section remain in simple contact with each other). Hence, the grip section main body 1261 is opened, thereby achieving an open state in which the needle thread is released. As above, the magnet section 1270 acting as the upstream drive section switches between the closed state in which the grip section main body 1261 grips the needle thread and the open state in which the needle thread is released.

The operation of the needle thread control section 1230 will be described. At the end point of the initial position movement zone, the turning arm 1281 is located in the initial position. At the position of the end point of the second position control zone, the turning arm 1281 is placed in the initial position (in an example in FIG. 39, at the end point of the initial position movement zone, the turning arm 1281 is placed in the home position). Specifically, the hook section 1284 of the turning arm 1281 is situated at an obliquely upward position (a position designated by 1281(A) shown in FIG. 6 and FIG. 7). The leading end of the turning arm 1281 is exposed to the front side of the plate section 1341 from the opening section 1342*b* at the initial position. When a change is made to the needle thread to be selected, the turning arm 1281 is receded. Therefore, after receding, the turning arm 1281 is turned to the initial position. On this occasion, the turning arm 1281 is upwardly turned, thereby turning the needle thread to the initial position while remaining in contact with and retaining the needle thread supported by the needle thread supporting member 1288.

When entered the torque control zone, the needle thread motor 1286 is subjected to torque control, whereby the needle thread motor 1286 imparts upward rotating force to the turning arm 1281. Thereby, in a state in which the turning arm 1281 is pulling the needle thread J against a direction (a pull-up direction) in which a thread take-up lever (any thread take-up lever to be actuated (hereinafter called an "actuation thread take-up lever") from among the thread take-up levers 12*a*-1 to 12*a*-9) pulls the needle thread J, the actuation thread take-up lever upwardly rotates, thereby pulling up the needle thread J with respect to the process fabric. As the actuation thread take-up lever pulls up the needle thread J (i.e., the actuation thread take-up lever shifts to the top dead center (the other dead center)), the turning arm 1281 rotates in the direction (the downward direction) in which the actuation thread take-up lever pulls the needle thread J. At the end point of the torque control zone, the grip section main body 1241 is opened, and the grip section main body 1261 is closed.

A torque value set in the needle thread control torque data is set to a value such that, as the actuation thread take-up lever pulls the needle thread J, the turning arm 1281 turns in the direction (the downward direction) in which the actuation thread take-up lever pulls the needle thread J and does not hinder the actuation thread take-up lever from pulling the needle thread J.

When a torque value is large during torque control, the needle thread J is pulled hard, resultant stitches will be sewn tightly. When the torque value is small, the needle threads J is pulled gently, so that resultant stitches will be sewed softly. In FIG. 37, FIG. 37(*a*) shows a state achieved at an angle of about 290 degrees in FIG. 38; FIG. 37(*b*) shows a state achieved at an angle of about 330 degrees in FIG. 38; FIG. 37(*c*) shows a state achieved at an angle of about 70 degrees; FIG. 37(*d*) shows a state achieved at an angle of about 110 degrees in FIG. 38; and FIG. 37(*e*) shows a state achieved at an angle of about 170 degrees in FIG. 38. The needle thread motor 1280 is subjected torque control in FIGS. 37(*b*) and 37(*c*). If the torque value is made large at certain stitch, the needle thread J is pulled hard, so that the stich will be sewed tightly. In the meantime, when the torque value is made smaller, the needle thread J will be pulled gently, so that the stitch will be sewed softly. In FIG. 37, K denotes a bobbin thread, and N denotes process fabric.

When having entered the first position control zone, the needle thread motor 1286 is subjected to position control with the grip body 1241 opened and the grip body 1261 closed, whereupon the turning arm 1281 turns toward a (upward) direction in which the needle thread J is pulled out from the upstream position. In short, the turn arm 1281 turns in the direction identical with a direction in which rotating force is imparted to the turning arm 1281 in the torque control zone. In the first position control zone, an angle through which the needle thread motor 1286 rotates is an angle corresponding to a postcorrected needle thread requirement of the needle thread quantity data 92*e* for the stitch about the immediately-arriving torque control zone in the needle thread quantity data 92*e*. Specifically, a rotation angle corresponding to the postcorrected needle thread requirement for the stitch (the stitch of the immediately-arriving torque control zone) of the needle thread quantity data is detected from the second correspondence table 92*g*, thereby rotating the needle thread motor 1286 through the detected rotation angle. At the time of detection of the rotation angle, an individual table corresponding to the angle of the needle thread motor 1286 at the starting point of the first position control zone (the angle of the needle thread motor 1286 at the current position) is selected from a plurality of individual tables 92*b*-1. The rotation angle is detected from the thus-selected individual table. Position control is performed according to the first angle correspondence data such that the needle thread motor 1286 rotates through the detected rotation angle. More specifically, the needle thread motor is controlled so as to rotate through the angle that is specified by the angle of the needle thread motor 1286 at the starting point of the first position control zone and the postcorrected needle thread requirement for the stitch of the immediately-arriving torque control zone, whereby the turning arm 1281 turns so as to pull out the needle thread by an amount of the postcorrected needle thread requirement. The angle is specified by the angle of the needle thread motor 1286 and the postcorrected needle thread requirement. Therefore, depending on the postcorrected needle thread requirement stored in the needle thread quantity data, the turning arm 1281 may turn upward in excess of the initial position as designated by an angular shift R-1 in FIG. 39. On the other hands, the turning arm 1281 may not turn to the initial position as designated by an angular shift R-2. In addition, the turning arm 1281 may also be in the home position at the end point of the first position control zone. At the end point of the first position control zone, the grip body 1241 is closed, and the grip body 1261 is opened. Although FIG. 39 shows a change in the angle of the needle thread motor 1286, the angle of the turning arm 1281 also changes similarly.

When having entered the second position control zone, the needle thread motor is subjected to position control according to the second angle correspondence data such that the turning arm 1281 turns to the initial position with the grip body 1241 closed and the grip body 1261 opened. As designated by the angular shift R-1 in FIG. 39, when the turning arm 1281 turns upward in excess of the home position at the end point of the first position control zone, the turning arm 1281 turns downward in the second position control zone and, in the meantime, when the turning arm 1281 does not reach the initial position at the end point of the first position control zone, the turning arm turns upward in the second position control zone. When the turning arm 1281 is situated at the initial position at the end point of the first position control zone, the turning arm 1281 does not need to turn in the second position control zone.

Reference numeral 1281(A) in FIGS. 6 and 7 shows a state in which the needle thread motor 1286 returns to the initial position at the end point of the second position control zone and the turning arm 1281 thereby turns to the initial position (which may also be the origin position).

Correction of the needle thread quantity data 92*e* will now be described. An explanation will be provided in accordance with the flowchart shown in FIG. 28, and the angle of the main spindle is detected (S51) (the main spindle is detected in the same manner as in step S1), thereby determining whether or not the needle thread motor is at the end point of the torque control zone (S52). When the needle thread motor is at the end point of the torque control zone, the needle thread consumption is detected (S53). Specifically, an angle (the angle a in FIG. 39) through which the needle thread motor 1286 rotates from the initial position to the end point of the torque control zone is detected. The needle thread consumption corresponding to the detected rotation angle is detected from the first correspondence table 92*f*. Since the rotation angle of the needle thread motor 1286 and the turning angle of the turning arm 1281 are the same. Hence, the turning angle of the turning arm 1281 is detected by detecting the rotating angle of the needle thread motor 1286.

The detected needle thread consumption is compared with the precorrected needle thread requirement (S54). If the precorrected needle thread requirement is identical with the needle thread consumption, processing will be completed. In contrast, if the precorrected needle thread requirement is different from the needle thread consumption, a determination is made as to whether or not the precorrected needle thread requirement is larger than the needle thread consumption (S55). If the precorrected needle thread requirement is larger than the needle thread consumption (i.e. a difference is positive), a correction will be made so as to increase the postcorrected needle thread requirement of a stitch next to the target stitch and subsequent stitches (i.e., including a stitch next to the target stitch and stitches subjected to the next stitch) in the postcorrected needle thread requirement data by a predetermined length (a unit correction value) (S56). When the precorrected needle thread requirement is smaller than the needle thread consumption (i.e., the difference is negative), a correction will be made so as to decrease the postcorrected needle thread requirement of a stitch next to the target stitch and subsequent stitches in the postcorrected needle thread requirement data by a predetermined length (a unit correction value) (S57). In relation to the postcorrected needle thread requirement data in the needle thread quantity data 92*e*, the needle thread requirement is updated to the postcorrected needle thread requirement and then stored. The unit correction value is made of the absolute value.

Processing of step S53 is performed at timing of completion of the torque control zone ($Z_2$ timing in FIG. 38 and FIG. 39). Processing of steps S54 through S57 is performed up to the starting point ($Z_4$) of the next thread pull-out zone.

Specific examples of steps S55 through S57 will be explained by reference to FIGS. 29 and 30. In relation to stitch m through stitch m+3 . . . , A0 through A3 . . . are stored for a precorrected needle thread requirement. Likewise, A0 through A3 . . . are stored for the postcorrected needle thread requirement in a precorrected state (FIG. 29(*a*)). A stitch m is taken as a target stitch, and the needle thread consumption of the stitch m in the torque control zone is B0. Provided that A0-B0 (the precorrected needle thread requirement—the postcorrected needle thread requirement) is +0.1 mm, the precorrected needle thread requirement is larger than the needle thread consumption (i.e., the difference is positive). Accordingly, a correction is made so as to add the unit correction value to the postcorrected needle thread requirement of a stitch next to the stitch m and subsequent stitches. Namely, a correction is made to increase the needle thread requirement in the postcorrected needle thread requirement data. In an example shown in FIGS. 29(*a*) and (*b*), 0.1 mm (a unit correction value) is added to all the needle thread requirements of stitches subsequent to the stitch m+1 (FIG. 29(*b*)). Provided that the stitch m is the target stitch, a correction is made to needle thread requirement (the needle thread requirement in the postcorrected needle thread requirement data) of a stitch next to the target stitch and subsequent stitches.

In the first position control zone of the stitch m, a needle thread for the next stitch is prepared. For this reason, corrected needle thread requirement (i.e., the postcorrected needle thread requirement) of the stitch m+1 is applied. The needle thread motor 1286 rotates over a length of A1+0.1 mm. Specifically, in the first position control zone of the control zone of the stitch m, the needle thread motor 1286 rotates through an angle that is specified by the postcorrected needle thread requirement of the stitch m+1 (i.e., a stitch of the immediately-arriving torque control zone) and an angle of the current position of the needle thread motor 1286 (an angle at the starting point of the first position control zone of the stitch m), thereby preparing a needle thread to be used in the immediately-arriving torque control zone. By means of the second correspondence table 92*g*, the rotation angle is detected from the postcorrected needle thread requirement.

Subsequently, in relation to the stitch m+1 that is the next target stitch, provided that the needle thread consumption in the torque control zone is B1 and that A1-B1 (the precorrected needle thread requirement—the needle thread consumption) is +0.2 mm, the precorrected needle thread requirement is larger than the needle thread consumption (in other words, the difference is positive). Hence, a correction is made to add the unit correction value to the postcorrected needle thread requirement of a stitch next to stitch m+1 and subsequent stitches. In short, a correction is made to increase the needle thread requirement in the postcorrected needle thread requirement data. In an example shown in FIGS. 30(*c*) and (*d*), 0.1 mm (a unit correction value) is added to all the needle thread requirements for stitches subsequent to stitch m+2. As a result, the postcorrected needle thread requirements for the stitches subsequent to the stitch m+2 become equal to the original needle thread requirements (the precorrected needle thread requirement) having 0.2 added (FIG. 30(*c*)). In short, provided that the stitch m+1 is the target stitch, a correction is made to the needle thread requirements (the needle thread requirements in the postcorrected needle thread requirement data) for a stitch next to the target stitch and subsequent stitches.

In the first position control zone of the stitch m+1, a needle thread for the next stitch is prepared. For this reason, corrected needle thread requirement of the stitch m+2 is applied. The needle thread motor 1286 rotates over a length of A1+0.2 mm. Specifically, in the first position control zone of the control zone of the stitch m+1, the needle thread motor 1286 rotates through an angle that is specified by the postcorrected needle thread requirement of the stitch m+2 (i.e., a stitch of the immediately-arriving torque control zone) and an angle of the current position of the needle thread motor 1286 (an angle at the starting point of the first position control zone of the stitch m+1), thereby preparing a needle thread to be used in the immediately-arriving torque control zone.

Subsequently, in relation to the stitch m+2 that is the next target stitch, provided that the needle thread consumption in the torque control zone is B2 and that A2-B2 (the precorrected needle thread requirement—the needle thread consumption) is −0.1 mm, the precorrected needle thread requirement is smaller than the needle thread consumption (in other words, the difference is negative). Hence, a correction is made to subtract the unit correction value from the postcorrected needle thread requirement of a stitch next to the target stitch (stitch m+2) and subsequent stitches. In short, a correction is made to decrease the needle thread requirement in the postcorrected needle thread requirement data. In the example shown in FIGS. 30(*c*) and (*d*), 0.1 mm (a unit correction value) is subtracted from all the needle thread requirements for stitches subsequent to stitch m+3. As a result, the postcorrected needle thread requirements for the stitches subsequent to the stitch m+3 become equal to the original needle thread requirements (the precorrected needle thread requirement) having 0.1 added (FIG. 30(*d*)). In short, provided that the stitch m+2 is the target stitch, a correction is made to the needle thread requirements (the needle thread requirements in the postcorrected needle thread requirement data) for a stitch next to the target stitch and subsequent stitches.

In the first position control zone of the stitch m+2, a needle thread for the next stitch is prepared. For this reason, corrected needle thread requirement (the postcorrected needle thread requirement) of the stitch m+3 is applied. The needle thread motor 1286 rotates over a length of A1+0.1 mm. Specifically, in the first position control zone of the control zone of the stitch m+2, the needle thread motor 1286 rotates through an angle that is specified by the postcorrected needle thread requirement of the stitch m+3 (i.e., a stitch of the immediately-arriving torque control zone) and an angle of the current position of the needle thread motor 1286 (an angle at the starting point of the first position control zone of the stitch m+2), thereby preparing a needle thread to be used in the immediately-arriving torque control zone.

The precorrected needle thread requirement is larger than the needle thread consumption. This means that the quantity of needle thread supposed to have been consumed originally is not consumed because the tension on the needle thread is stronger than the bobbin thread and so on, as a result of which the needle thread consumption is smaller as shown in FIG. 33(*c*). A larger quantity of needle thread is supplied by making a correction for adding the postcorrected needle thread requirement, thereby making the needle thread consumption closer to the precorrected needle thread requirement. On the contrary, the precorrected needle thread requirement is smaller than the needle thread consumption. This means that the needle thread has been consumed larger than required because the tension on the needle thread is smaller than the bobbin thread and so on, as a result of which the needle thread consumption is larger as shown in FIG. 33(*a*). A smaller quantity of needle thread is supplied by making a correction for subtracting the postcorrected needle thread requirement, thereby making the needle thread consumption closer to the precorrected needle thread requirement.

Under the above method, each stitch is sequentially taken as a target stitch, and the needle thread consumption and the precorrected needle thread requirement are compared with each other for each target stitch, thereby correcting the postcorrected needle thread requirement. Hence, the needle thread consumption can be made minutely closer to the precorrected needle thread requirement.

In the above description, in relation to the stitches of the embroidery data, one stitch is sequentially specified as a target stitch. A correction is made to the needle thread quantity data stitch by stitch. Alternatively, it may also be possible to compare the precorrected needle thread requirement with the needle thread consumption, with regard to a stitch group made up of a plurality of stitches including a target stitch, and to thereby make a correction to the needle thread quantity data. Specifically, an aggregate of needle thread requirements for a plurality of stitches (i.e., a total of precorrected needle thread requirements) and an aggregate of needle thread consumptions for the plurality of stitches (i.e., a total of needle thread consumptions) are compared with each other. When the aggregate of precorrected needle thread requirements is larger than the aggregate of needle thread consumptions, the unit correction value is added to the postcorrected needle thread requirement for a stitch next to the target stitch and subsequent stitches. On the contrary, when the aggregate of precorrected needle thread requirements is smaller than the aggregate of needle thread consumptions, the unit correction value is subtracted from the postcorrected needle thread requirement for the stitch next to the target stitch and subsequent stitches. The stitch group is made up of a plurality of stitches including the target stitch and a stitch preceding to the target stitch, and the plurality of stitches are continuous. In other words, the stitch group is made up of the target stitch and one stitch or a plurality of stitches continuous from and before the target stitch. Furthermore, the plurality of stitches in the "aggregate of needle thread consumptions for a plurality of stiches" are identical with the plurality of stitches in the "aggregate of precorrected needle thread requirements for a plurality of stitches."

When the precorrected needle thread requirement is compared with the needle thread consumption with regard to a stitch group made up of a plurality of stitches, a stitch in the embroidery data may also be sequentially taken as a target stitch in the case of the target stitch being the nearest stitch in the stitch group, or a target stich may also be set for each number of stitches that make up a stitch group.

For instance, in examples shown in FIGS. 29 and 30, when the number of stitches making up the stitch group is taken as two, the postcorrected needle thread requirement for stitch m to stitch m+1 is not updated. In stitch m+1, the needle thread requirement (postcorrected needle thread requirement) for stitch m+2 and subsequent stitches is corrected at stitch m+1. In this case, the stitch m+1 is taken as a target stitch, and stitch m+1 and stitch m make up a stitch group. More specifically, (A0−B0)+(A1−B1) yields +0.2 mm at stitch m+1. Since a difference is positive, 0.1 mm is added to the postcorrected needle thread requirement for stitch m+2 and subsequent stitches. The needle thread requirement for stitch m+2 is A2+0.1 mm in this case. The needle thread requirement for stitch m+3 is A3+0.1 mm (the needle thread requirement for stitch m stays at A0, and the needle thread requirement for stitch m+1 stays at A1).

When stitches are taken as a target stitch one by one, a target stich next to stitch m+1 is stitch m+2, and stitch m+2 and stitch m+1 make up a stitch group. (A1−B1)−(A2−B2) assumes a value of +0.1 mm. Since the difference is positive, the needle thread requirement for stitch m+3 and subsequent stitches is incremented by 0.1 mm. Specifically, the needle thread requirement for stitch m+3 is A3+0.2 mm.

In the meantime, when the target stich is set for each number of stitches that make up a stitch group. In the above case, a target stitch is provided every two stitches. A target stitch next to stitch m+1 that is the target stitch is stitch m+3 (target stitch is stitch m+3 that is nearest stitch in next two stitches). An aggregate of needle thread consumption for two stitches, or stitch m+2 and stitch m+3, is compared with an aggregate of needle thread requirement for these two stitches. On the basis of a comparison result, needle thread quantity data for stitch m+4 and subsequent stitches (a stitch next to the target stitch) is corrected.

As above, in the case that the needle thread consumption is compared with the precorrected needle thread requirement with regard to the stitch group made up of a plurality of stitches and the needle thread quantity data is corrected, frequent occurrence of a variation in difference between the precorrected needle thread requirement and the needle thread consumption can be made small within a range of positive and negative values as compared with the case where the needle thread quantity data is sequentially corrected on a per-stitch basis. Hence, changes in the rate of needle thread on the back of the process fabric can be made small.

When a target stitch is provided for each number of stitches that make up a stitch group, the frequent occurrence of a correction being made to needle thread requirement becomes smaller. Hence, a burden on the control circuit 90 can be made small accordingly.

Although the stitch group is made up of a plurality of stitches composed of a target stitch and stitches preceding the target stitch, and the plurality of stitches are continuous, the plurality of stitches may also be made up of a target stitch and one or a plurality of stitches preceding the target stitch, and the plurality of stitches may also be discontinuous. For instance, a stitch group may be made up of a target stitch and a stitch two before the target stitch. In this case, when stitch m+2 is taken as a target stitch, a stitch group is made up of stitch m+2 and stitch m. In short, the stitch group may also be formed from a plurality of stitches including a target stitch, the only requirement is to compare needle thread consumption with precorrected needle thread requirement in relation to a plurality of stitches including the target stitch and correct needle thread requirement.

As shown in FIGS. 38 and 29, the above description states that, within the control zone of each stitch, the first position control zone is provided subsequent to the torque control zone and that the second position control zone is provided subsequent to the first position control zone. However, the second position control zone may be provided subsequent to the first position control zone, and the torque control zone may be provided subsequent to the second position control zone.

Even in this case, in relation to a certain stitch (a target stitch), the needle thread motor 1286 is rotated through the angle that is specified by postcorrected needle thread requirement data on a stitch in the torque control zone (the immediately-arriving torque control zone) within the control zone of the certain stitch and by the angle of the needle thread motor 1286 at the starting point of the first position control zone. Thus, a needle thread to be used in the torque control zone is pulled out. In this case, in contrast with the case of the control zone of the stitch shown in FIGS. 38 and 39, the stitch of the immediately-arriving torque control zone becomes the same as the target stitch. On the occasion of correction of the needle thread quantity data, the needle thread consumption can be detected at the end point of the torque control zone of the target stitch. Hence, the needle thread requirement data for the stitch next to the target stitch and subsequent stitches is corrected by comparing the precorrected needle thread requirement with the needle thread consumption.

In the above description, the unit correction value is added or subtracted. However, a plurality of unit correction values may be provided. Further, the plurality of unit correction values may be made different from each other. During correction of the needle thread requirement, the unit correction values selected from the plurality of unit correction values may also be incremented or decremented with reference to the needle thread requirement.

For instance, during correction of the needle thread requirement, the unit correction value to be incremented or decremented with reference to the needle thread requirement may be changed in accordance with the magnitude of the absolute value of the value that is produced by subtracting the needle thread consumption from the precorrected needle thread requirement. As the magnitude of the absolute value is greater, the unit correction value may be changed greater.

When a difference between the precorrected needle thread requirement and the needle thread consumption is larger than the predetermined threshold value, the unit correction value is made larger. On the contrary, when the difference between the precorrected needle thread requirement and the needle thread consumption is smaller than the threshold value, the unit correction value is mad smaller.

For instance, in the example shown in FIGS. 29 and 30, there are two types of unit correction value; that is, 0.1 mm and 0.2 mm. Given that the threshold value is 0.3, when the difference between the needle thread requirement and the needle thread consumption (an absolute value of the value determined by subtracting the needle thread consumption from the needle thread requirement) is the threshold value or less, the unit correction value is set to 0.1 mm. When the difference between the needle thread requirement and the needle thread consumption exceeds the threshold value, the unit correction value is set to 0.2 mm. As a result, the needle thread consumption can be quickly made closer to the precorrected needle thread requirement.

Moreover, a plurality of unit correction values that are different in magnitude from each other may be provided. During correction of needle thread requirement, the unit correction value to be incremented or decremented with reference to the needle thread requirement may be changed in accordance with the number of times either positive or negative values, which are produced by subtracting the needle thread consumption from the precorrected needle thread requirement, become continuous. Alternatively, as either positive or negative values, which are produced by subtracting the needle thread consumption from the precorrected needle thread requirement, become continuous a large number of times, the unit correction value may be changed greater.

For instance, in the example shown in FIGS. 29 and 30, two types of unit correction values; that is, 0.1 mm and 0.2 mm, are provided. When either positive or negative stitches are continuous two times or less, the unit correction value is set to 0.1 mm. On the contrary, when either positive or negative stitches are continuous three times or more, the unit correction value is set to 0.2. When stitches, for which the value produced by subtracting the needle thread consumption from the precorrected needle thread requirement is positive, become continuous three times or more, 0.2 mm is added to the needle thread requirement. On the other hand, when stitches, for which the value produced by subtracting the needle thread consumption from the precorrected needle thread requirement is negative, become continuous three times, 0.2 mm is subtracted from the needle thread requirement. As a result, the needle thread requirement can be made closer to the precorrected needle thread requirement.

In the above description, the needle thread requirement in the precorrected needle thread requirement data is calculated by the computation expression ($L+2\times T+L\times 2/3$) and thus set. However, the needle thread requirement can also be determined from a angle (an acute angle) (this is an inner angle) between the target stitch and a stitch immediately preceding the target stitch. As shown in FIGS. 31(*a*), (*b*), (*c*) and (*d*), the inner angle is an angle $\gamma$ between the stitch m and the stitch m−1 immediately preceding the stitch m. The inner angle is of absolute value. The stitch m a stitch that is a subject of precorrected needle thread requirement. When the precorrected needle thread requirement of the stitch m is calculated, an inner angle between the stitch m and the stitch m−1 is taken into account.

In reality, the ratio between the needle thread and the bobbin thread on the back of the process fabric that is 2:1 is suitable for the case where the inner angle is 0 as shown in FIG. 31(*a*). As shown in FIG. 31(*d*), when the inner angle is 180 degrees, the needle thread hardly appears from the back of the process fabric. Hence, the needle thread requirement may also be set to zero. Therefore, when the inner angle is 0 degree, the needle thread requirement is calculated by the expression. When the inner angle is 180 degrees, the needle thread requirement is taken as 0. As the inner angle shifts from 0 degree to 180 degrees, the needle thread requirement proportionally changes in a linear manner. In short, when the precorrected needle thread requirement in the needle thread quantity data is previously stored, the needle thread requirement is also adjusted in advance in accordance with the inner angle.

An inner angle table 92*d* such as that shown in FIG. 32 is prepared in advance (the inner angle table 92*h* is previously stored in the memory device 92). The needle thread requirement is calculated by adding a correction coefficient specified by the inner angle table 92*h* to the expression. The inner angle table 92*h* is specified such that the correction coefficient at an inner angle of 0 degree is 1000; that the correction coefficient at an angle of 180 degrees is 0 and that the correction coefficient becomes linearly proportional from an inner angle of 0 degree to 180 degrees. Provided that the correction coefficient is taken as w, the needle thread requirement is calculated by the expression of $L+2\times T+(L\times 2/3\times w/1000)$. Specifically, the length of the needle thread on the back of the process fabric is weighted by the magnitude of the inner angle (i.e., the coefficient is integrated in accordance with the magnitude of the inner angle with respect to the length of the needle thread on the back of the process fabric, thereby adjusting the length of the needle thread on the back of the needle thread fabric.

When a ratio between the length of a needle thread and the length of a bobbin thread is taken as A:B, the expression added with the correction coefficient is L+2×T+(L×A/(A+B)×w/1000). Given that w/1000 is W and that W is a correction coefficient, the expression is L+2×T+(L×A/(A+B)×W). Provided that W is a correction coefficient, the correction coefficient at an inner angle of 0 degree is one. The correction coefficient is 0 at an inner angle of 180 degrees.

Even in the precorrected needle thread requirement data achieved when the inner angle is taken into account, the precorrected needle thread requirement generated outside may be stored in the needle thread quantity data through the input-output device 94. The precorrected needle thread requirement data may also be stored in the needle thread quantity data by calculating the precorrected needle thread requirement with the control circuit 90. Specifically, stitch width data is stored in the embroidery data 92*a* input from the outside, and the inner angle can be calculated from the stitching direction in the embroidery data 92*a*. Accordingly, the control circuit 90 can calculate the precorrected needle thread requirement by inputting, through the input-output device 94, data on the thickness of the process fabric and data on the ratio between the length of the needle thread and the length of the bobbin thread on the back of the fabric process. Further, the inner angle is said to be calculated from the stitching direction. However, data on the inner angle may also be input from the outside by way of the input-output device 94.

As mentioned above, the precorrected needle thread requirement is calculated in consideration of the angle (inner angle) which a certain stitch forms with another stitch preceding the stitch. Therefore, the precorrected needle thread requirement can be set to a more appropriate value.

As above, when embroidery sewing is performed according to the embroidery data, in connection with a control zone for each stitch, in the torque control zone including at least a portion of an area from one dead center to the other dead center of the thread take-up lever, that is an area during which the thread take-up lever pulls the needle thread with respect to the process fabric to be sewn with the needle thread, torque control is performed to impart rotating force to the turning arm, with the upstream grip section main body closed and the downstream grip body opened, by controlling the needle thread motor according to the torque value of the torque data so as to impart a tension to the needle thread against the direction of the needle thread being pulled by the thread take-up lever; in the first position control zone that is at least a portion of a zone other than the torque control zone, first position control is performed to turn the turning arm in the same direction as the rotating force is imparted to the turning arm in the torque control zone so as to pull out the needle thread from upstream, with the upstream grip section main body opened and the downstream grip body closed, by controlling the position of the needle thread motor so as to rotate through the angle corresponding to with the needle thread requirement in the postcorrected needle thread requirement data for the stitch of the immediately-arriving torque control zone; and, in the second position control zone that is at least a portion of the zone other than the torque control zone and subsequent to the first position control zone, second position control is performed to control the position of the needle thread motor, with the upstream grip section main body closed and the downstream grip body opened, such that the angle of the needle thread motor returns to the initial position at the angle of the needle thread motor that is the position of the needle thread motor in its rotating direction.

In relation to a target stitch that is one to be sequentially specified among stitches in the embroidery data or a plurality of stitches including the target stitch, the needle thread consumption showing the length of the needle thread used in the torque control zone (in particular, the length of the needle thread specified by the rotation angle of the needle thread motor in the torque control zone) is compared with the needle thread requirement in the precorrected needle thread requirement data. When the needle thread requirement is larger than the needle thread consumption, a correction is made to increase the needle thread requirement in the postcorrected needle thread requirement data on a stitch next to the target stitch and subsequent stitches. On the other hand, when the needle thread requirement is smaller than the needle thread consumption, a correction is made to decrease the needle thread requirement in the postcorrected needle thread requirement data on a stitch next to the target stitch and subsequent stitches.

Control of the main spindle motor 20 is now described. Control of the main spindle motor 20 is performed in the same manner as in the case of position control of the needle thread motor 1286.

First, angle data (this can also be taken as position data) are read from the main spindle data (S61 shown in FIG. 34, S61 shown in FIG. 36: a reading step). Specifically, an angle (a main spindle angle) corresponding to a time that is an objective of processing is detected from the main spindle data, and data pertaining to the angle are read.

Next, there is detected an amount of change in the thus-detected main spindle angle per unit time, and speed data are calculated (S62 shown in FIG. 34, S62 shown in FIG. 36: a speed data calculation step). On the occasion of calculation of speed data, the amount of change in angle data is divided by a time, thereby calculating speed data. Namely, the speed data are calculated by differentiating the angle data.

The amount of change in speed data per unit time is detected, thereby calculating torque data (S63 shown in FIG. 34, S63 shown in FIG. 36: a torque data calculation step). On the occasion of calculation of torque data, the amount of change in speed data is divided by a time, thereby calculating torque data. Namely, torque data are calculated by differentiating the speed data. Speed data required to calculate the amount of change in speed are previously retained by the CPU 90*a*.

Torque compensation data are calculated from the torque data calculated in step S63 (S64 shown in FIG. 34, S64 shown in FIG. 36). Specifically, torque data are multiplied by an inertia ratio (S64-1 shown in FIG. 36), and torque derived from a mechanical loss is added to a value determined by multiplying the torque data by the inertial ratio, thereby calculating the torque compensation data (S64-2 shown in FIG. 36). The inertia ratio is a constant previously determined according to a mass of each of the machine elements, or the like. Further, the torque derived from a mechanical loss is a value previously determined in correspondence with each of the machine elements.

Data (a count value of the encoder) output from the encoder 21 are subtracted from the angle data read in step S61 (S65 shown in FIG. 35, S65 shown in FIG. 36: a location deviation calculation step). A value calculated in step S65 can be said to be a value of a location deviation.

The value calculated in step S65 is now multiplied by a predetermined constant, thereby calculating a speed value (S66 shown in FIG. 35 and S66 shown in FIG. 36).

A current motor speed value is calculated by differentiating the output from the encoder 21 (S67 shown in FIG. 35 and S67 shown in FIG. 36). Specifically, an amount of change in encoder count value per unit time is calculated, thereby calculating a current motor speed value.

Next, the current motor speed value calculated in step S67 is subtracted from the speed value calculated in step S66, and the speed data calculated in step S62 are added to a subtraction result (S68 shown in FIG. 35, S68 shown in FIG. 36: a speed deviation calculation step). A value calculated in step S58 can be said to be a value of speed deviation.

The value calculated in step S68 is multiplied by a predetermined constant, thereby calculating a torque value (S69 shown in FIG. 35 and S69 shown in FIG. 36).

The torque value output from the current sensor 90*c* is subtracted from the torque value calculated in step S69. Further, torque compensation data calculated in step S54 are added to a subtraction result (S70 shown in FIG. 35, and S70 shown in FIG. 36: a torque deviation calculation step). The value calculated in step S70 can be said to be a torque deviation value.

The value calculated in step S70 is multiplied by a predetermined constant, thereby calculating a voltage value (a voltage command to the PWM circuit) output to the PWM circuit 90*b* (S71 shown in FIG. 35, S71 shown in FIG. 36). The voltage value is then output to the PWM circuit 90*b* (S72 shown in FIG. 35, and S72 shown in FIG. 36).

The PWM circuit 90*b* outputs a pulse signal as a voltage signal in accordance with an input signal, thereby supplying an electric current to the main spindle motor 20 (S73 shown in FIG. 35, S73 shown in FIG. 36: a current supply step). In the description about the flowcharts of FIG. 34 and FIG. 35 in relation to control of the main spindle motor 20, the PWM circuit 90*b* and the current sensor 90*c* are the PWM circuit 90*b* and the current sensor 90*c* that correspond to the main spindle motor 20.

As above, according to the sewing machine of the embodiment, the needle thread quantity data are provided; the precorrected needle thread requirement is previously determined for each stitch; and the postcorrected needle thread requirement data is corrected according to the magnitude of the difference between the precorrected needle thread requirement and the needle thread consumption. Accordingly, the needle thread consumption can be made closer to the precorrected needle thread requirement, and a desired balance between the needle thread consumption and the bobbin thread consumption can be achieved. Since the desired balance between the needle thread consumption and the bobbin thread consumption can be achieved, a seam finish involving the stable balance between the needle thread consumption and the bobbin thread consumption can be produced.

The precorrected needle thread requirement is preliminarily determined in accordance with the ratio between the length of the needle thread and the length of the bobbin thread on the back of the process fabric, whereby a desired balance between the needle thread consumption and the bobbin thread consumption can be achieved.

Particularly, even when the existing configuration using a bobbin case for a bobbin thread having a tension spring attached is used, a desired balance between the needle thread consumption and the bobbin thread consumption can be achieved. Accordingly, a low-cost sewing machine (i.e., a sewing capable of achieving a desired balance between the needle thread consumption and the bobbin thread consumption) can be provided.

The precorrected needle thread requirement is set in consideration of the inner angle that is the angle which the target stich forms with the stitch preceding the target stitch. A more appropriate value can be set on the precorrected needle thread requirement.

The sewing machine 1 of the embodiment controls the torque of the needle thread in the torque control zone and, therefore, can control the magnitude of the tension on the needle thread. Particularly, torque control is performed by the needle thread control torque data on a per-stitch basis in the torque control zone. Hence, the tension on the needle thread can be controlled on a per-stitch basis, and the tightness of the seam can be controlled for each stitch.

Even the plurality of sewing machines 1 make the needle thread control torque data 92*b*, the zone position data 92*c*, and the needle thread quantity data 92*e* stored in the memory device 92 identical to each other. Therefore, the sewing machines each can produce the same embroidery on the process fabric, as a result of which the embroidery produced by the respective sewing machines becomes extremely identical with each other.

In the existing sewing machine, a pretension component, a thread tension disc, a rotary tension component, and a tension spring are in the needle thread path from the thread roll wound around the needle thread bobbin to the thread take-up lever. However, in the first position control zone in which the needle thread J is pulled out, the grip body 1241 is opened. Only the pretension component is present upstream with reference to the turning arm 1281 of the turning section 1280. Frictional resistance is not present between the thread tension disc and the rotary tension component. Moreover, since the grip body 1261 is closed, movement of the thread take-up lever will not pose any problems at the time of pulling out the needle thread. Therefore, the needle thread can be smoothly pulled out of the thread roll, and the possibility of occurrence of a break in the thread can be made smaller.

If a break has occurred in the needle thread, the turning arm 1281 will not turn downward in the course of the take-up lever shifting to the top dead center. In other words, the turning arm 1281 is not pulled in a direction opposite to the direction of torque being imparted by the needle thread motor 1286. Hence, the turning arm 1281 is detected failing to turn downward, whereby occurrence of a break in the needle thread can be detected. Further, in the case of occurrence of no break in the needle thread, the turning arm 1281 turns downward in the torque control zone, so that occurrence of a break in the needle thread can be detected accurately.

In the first position control zone, among the position control zones, the current position of the needle thread motor 1286 is detected, and the first angle correspondence data for effecting position control so as to pull out the needle thread commensurate with the postcorrected needle thread requirement is prepared, the position of the needle thread motor 1286 is controlled according to the first angle correspondence data. Hence, the needle thread required in the torque control zone of the next stitch will not become deficient.

The descriptions state that the needle thread consumption is detected in accordance with the angle through which the turning arm 1281 turns. However, another method may also be adopted to detect the length of the needle thread used in the torque control zone. For instance, a mechanism for detecting a length over which the needle thread passes by down below the downstream grip body 1260 (in particular, the grip body 1261) on the needle thread path may be provided. A conceivable configuration of the mechanism is made up of a pulley that rotates as the needle thread transfers and an encoder that detect rotation angle of the pulley. Since the mechanism causes frictional resistance between the needle thread and the pulley, the method for detecting the needle thread consumption in accordance with the turning angle of the turning arm 1281 can be said to be a method for enabling easy detection of the needle thread consumption.

Although the description states that the sewing machine 1 is a sewing machine for embroidery, another sewing machine (i.e., a sewing machine for sewing) other than the embroider sewing machine may also be usable.

The sewing machine for sewing is usually equipped with one thread take-up lever and one needle thread bar in one head. Sewing data is used in place of the embroider data. As shown in FIG. 11, the sewing data also includes a stitch width, a stitching direction, and thread attributes (data on the thread attributes may also be omitted). Further, even in the case of the sewing machine for sewing, when sewing is performed according to the sewing data, in connection with a control zone for each stitch, in the torque control zone including at least a portion of an area from one dead center to the other dead center of the thread take-up lever, that is an area during which the thread take-up lever pulls the needle thread with respect to the process fabric to be sewn with the needle thread, torque control is performed to impart rotating force to the turning arm, with the upstream grip section main body closed and the downstream grip body opened, by controlling the needle thread motor according to the torque value of the torque data so as to impart a tension to the needle thread against the direction of the needle thread being pulled by the thread take-up lever; in the first position control zone that is at least a portion of a zone other than the torque control zone, first position control is performed to turn the turning arm in the same direction as the rotating force is imparted to the turning arm in the torque control zone so as to pull out the needle thread from upstream, with the upstream grip section main body opened and the downstream grip body closed, by controlling the position of the needle thread motor so as to rotate through the angle corresponding to with the needle thread requirement in the postcorrected needle thread requirement data for the stitch of the immediately-arriving torque control zone; and, in the second position control zone that is at least a portion of the zone other than the torque control zone and subsequent to the first position control zone, second position control is performed to control the position of the needle thread motor, with the upstream grip section main body closed and the downstream grip body opened, such that the angle of the needle thread motor returns to the initial position at the angle of the needle thread motor that is the position of the needle thread motor in its rotating direction.

Even in the case of the sewing machine for sewing, in relation to a target stitch that is one to be sequentially specified among stitches in the sewing data or a plurality of stitches including the target stitch, the needle thread consumption showing the length of the needle thread used in the torque control zone or the length of the needle thread specified by the rotation angle of the needle thread motor in the torque control zone is compared with the needle thread requirement in the precorrected needle thread requirement data. When the needle thread requirement is larger than the needle thread consumption, a correction is made to increase the needle thread requirement in the postcorrected needle thread requirement data on a stitch next to the target stitch and subsequent stitches. On the other hand, when the needle thread requirement is smaller than the needle thread consumption, a correction is made to decrease the needle thread requirement in the postcorrected needle thread requirement data on a stitch next to the target stitch and subsequent stitches.

As above, according to the sewing machine other than the embroidery sewing machine, a desired balance between the needle thread consumption and the bobbin thread consumption can be achieved, and, as a result, a seam finish involving the stable balance between the needle thread consumption and the bobbin thread consumption can be produced. Even when the existing configuration using a bobbin case for a bobbin thread having a tension spring attached is used, a desired balance between the needle thread consumption and the bobbin thread consumption can be achieved. Accordingly, a low-cost sewing machine (i.e., a sewing capable of achieving a desired balance between the needle thread consumption and the bobbin thread consumption) can be provided.

In the above description, the end point of the torque control zone coincides with the starting point of the first position control zone. However, the first position control zone may also be taken as a thread pull-out zone, the second position control zone may also be taken as an initial position movement zone. An extent from the end point of the torque control zone to the starting point of the thread pull-out zone may also be taken as a first angle maintenance zone in which the angle of the turning arm 1281 is maintained. An extent from the end point of the initial position movement zone to the starting point of the torque control zone may also be taken as a second angle maintenance zone in which the angle of the turning arm 1281 is maintained. In this case, the timing when the upstream grip section 1240 is changed from a close position to an open position and when the downstream grip section 1260 is changed from an open position to a close position is set to any position in the extent from the end point of the torque control zone to the starting point of the thread pull-out zone.

"Sewing data" is a word of broader concept about "embroidery data." The embroidery data can be said to include sewing data.

Throughout the drawings of the embodiments, direction Y1-Y2 is orthogonal to direction X1-X2, and direction 21-22 is orthogonal to the direction X1-X2 and the direction Y1-Y2.

DESCRIPTIONS OF THE REFERENCE NUMERALS AND SYMBOLS

1 SEWING MACHINE
2 SEWING MACHINE UNIT
3 HEAD
5 NEEDLE PLATE
10 MACHINE ELEMENT GROUP
12*a*-1, 12*a*-2, 12*a*-3, 12*a*-4, 12*a*-5, 12*a*-6, 12*a*-7, 12*a*-8, 12*a*-9 THREAD TAKE-UP LEVER
12*b*-1, 12*b*-2, 12*b*-3, 12*b*-4, 12*b*-5, 12*b*-6, 12*b*-7, 12*b*-8, 12*b*-9 NEEDLE BAR
12*ba* SEWING NEEDLE
12*bb* PIN HOLE
12*d* SEWING FRAME
14*a* NEEDLE BAR CONNECTING STUD
14*b* NEEDLE BAR ACTUATION MEMBER
14*c* BASE NEEDLE BAR
20 MAIN SPINDLE MOTOR

21, 1287 ENCODER
22 MAIN SPINDLE
24 FRAME ACTUATOR
90 CONTROL CIRCUIT
92 MEMORY DEVICE
92*a* EMBROIDERY DATA
92*b* NEEDLE THREAD CONTROL TORQUE DATA
92*c* ZONE POSITION DATA
92*d* MAIN SPINDLE DATA
92*e* NEEDLE THREAD QUANTITY DATA
92*f* FIRST CORRESPONDENCE TABLE
92*g* SECOND CORRESPONDENCE TABLE
92*h* INNER ANGLE TABLE
94 INPUT-OUTPUT DEVICE
96 OPERATION SECTION
100 SHUTTLE
1230 NEEDLE THREAD CONTROL SECTION
1240 UPSTREAM GRIP SECTION
1241 GRIP SECTION MAIN BODY
1242-1 through 1242-9 FIRST PLATE-LIKE SECTION UNIT
1242*a*, 1262*a* FIRST PLATE-LIKE SECTION
1244, 1264 SECOND PLATE-LIKE SECTION
1250, 1270 MAGNET SECTION
1252 GUIDE MEMBER
1254 GUIDE MEMBER
1260 DOWNSTREAM GRIP SECTION
1261 GRIP SECTION MAIN BODY
1262-1 through 1262-9 FIRST PLATE-LIKE SECTION UNIT
1272, 1274 GUIDE MEMBER
1280 TURNING SECTION
1281 TURNING ARM
1282 MAIN BODY SECTION
1284 HOOK SECTION
1286 NEEDLE THREAD MOTOR
1288 NEEDLE THREAD SUPPORT MEMBER
1290 GUIDE MEMBER
1300, 1302 NEEDLE THREAD GUIDE
1310 CASE
1312 ARM
1314 NEEDLE BAR CASE
1330 NEEDLE BAR CASE MAIN BODY
1332 ENCLOSURE SECTION
1334 RAIL SECTION
1336 GUIDE MEMBER
1337 TENSION SPRING
1340 NEEDLE THREAD CONTROL MOUNTING SECTION
1341 PLATE SECTION
2100 SHUTTLE
2110 OUTER SHUTTLE
2130 MIDDLE SHUTTLE PRESSER
2150 MIDDLE SHUTTLE
2200 BOBBIN
2210 BOBBIN CASE
J NEEDLE THREAD
R BOBBIN THREAD
R-1 ANGLE SHIFT
R-2 ANGLE SHIFT

The invention claimed is:

1. A sewing machine comprising:

thread take-up lever formed in a swayable manner, a needle thread control section, a memory section, and a control section, wherein the needle thread control section that is disposed at an upstream position in a needle thread path of the thread take-up lever and that controls tension on a needle thread, has an upstream grip section including an upstream grip section main body which grips a needle thread in a pinching manner and an upstream actuation section that performs, with respect to the upstream grip section main body, switching between a closed state in which the needle thread is gripped and an open state in which the needle thread is released from a gripped state, a downstream grip section that is disposed at a downstream position in the needle thread path of the upstream grip section and that has a downstream grip section main body which grips a needle thread in a pinching manner and a downstream actuation section that performs, with respect to the downstream grip section main body, switching between a closed state in which the needle thread is gripped and an open state in which the needle thread is released from a gripped state, and a turning section that turns the needle thread between the upstream grip section main body and the downstream grip section main body and that has a turning arm which contacts the needle thread and a needle thread motor which turns the turning arm;

the memory section stores torque data and needle thread quantity data, wherein the torque data stores a torque value for controlling a needle thread on a per-stitch basis in sewing data, the needle thread quantity data has precorrected needle thread requirement data and postcorrected needle thread requirement data, the precorrected needle thread requirement data stores a needle thread requirement showing a length of a required needle thread, on a per-stitch basis in the sewing data, and the postcorrected needle thread requirement data stores the needle thread requirement of the precorrected needle thread requirement data on a per-stitch basis in the sewing data, in which the needle thread requirement in the postcorrected needle thread requirement data is updated to the postcorrected needle thread requirement for a stitch where the needle thread requirement has been corrected by the control section; and when performing sewing operation in accordance with sewing data in the control zone for each stitch, the control section, in a torque control zone that is a zone including at least a portion from one dead point to the other dead point of the thread take-up lever in which the thread take-up lever pulls the needle thread with respect to a process fabric to be sewn with the needle thread, imparts a rotating force to the turning arm, while closing the upstream grip section main body and while opening the downstream grip body, by controlling the needle thread motor according to the torque value of the torque data so as to impart a tension to the needle thread against a direction in which the thread take-up lever pulls the needle thread;

in a first position control zone that is at least a portion of a zone other than the torque control zone, turns the turning arm in the same direction as the rotating force is imparted to the turning arm in the torque control zone so as to pull out the needle thread from an upstream position, while opening the upstream grip section main body and while closing the downstream grip body, by controlling the needle thread motor so as to rotate through an angle corresponding to the needle thread requirement in the postcorrected needle thread requirement data for a stitch of an immediately-arriving torque control zone;

in a second position control zone that is at least a portion of the zone other than the torque control zone and subsequent to the first position control zone, controls the needle thread motor, while closing the upstream grip section main body and while opening the downstream grip body, such that the angle of the needle thread motor returns to an initial position at the angle of the needle thread motor that is the position of the needle thread motor in its rotating direction; and in relation to a target stitch that is one to be sequentially specified among stitches in the sewing data or a plurality of stitches including the target stitch, compares needle thread consumption showing the length of the needle thread used in the torque control zone with the needle thread requirement in the precorrected needle thread requirement data, performs a correction to increase the needle thread requirement in the postcorrected needle thread requirement data for the stitch next to the target stitch and subsequent stitches when the needle thread requirement is larger than the needle thread consumption, and performs a correction to decrease the needle thread requirement in the postcorrected needle thread requirement data for the stitch next to the target stitch and subsequent stitches when the needle thread requirement is smaller than the needle thread consumption.

2. The sewing machine according to claim 1, wherein an angle corresponding to the needle thread requirement in the postcorrected needle thread requirement data for a stitch of the immediately-arriving torque control zone is an angle that is specified by the angle of the needle thread motor at a starting point of the first position control zone and the needle thread requirement of the postcorrected needle thread requirement data for the stitch of the immediately-arriving torque control zone.

3. The sewing machine according to claim 1, wherein the needle thread consumption is a length specified by the turning angle of the turning arm in the torque control zone.

4. The sewing machine according to claim 1, wherein the control section sequentially takes each stitch in the sewing data as a target stitch and compares, on each target stitch, the needle thread consumption with the needle thread requirement in the precorrected needle thread requirement data.

5. The sewing machine according to claim 1, wherein the control section compares, with regard to a stitch group that includes a target stitch and a stitch preceding the target stitch and that is made up of a plurality of stitches exhibiting continuity, compares an aggregate of needle thread consumption with an aggregate of needle thread requirement in the precorrected needle thread requirement data, thus compares the needle thread consumption with the needle thread requirement in the precorrected needle thread requirement, and takes respective stitches in the sewing data sequentially as a target stitch.

6. The sewing machine according to claim 1, wherein the control section compares, with regard to a stitch group that includes a target stitch and a stitch preceding the target stitch and that is made up of a plurality of stitches exhibiting continuity, compares an aggregate of needle thread consumption with an aggregate of needle thread requirement in the precorrected needle thread requirement data, thus compares the needle thread consumption with the needle thread requirement in the precorrected needle thread requirement, and sets a target stitch for each number of stitches that make up a stitch group.

7. The sewing machine according to claim 1, wherein one unit correction value of absolute value to be used for correcting the needle thread requirement in the postcorrected needle thread requirement is provided, and, during the correction of the needle thread requirement, the control section increases or decreases the unit correction value with reference to the needle thread requirement.

8. The sewing machine according to claim 7, wherein the sewing machine is equipped with an input section for entering the unit correction value.

9. The sewing machine according to claim 1, wherein a plurality of unit correction values of absolute value to be used for correcting the needle thread requirement in the postcorrected needle thread requirement are provided; the plurality of unit correction values are different from each other; and, during the correction of the needle thread requirement, the control section increases or decreases the unit correction value selected from the plurality of unit correction values, with reference to the needle thread requirement.

10. The sewing machine according to claim 9, wherein, during correction of the needle thread requirement in the postcorrected needle thread requirement, the control section selects a unit correction value from the plurality of unit correction values according to the magnitude of the absolute value of a value determined by subtracting the needle thread consumption from the needle thread requirement in the precorrected needle thread requirement data, and selects the unit correction value such that the unit correction value becomes larger as the magnitude of the absolute becomes larger.

11. The sewing machine according to claim 9, wherein, during correction of the needle thread requirement in the postcorrected needle thread requirement, the control section selects a unit correction value from the plurality of unit correction values according to the number of times either positive or negative values, which are determined by subtracting the needle thread consumption from the needle thread requirement in the precorrected needle thread requirement data, are continuous; and selects the unit correction value such that the unit correction value becomes greater as the number of times either the positive or negative values are continuous becomes larger.

12. The sewing machine according to claim 1, or 8, wherein the needle thread requirement in the precorrected needle thread requirement data is calculated from a switch width and the thickness of the process fabric.

13. The sewing machine according to claim 12, wherein the needle thread requirement in the precorrected needle thread requirement data is calculated as a result of the length of the needle thread on the back of the process fabric being calculated according to a ratio between the length of the needle thread and the length of a bobbin thread on the back of the process fabric where the bobbin thread appears.

14. The sewing machine according to claim 13, wherein the length of the needle thread on the back of the process fabric is calculated by weighting the length of the needle thread on the back of the process fabric, which is based on the ratio between the length of the needle thread and the length of the bobbin thread on the back of the process fabric, by the magnitude of an inner angle which a stitching direction of a stitch forms with a stitching direction of another stitch immediately preceding the stitch and which is an acute angle.

15. The sewing machine according to claim 14, wherein the coefficient achieved when the inner angle is 0 degree is 1; the coefficient achieved when the inner angle is 180 degrees is 0; and the coefficient is proportional to the angle.

16. The sewing machine according to claim 1, wherein the needle thread requirement in the precorrected needle thread requirement data is calculated according to an expression of $L+2\times T+L\times A/(A+B)$, provided the stitch width is L, the ratio between the length of the needle thread and the length of the bobbin thread on the back of the process fabric is A:B, and the thickness of the process fabric is T.

17. The sewing machine according to claim 1, wherein the needle thread requirement in the precorrected needle thread requirement data is calculated according to an expression of $L+2\times T+L\times A/(A+B)\times W$, provided the stitch width is L, the ratio between the length of the needle thread and the length of the bobbin thread on the back of the process fabric is A:B, a coefficient corresponding to the magnitude of an inner angle which a stitching direction of a stitch forms with a stitching direction of another stitch immediately preceding the stitch and which is an acute angle is W, and the thickness of the process fabric is T.

18. The sewing machine according to claim 1, further comprising an input section for entering data on each stitch width and data on the thickness of the process fabric; the control section generates the precorrected needle thread requirement data by calculating the length of the required needle thread from the data on the stitch width and the data on the thickness of the process fabric entered from the input section; and the thus-generated needle thread requirement is stored in the memory section.

19. The sewing machine according to claim 18, wherein, in relation to each stitch, data on the ratio between the length of the needle thread and the length of the bobbin thread on the back of the process fabric where the bobbin thread appears is entered from the input section, and the control section calculates the needle thread requirement in the precorrected needle thread requirement data by calculating the length of the needle thread on the back of the process fabric from the ratio.

20. The sewing machine according to claim 19, wherein either data on the stitching direction of each stitch or data on the magnitude of the inner angle which the stitching direction of the stitch forms with the stitching direction of another stitch immediately preceding the stitch and which is an acute angle is entered from the input section; and the control section calculated the length of the needle thread on the back of the process fabric by weighting the length of the needle thread which is based on the ratio between the length of the needle thread and the length of the bobbin thread on the back of the process fabric by the magnitude of the inner angle.

21. The sewing machine according to claim 1, further comprising the input section for entering data on stitch width of each stitch, data for each stitch on the ratio between the length of the needle thread and the length of the bobbin thread on the back of the process fabric where the bobbin thread appears, and data on the thickness of the process fabric, wherein the control section generates the precorrected needle thread requirement data by calculating on the basis of the data entered by the input section according to $L+2\times T+L\times A/(A+B)$, provided the stitch width is L, the thickness of the process fabric is T, and the ratio is A:B, and the generated precorrected needle thread requirement data is stored in the memory section.

22. The sewing machine according to claim 1 further comprising an input section for entering either data on the stitching direction of each stitch or data on the magnitude of an inner angle which the stitching direction of a stitch forms with the stitching direction of another stitch immediately preceding the stitch and which is an acute angle, data on the stitch width of each stitch, data for each stitch on a ratio between the length of the needle thread and the length of the bobbin thread on the back of the process fabric where the bobbin thread appears, and data on the thickness of the process fabric, wherein the control section generates the precorrected needle thread requirement data by calculating on the basis of the data entered by the input section according to $L+2\times T+L\times A/(A+B)\times W$, provided the stitch width is L, the thickness of the process fabric is T, the ratio is A:B, and a coefficient corresponding to the magnitude of the inner angle is W, and the generated precorrected needle thread requirement data is stored in the memory section.

23. The sewing machine according to claim 1, wherein the end point of the torque control zone coincides with the starting point of the first position control zone; the end point of the first position control zone coincides with the starting point of the second position control zone; the end point of the second position control zone coincides with the starting point of the torque control zone; and, in the first position control zone, the control section detects a current position at the angle of the needle thread motor at the starting point of the first position control zone; generates first angle correspondence data which specifies angle of the needle thread motor from the current position at the angle of the needle thread motor to the position where the needle thread motor rotates through an angle specified on the basis of the current position at the angle of the needle thread motor and the needle thread requirement in the post-corrected needle thread requirement data on each angle of the main spindle motor that is a position of a main spindle in its rotation direction where the main spindle motor transmit power to the thread take-up lever; and controls the position of the needle thread motor at the angle of the needle thread motor corresponding to the angle of the main spindle motor as the main spindle motor rotates and the angle of the main spindle motor changes;

in the second position control zone, detects the current position at the angle of the needle thread motor at the starting point of the second position control zone; generates second angle correspondence data which specifies the angle of the needle thread motor from the angle at the current position of the needle thread motor to the initial position on each angle of the main spindle motor; and controls the position of the needle thread motor at the angle of the needle thread motor commensurate with the angle of the main spindle motor as the main spindle motor rotates and the angle of the main spindle motor rates.

* * * * *